US010030655B2

(12) United States Patent
Terada

(10) Patent No.: US 10,030,655 B2
(45) Date of Patent: Jul. 24, 2018

(54) OIL PUMP

(71) Applicant: AISIN SEIKI KABUSHIKI KAISHA, Kariya-shi, Aichi-ken (JP)

(72) Inventor: Mitsuru Terada, Okazaki (JP)

(73) Assignee: AISIN SEIKI KABUSHIKI KAISHA, Kariya-shi, Aichi-ken (JP)

( * ) Notice: Subject to any disclaimer, the term of this patent is extended or adjusted under 35 U.S.C. 154(b) by 168 days.

(21) Appl. No.: 14/916,901

(22) PCT Filed: Sep. 1, 2014

(86) PCT No.: PCT/JP2014/072880

§ 371 (c)(1),
(2) Date: Mar. 4, 2016

(87) PCT Pub. No.: WO2015/045744

PCT Pub. Date: Apr. 2, 2015

(65) Prior Publication Data

US 2016/0215775 A1 Jul. 28, 2016

(30) Foreign Application Priority Data

Sep. 24, 2013 (JP) ..... 2013-196376
Oct. 30, 2013 (JP) ..... 2013-224862

(51) Int. Cl.
*F04C 14/22* (2006.01)
*F04C 2/34* (2006.01)
(Continued)

(52) U.S. Cl.
CPC ..... *F04C 14/223* (2013.01); *F04C 2/332* (2013.01); *F04C 2/3448* (2013.01);
(Continued)

(58) Field of Classification Search
CPC ..... F04C 13/001; F04C 14/223; F04C 15/06; F04C 2/332; F04C 2/3448; F04C 2210/206
(Continued)

(56) References Cited

U.S. PATENT DOCUMENTS 2,250,947 A 7/1941 Carpenter, Jr.
7,736,134 B2 6/2010 Schneider
(Continued)

FOREIGN PATENT DOCUMENTS

CN 101163883 A 4/2008
GB 319467 A 9/1929
(Continued)

OTHER PUBLICATIONS

International Search Report (PCT/ISA/210) dated Sep. 9, 2014, by the Japanese Patent Office as the International Searching Authority for International Application No. PCT/JP2014/072880.
(Continued)

*Primary Examiner* — Mary A Davis
*Assistant Examiner* — Dapinder Singh
(74) *Attorney, Agent, or Firm* — Buchanan Ingersoll & Rooney PC

(57) ABSTRACT

This oil pump is equipped with a rotatable inner rotor that includes a vane-housing unit housing multiple vanes so as to be capable of sliding in the radial direction, a rotatable annular outer rotor that includes multiple vane-connecting parts connecting the tip ends of the multiple vanes on the outside in the radial direction, first volume-changing parts, which are provided between the inner rotor and the outer rotor, and a first volume of which is changed in response to eccentricity of the inner rotor with respect to the outer rotor, thereby providing a pumping function, and second volume-changing parts, which are provided in the outer rotor, and a second volume of which is changed by a change in the distance between adjacent vane-connecting parts in the circumferential direction in response to eccentricity of the inner rotor with respect to the outer rotor, thereby providing a pumping function.

14 Claims, 14 Drawing Sheets

(51) Int. Cl.

| | |
|---|---|
| ***F04C 13/00*** | (2006.01) |
| ***F04C 15/00*** | (2006.01) |
| ***F04C 2/344*** | (2006.01) |
| ***F04C 15/06*** | (2006.01) |
| ***F04C 2/332*** | (2006.01) |

(52) U.S. Cl.
CPC ..... *F04C 13/001* (2013.01); *F04C 15/06* (2013.01); *F04C 2210/206* (2013.01)

(58) Field of Classification Search
USPC ..... 418/5, 23, 24, 26, 173
See application file for complete search history.

(56) References Cited

U.S. PATENT DOCUMENTS

| | | | | |
|---|---|---|---|---|
| 8,690,544 | B2 | 4/2014 | Ono | |
| 2007/0292291 | A1 | 12/2007 | Schneider et al. | |
| 2012/0275945 | A1 | 11/2012 | Schulz-Andres et al. | |
| 2012/0292292 | A1* | 11/2012 | Lin | B23H 5/02 219/69.12 |
| 2012/0301342 | A1 | 11/2012 | Ohnishi et al. | |
| 2013/0164162 | A1 | 6/2013 | Saga | |
| 2014/0170008 | A1 | 6/2014 | Watanabe et al. | |

FOREIGN PATENT DOCUMENTS

| | | | |
|---|---|---|---|
| JP | 48-43601 | Y1 | 12/1973 |
| JP | 50-16903 | A | 2/1975 |
| JP | 07-010483 | U | 2/1995 |
| JP | 2009-510332 | A | 3/2009 |
| JP | 2012145095 | A | 8/2012 |
| JP | 2012-255439 | A | 12/2012 |
| JP | 2013-510975 | A | 3/2013 |
| JP | 2013-221464 | A | 10/2013 |

OTHER PUBLICATIONS

Written Opinion (PCT/ISA/237) dated Sep. 9, 2014, by the Japanese Patent Office as the International Searching Authority for International Application No. PCT/JP2014/072880.

* cited by examiner (FIRST EMBODIMENT)

OIL PUMP

TECHNICAL FIELD

The present invention relates to an oil pump, and more particularly, it relates to an oil pump including an inner rotor, an outer rotor, and multiple vanes connecting the outer periphery of the inner rotor and the inner periphery of the outer rotor.

BACKGROUND ART

In general, an oil pump including an inner rotor, an outer rotor, and multiple vanes connecting the outer periphery of the inner rotor and the inner periphery of the outer rotor is known. Such an oil pump is disclosed in Japanese Patent Laying-Open No. 2012-255439, for example.

In Japanese Patent Laying-Open No. 2012-255439, there is disclosed a pendulum-slider pump (oil pump) including an inner rotor rotationally driven, an outer rotor arranged to surround the inner rotor, configured to be rotatable outside the inner rotor, and multiple pendulums (vanes) connecting the outer periphery of the inner rotor and the inner periphery of the outer rotor. In this pendulum-slider pump described in Japanese Patent Laying-Open No. 2012-255439, a first end (tip end) of each of the pendulums is hinged to the outer periphery of the inner rotor, and a second end (base part) of each of the pendulums is fitted into a recess part of the outer rotor formed to correspond to each of the pendulums. In response to relative eccentricity between the inner rotor and the outer rotor, each of the pendulums is sequentially rotationally moved while swinging about a connecting part with the inner rotor along with the rotation of the inner rotor, and the second end of each of the pendulums is displaced to freely appear from and disappear into the recess part of the outer rotor. At this time, multiple volume chambers individually partitioned by the pendulums are sequentially repetitively deformed along with the rotation of the inner rotor, thereby providing a pumping function.

Furthermore, in order to cause the pendulums to swing (turn), an intermediate part of each of the pendulums connecting the first end and the second end is narrower than both ends (the first end and the second end). Thus, the intermediate part entering the recess part of the outer rotor is prevented from contacting with an inner wall of the recess part due to swing (inclination) of the pendulums. In addition, each of the pendulums swings, whereby both the inner rotor and the outer rotor having relative eccentricity smoothly rotate.

PRIOR ART

Patent Document

Patent Document 1: Japanese Patent Laying-Open No. 2012-255439

SUMMARY OF THE INVENTION

Problem to be Solved by the Invention

In the pendulum-slider pump (oil pump) described in Japanese Patent Laying-Open No. 2012-255439, although the multiple volume chambers individually partitioned by the pendulums are sequentially repetitively deformed along with the rotation of the inner rotor, thereby providing the pumping function, there is such a problem that a net rate of discharge of oil per unit rotation cannot be sufficiently increased because of the difficulty of sufficiently utilizing the amount of change in volume other than the volume of the multiple volume chambers partitioned by the pendulums.

The present invention has been proposed in order to solve the aforementioned problem, and an object of the present invention is to provide an oil pump capable of sufficiently increasing a net rate of discharge of oil per unit rotation.

Means for Solving the Problem

In order to attain the aforementioned object, an oil pump according to an aspect of the present invention includes a rotatable inner rotor that includes a vane-housing unit housing multiple vanes so as to be capable of sliding in a radial direction, a rotatable annular outer rotor that includes multiple vane-connecting parts connecting tip ends of the multiple vanes on the outside in the radial direction, first volume-changing parts, which are provided between the inner rotor and the outer rotor, and the first volume of which is changed in response to the eccentricity of the inner rotor with respect to the outer rotor, thereby providing a pumping function, and second volume-changing parts, which are provided in the outer rotor, and the second volume of which is changed by a change in a distance between adjacent vane-connecting parts in a circumferential direction in response to the eccentricity of the inner rotor with respect to the outer rotor, thereby providing a pumping function.

As hereinabove described, the oil pump according to the aspect of the present invention includes the inner rotor that includes the vane-housing unit housing the multiple vanes so as to be capable of sliding in the radial direction, the outer rotor that includes the multiple vane-connecting parts connecting the tip ends of the multiple vanes on the outside in the radial direction, the first volume-changing parts, the first volume of which is changed in response to the eccentricity of the inner rotor with respect to the outer rotor, thereby providing the pumping function, and the second volume-changing parts, which are provided in the outer rotor, and the second volume of which is changed by the change in the distance between the adjacent vane-connecting parts in the circumferential direction in response to the eccentricity of the inner rotor with respect to the outer rotor, thereby providing the pumping function. Thus, in addition to the highly-efficient pumping of the first volume-changing parts partitioned by the vanes, the pumping of the second volume-changing parts newly provided in the outer rotor can be effectively utilized. Therefore, a net rate of discharge of oil per unit rotation in the oil pump can be sufficiently increased. Consequently, the pumping efficiency can be improved. When compared at the same rate of discharge, the oil pump can be reduced in size, and hence the mountability of the oil pump to a device (apparatus) can be improved. Furthermore, the oil pump is reduced in size so that a mechanical loss during driving of the oil pump can be reduced, and hence the load of a drive source driving the oil pump is reduced so that the energy can be saved.

The aforementioned oil pump according to the aspect preferably further includes third volume-changing parts, the third volume of which in the vane-housing unit of the inner rotor is changed by slide of the multiple vanes in the radial direction in response to the eccentricity of the inner rotor with respect to the outer rotor, thereby providing a pumping function. According to this structure, the oil pump can be configured to incorporate the change in the volume of the third volume-changing parts in the vane-housing unit by the linear slide of the vanes in the radial direction with respect to the vane-housing unit into the pumping including the suction and discharge of the oil in addition to the pumping of the first volume-changing parts and the second volume-changing parts, and hence the pumping of the third volume-changing parts is effectively added so that the rate of discharge of the oil per unit rotation that the oil pump has can be further increased. Consequently, the oil pump can be further reduced in size. In the aforementioned Patent Document 1, the intermediate part of each of the swinging pendulums is narrower than both ends, and hence a new space part (volume part) is collaterally generated between the narrowed intermediate part of each of the pendulums and the recess part of the outer rotor when the second end (base part) of each of the pendulums deeply enters the recess part so that a volume chamber surrounded by the base part and the recess part is minimized. In the aforementioned oil pump according to the aspect, on the other hand, the vanes linearly sliding in the radial direction are used, and hence it is not necessary to narrow an intermediate part of each of the vanes that appears from and disappears into the vane-housing unit. Therefore, no minus factor (wasted work) to newly increase the volume (newly form volume chambers) in parts of the third volume-changing parts on the side of the first volume-changing parts is generated during a decrease change in the third volume of the third volume-changing parts, and hence the changes in the volumes of the first, second, and third volume-changing parts can effectively work on the pumping of the entire oil pump.

The aforementioned structure further including the third volume-changing parts preferably further includes a suction port that suctions oil and a discharge port that discharges the oil, and in the suction port, the third volume in the vane-housing unit of the inner rotor is preferably gradually increased by gradual slide of the vanes, housed in the vane-housing unit, to the outside in the radial direction while in the discharge port, the third volume in the vane-housing unit of the inner rotor is preferably gradually decreased by the gradual slide of the vanes, housed in the vane-housing unit, to the inside in the radial direction. According to this structure, the change in the third volume generated by repeating appearance (increase) from and disappearance (decrease) into the vane-housing unit along with back-and-forth linear movement of the vanes to the outside and the inside in the radial direction can be easily utilized as pumping. At this time, the drive force of the oil pump can be converted to not only the change in the volume (first volume) of the first volume-changing parts and the change in the volume (second volume) of the second volume-changing parts following the slide of the vanes but also the change in the volume (third volume) of the third volume-changing parts following the slide of the vanes, and hence the mechanical efficiency of the oil pump can be improved without wasting the drive force.

In the aforementioned structure further including the third volume-changing parts, the thickness of each of parts of the vanes housed in the vane-housing unit is preferably constant. According to this structure, the vanes including the parts housed in the vane-housing unit, the thickness of which is constant, are used, whereby the vanes can stably slide in the radial direction without backlash in the vane-housing unit. Furthermore, no backlash of the vanes is generated during back-and-forth movement, and hence the airtightness can be improved when the third volume-changing parts (third volume) repeat their enlargement (increase) and shrinkage (decrease). Thus, the pumping efficiency of the third volume-changing parts can be maintained at a high level.

In the aforementioned oil pump according to the aspect, the second volume-changing parts are preferably configured to be capable of changing the second volume by the change in the distance between the multiple vane-connecting parts of the outer rotor in the circumferential direction by changes in the radial slide positions of the tip ends of the vanes on the outside in the radial direction in response to the eccentricity of the inner rotor with respect to the outer rotor, the outer rotor preferably includes multiple outer rotor pieces, each of which is provided for each of the multiple vanes and includes a vane-connecting part, the multiple outer rotor pieces are preferably circumferentially arranged in a state where adjacent outer rotor pieces engage with each other so as to be capable of changing a distance therebetween in the circumferential direction, the adjacent outer rotor pieces preferably engage with each other in the circumferential direction while having engagement spaces constituting the second volume changing-parts, and the second volume of the engagement spaces is preferably changed by a change in the distance between the adjacent outer rotor pieces in the circumferential direction. According to this structure, properly utilizing the displacement of the radial slide positions of the tip ends of the vanes on the outside in the radial direction, distances between the multiple vane-connecting parts of the outer rotor in the circumferential direction can be easily changed (increased and decreased). Thus, properly utilizing the drive force of the vanes in the radial direction, the second volume changing-parts can perform the pumping function.

Furthermore, the multiple outer rotor pieces are circumferentially arranged in the state where the adjacent outer rotor pieces engage with each other so as to be capable of changing the distance therebetween in the circumferential direction, whereby properly utilizing the movement (expansion and contraction) of the adjacent outer rotor pieces away from and toward each other in the circumferential direction, the second volume changing-parts (second volume) can perform the pumping function of repeating their enlargement (increase) and shrinkage (decrease). Moreover, the second volume of the engagement spaces is changed by the change in the distance between the adjacent outer rotor pieces in the circumferential direction, whereby properly utilizing, as the second volume, the engagement spaces generated when the outer rotor pieces engage with each other, the second volume changing-parts can perform the pumping function of repeating an increase and decrease in the second volume.

In the aforementioned structure in which the second volume changing-parts can change the second volume in response to the eccentricity of the inner rotor with respect to the outer rotor, grooves or holes that allow the engagement spaces constituting the second volume-changing parts and the first volume-changing parts to communicate with each other are preferably provided. According to this structure, the first volume-changing parts having the first volume and the second volume-changing parts having the second volume are allowed to communicate with each other through the grooves or holes, and hence the oil can be suctioned into both the first volume-changing parts and the second volume-changing parts when the volume chambers are enlarged. When the volume chambers are shrunk, the oil can be discharged from both the first volume-changing parts and the second volume-changing parts.

In the aforementioned structure in which the adjacent outer rotor pieces engage with each other in the circumferential direction while having the engagement spaces constituting the second volume changing-parts, the engagement spaces constituting the second volume-changing parts each preferably include a first engagement space located on a first side between two adjacent vanes and a second engagement space located on a second side between the two adjacent vanes. According to this structure, when the generally annular outer rotor is configured by sequentially connecting the adjacent outer rotor pieces to each other, each of the outer rotor pieces can easily engage with an outer rotor piece adjacent on the first side (right side, for example) relative to itself through the first engagement space, and each of the outer rotor pieces can easily engage with an outer rotor piece adjacent on the second side (left side, for example) relative to itself through the second engagement space, for example.

The aforementioned structure in which the second volume-changing parts can change the second volume in response to the eccentricity of the inner rotor with respect to the outer rotor preferably further includes a suction port that suctions oil and a discharge port that discharges the oil, the outer rotor preferably includes multiple outer rotor pieces, each of which is provided for each of the multiple vanes and includes the vane-connecting part, and in the suction port, the second volume is preferably gradually increased by a gradual increase in the distance between the adjacent outer rotor pieces in the circumferential direction while in the discharge port, the second volume is preferably gradually decreased by a gradual decrease in the distance between the adjacent outer rotor pieces in the circumferential direction. According to this structure, the second volume of each of the second volume-changing parts can be increased or decreased in synchronization with the timing of sequentially passing through the suction port or the discharge port when the annular outer rotor is rotated, and hence the second volume-changing parts can effectively perform their pumping function.

The aforementioned oil pump according to the aspect preferably further includes a rotor-housing unit that houses the inner rotor and is movable in a first direction so as to change the eccentricity of the inner rotor, a suction port that suctions oil and a discharge port that discharges the oil, and a cam member linearly moved in a second direction orthogonal to the first direction in response to the discharge pressure of the oil from the discharge port, including a cam region provided to increase and decrease the eccentricity of the inner rotor by moving the rotor-housing unit in the first direction following linear movement in one direction of the second direction. According to this structure, a change can be easily made by increasing or decreasing the eccentricity of the inner rotor while moving the rotor-housing unit in the first direction through the cam region provided in the cam member following the linear movement of the cam member in one direction of the second direction in response to the discharge pressure of the oil. Therefore, according to the present invention, only the movement in one direction enables an increase and decrease in the eccentricity of the inner rotor, and hence it is not necessary to switch a position on which the oil pressure acts in response to the discharge pressure (the rotational speed of an internal combustion) of the oil. Consequently, it is not necessary to provide a hydraulic direction switching valve or the like, and hence the structure of the oil pump can be further simplified.

In the aforementioned structure further including the rotor-housing unit and the cam member, the cam member preferably includes a spool member linearly moved in the second direction in response to the discharge pressure of the oil, the rotor-housing unit preferably includes a cam engaging part arranged to face the cam region of the spool member, the amount of protrusion of the cam region of the spool member with respect to the cam engaging part of the rotor-housing unit preferably changes along the second direction, and the rotor-housing unit is preferably moved in the first direction in response to a change in the amount of protrusion of the cam region associated with movement of the spool member in one direction of the second direction so that the eccentricity of the inner rotor is increased or decreased. According to this structure, effectively utilizing a cam mechanism including the cam region of the spool member and the cam engaging part of the rotor-housing unit, the eccentricity of the inner rotor can be increased or decreased directly following the change in the amount of protrusion of the cam region associated with the movement of the spool member in one direction of the second direction.

In the aforementioned structure in which the cam member includes the spool member linearly moved in the second direction in response to the discharge pressure of the oil, the cam region of the spool member preferably includes a first cam region arranged to face the cam engaging part of the rotor-housing unit when the discharge pressure of the oil from the discharge port is within a first pressure range, a second cam region engaging with the cam engaging part of the rotor-housing unit when the discharge pressure of the oil from the discharge port is within a second pressure range larger than the first pressure range, and a third cam region engaging with the cam engaging part of the rotor-housing unit when the discharge pressure of the oil from the discharge port is within a third pressure range larger than the second pressure range, and when the spool member is moved in one direction of the second direction so as to sequentially switch the cam region of the cam member to the first cam region, the second cam region, and the third cam region in response to an increase in the discharge pressure of the oil from the discharge port, the amount of movement of the rotor-housing unit in the first direction with respect to the rotation center of the inner rotor and the eccentricity of the inner rotor are preferably decreased in a case of the second cam region, and the amount of the movement of the rotor-housing unit in the first direction and the eccentricity of the inner rotor are preferably increased in a case of the third cam region from a state where the amount of the movement of the rotor-housing unit in the first direction with respect to the rotation center of the inner rotor and the eccentricity of the inner rotor are decreased in the case of the second cam region. According to this structure, based on the first cam region corresponding to the case where the discharge pressure of the oil from the discharge port is within the first pressure range, the cam region of the spool member is sequentially switched from the first cam region to the second cam region and from the second cam region to the third cam region along one direction of the second direction when the discharge pressure of the oil is increased from the first pressure range to the second pressure range and from the second pressure range to the third pressure range, and the eccentricity of the inner rotor can be both increased and decreased by the switching of the cam region following the movement of the spool member in one direction. Therefore, desired discharge pressure characteristics can be easily generated in the oil pump.

In the aforementioned structure in which the cam region includes the first cam region, the second cam region, and the third cam region, the first cam region is preferably formed such that the eccentricity of the inner rotor associated with the movement of the rotor-housing unit in the first direction is first eccentricity, the second cam region is preferably formed such that the eccentricity of the inner rotor associated with the movement of the rotor-housing unit in the first direction is second eccentricity smaller than the first eccentricity, and the third cam region is preferably formed such that the eccentricity of the inner rotor associated with the movement of the rotor-housing unit in the first direction is third eccentricity larger than the minimum value of the second eccentricity. According to this structure, based on the pump capacity in the case where the discharge pressure of the oil is within the first pressure range, the pump capacity in the case where the discharge pressure of the oil is within the second pressure range can be adjusted to be smaller than the pump capacity in the case where the discharge pressure of the oil is within the first pressure range, and the pump capacity in the case where the discharge pressure of the oil is within the third pressure range can be adjusted to be larger than the pump capacity in the case where the discharge pressure of the oil is within the second pressure range and smaller than the pump capacity in the case where the discharge pressure of the oil is within the first pressure range.

In this case, the second cam region is preferably provided such that the eccentricity of the inner rotor is decreased from the first eccentricity to the second eccentricity toward the third cam region, and the third cam region is preferably provided such that the eccentricity of the inner rotor is increased from the second eccentricity to the third eccentricity toward a side opposite to the second cam region. According to this structure, when the spool member is moved in one direction of the second direction, the eccentricity of the inner rotor associated with the movement of the rotor-housing unit in the first direction can be easily decreased in the case of the second cam region. Furthermore, when the spool member is moved on one direction of the second direction, the eccentricity of the inner rotor associated with the movement of the rotor-housing unit in the first direction can be easily increased in the case of the third cam region.

In the aforementioned structure in which the cam region includes the first cam region, the second cam region, and the third cam region, the first cam region of the spool member is preferably linearly moved to a position corresponding to the cam engaging part of the rotor-housing unit in the first pressure range so that the rotor-housing unit is linearly moved to a first eccentricity position in the first direction and the eccentricity of the inner rotor with respect to the outer rotor is changed to first eccentricity, which is maximum eccentricity, the second cam region of the spool member is preferably linearly moved to a position engaging with the cam engaging part of the rotor-housing unit in the second pressure range so that the rotor-housing unit is linearly moved to a second eccentricity position in the first direction and the eccentricity of the inner rotor with respect to the outer rotor is changed to second eccentricity smaller than the first eccentricity, and the third cam region of the spool member is preferably linearly moved to the position engaging with the cam engaging part of the rotor-housing unit in the third pressure range so that the rotor-housing unit is linearly moved to a third eccentricity position in the first direction and the eccentricity of the inner rotor with respect to the outer rotor is changed to third eccentricity larger than the minimum value of the second eccentricity. According to this structure, the rotor-housing unit can be moved to any of the first eccentricity position, the second eccentricity position, and the third eccentricity position corresponding to the first pressure range, the second pressure range, and the third pressure range, respectively, and the eccentricity of the inner rotor can be properly adjusted to the first eccentricity, the second eccentricity, and the third eccentricity. Therefore, the oil pump capable of accurately exhibiting the required discharge pressure characteristics can be obtained.

The aforementioned structure further including the rotor-housing unit and the cam member preferably further includes a first urging member that urges the rotor-housing unit toward the cam member and a second urging member that urges the cam member toward a position on the side of the discharge port. According to this structure, when the rotor-housing unit is moved in the first direction following the linear movement of the cam member in one direction of the second direction, the rotor-housing unit can be moved in the first direction while properly following the cam shape (concave-convex shape) of the cam region of the cam member by the urging force of the first urging member on the rotor-housing unit toward the cam member. Furthermore, the second urging member that urges the cam member toward a position on the side of the discharge port is provided, whereby when the discharge pressure of the oil from the discharge port is decreased, the cam member can be easily pushed back in another direction opposite to one direction of the second direction by the urging force of the second urging member. Thus, the cam member can perform a reversible operation in response to the discharge pressure of the oil.

According to the present application, the following structure is also conceivable in the aforementioned oil pump according to the aspect.

More specifically, in the aforementioned oil pump according to the aspect, an oil film is preferably formed on the outer surface of the outer rotor. According to this structure, even when the outer rotor includes the multiple vane-connecting parts and is configured to involve the change in its shape causing the change in the second volume of the second volume-changing parts resulting from the change in the distance between the adjacent vane-connecting parts in the circumferential direction, the oil film is formed on the outer surface of the outer rotor so that the annular outer rotor involving this change in its shape can be smoothly rotated in a casing of the oil pump. Furthermore, due to this oil film, the second volume of the second volume-changing parts can be smoothly changed.

In the aforementioned oil pump according to the aspect, the multiple vanes are preferably mounted on the vane-housing unit of the inner rotor so as to be capable of sliding in the radial direction without swinging in the circumferential direction. According to this structure, the vanes can appear from and disappear into the vane-housing unit while linearly (one-dimensionally) sliding along the radial direction when the oil pump operates, and hence it is not necessary to form, in the vanes, such a unique shape that the intermediate part of each of the vanes that appears from and disappears into the vane-housing unit is narrowed, for example. In other words, unlike the swinging pendulums (vanes) having the intermediate parts narrower than both ends, a factor to reduce the pumping efficiency due to the unique shape of the intermediate part can be removed. Therefore, the highly-efficient pumping function can be provided to the oil pump.

In the aforementioned oil pump in which the outer rotor includes the multiple outer rotor pieces, the outer rotor pieces each have engaging pieces engageable with each other in the circumferential direction in a state where the adjacent outer rotor pieces overlap each other in the radial direction, and the engagement spaces constituting the second volume-changing parts are configured to change the second volume by the change in a distance between the engaging pieces in the circumferential direction in response to the amount of overlap of the engaging pieces. According to this structure, the second volume of the engagement spaces can be easily increased or decreased in response to the amount of overlap of the engaging pieces overlapping each other, and hence the outer rotor (second volume-changing parts) can easily perform the pumping function.

In the aforementioned oil pump in which the cam region includes the first cam region, the second cam region, and the third cam region, the first cam region, the second cam region, and the third cam region are preferably continuously provided, and the cam engaging part of the rotor-housing unit is preferably configured to be moved in the first direction by sliding along at least the second cam region and the third cam region following the movement of the spool member. According to this structure, the rotor-housing unit can be moved in the first direction while engaging with the cam region (the second cam region and the third cam region) so as to follow the cam shape of the cam region when the spool member is moved in one direction of the second direction, and hence based on the first cam region corresponding to the case where the discharge pressure of the oil from the discharge port is within the first pressure range, the eccentricity of the inner rotor can be smoothly decreased in the case of the second cam region, and the eccentricity of the inner rotor can be smoothly increased from the decreased state in the case of the third cam region.

In the aforementioned oil pump according to the aspect, there is preferably a hysteresis error between the characteristics of the eccentricity of the inner rotor resulting from movement of the rotor-housing unit in the first direction in response to the change in the amount of protrusion of the cam region generated when the cam member is linearly moved in one direction of the second direction and the characteristics of the eccentricity of the inner rotor resulting from the movement of the rotor-housing unit in the first direction in response to the change in the amount of protrusion of the cam region generated when the cam member is linearly moved in another direction of the second direction opposite to one direction. According to this structure, even when the discharge pressure of the oil from the discharge port repeatedly fluctuates up and down at short time intervals, the characteristics of the eccentricity of the inner rotor have the hysteresis error in response to the movement direction of the cam member, and hence generation of the phenomenon (chattering phenomenon) where the linear movement of the cam member in one direction and another direction of the second direction following the frequent up-and-down fluctuation of the discharge pressure and the wiggle back-and-forth movement of the rotor-housing unit in the first direction based on this are frequently repeated can be avoided in the oil pump. Therefore, even when the discharge pressure of the oil from the discharge port repeatedly fluctuates up and down at the short time intervals, the eccentricity of the inner rotor does not vary in a fluctuating manner, and hence the oil can be stably discharged.

In the aforementioned oil pump further including the rotor-housing unit and the cam member, at least part of the oil suctioned into the suction port is supplied to the cam region of the cam member. According to this structure, when the rotor-housing unit is moved in the first direction through the cam region provided in the cam member, the oil, the pressure of which is decreased to below the discharge pressure, is easily drawn into the cam region so that a part of the rotor-housing unit coming into contact with the cam region can be smoothly moved, and hence cam operation for moving the rotor-housing unit in the first direction can be smoothly performed by the cam member. Thus, the smooth discharge pressure characteristics accurately following the discharge pressure of the oil from the discharge port can be obtained.

Effect of the Invention

According to the present invention, as hereinabove described, the oil pump capable of sufficiently increasing the net rate of discharge of the oil per unit rotation can be provided.

MODES FOR CARRYING OUT THE INVENTION

Embodiments of the present invention are hereinafter described on the basis of the drawings.

First Embodiment

Figure 1:
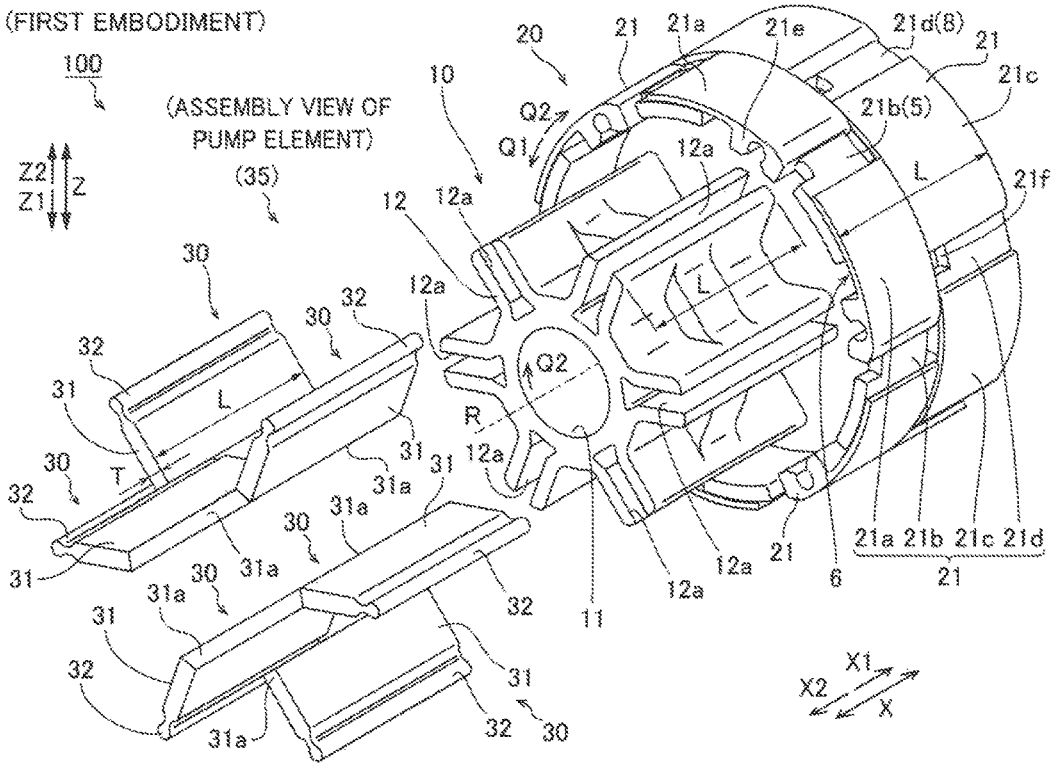
FIG. 1 An exploded perspective view showing the structure of a pump element in an oil pump according to a first embodiment of the present invention.
Figure 2:
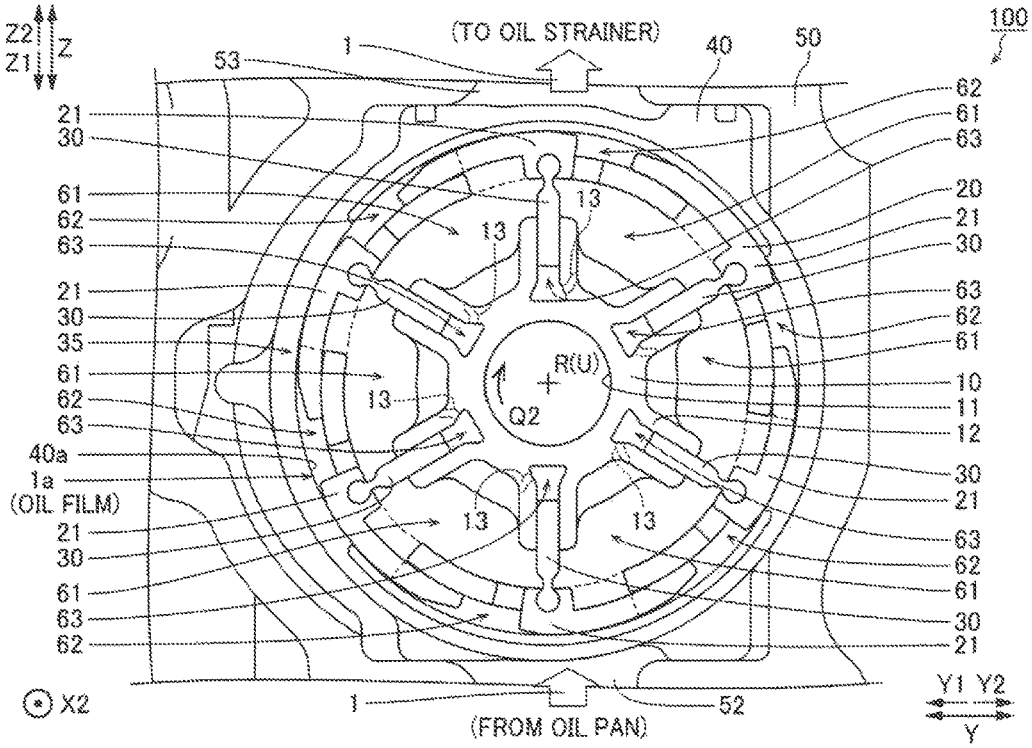
FIG. 2 A diagram showing the internal structure of the oil pump according to the first embodiment of the present invention.

The structure of an oil pump 100 according to a first embodiment of the present invention is now described with reference to FIGS. 1 to 7. In FIGS. 1 and 2, main components constituting the oil pump 100 are denoted by reference numerals, and in FIGS. 3 to 7, the detailed configuration (structure) of the oil pump 100 is denoted by reference numerals.

The oil pump 100 according to the first embodiment of the present invention includes an inner rotor 10, an outer rotor 20, and six vanes 30 connecting the inner rotor 10 and the outer rotor 20, as shown in FIG. 1. The inner rotor 10, the outer rotor 20, and the six vanes 30 constitute a pump element 35 having a pumping function.

The oil pump 100 also includes a housing 40 made of an iron-based metal material, housing the annular outer rotor 20 such that the outer rotor 20 is rotatable along arrow Q2 and a pump body (casing) 50 made of an aluminum alloy, housing the housing 40 such that the housing 40 is movable (in a direction Y), as shown in FIG. 2. In FIG. 1, illustration of the housing 40 housing the outer rotor 20 and the pump body 50 (see FIG. 2) is omitted in order to show the internal structure of the oil pump 100. The oil pump 100 is mounted on an unshown internal combustion (engine) or the like, for example, and in this case, the oil pump 100 has a function of supplying oil (lubricating oil) 1 (see FIG. 2) in an oil pan around pistons and to a movable part (slide part) such as a crankshaft.

As shown in FIG. 2, the oil pump 100 includes a suction port 52 that suctions the oil 1 and a discharge port 53 that discharges the oil 1. The suction port 52 and the discharge port 53 are formed behind (the rear side of the plane of the figure) the housing 40 in the pump body 50. The oil pump 100 further includes an unshown cover covering the pump body 50 from the front side of the plane of the figure. Thus, six volume chambers 61 surrounded by the inner rotor 10, the outer rotor 20, and the six vanes 30, respectively, are formed in the pump body 50 closed by the cover. Each of the volume chambers 61 has a volume V1. As described later, the volume V1 is increased or decreased in response to changes (enlargement or shrinkage) in the shapes of the volume chambers 61 resulting from expansion and contraction (slide) of the vanes 30 during the operation of the oil pump 100. The volume chambers 61 are examples of the "first volume-changing part" in the present invention. The volume V1 is an example of the "first volume" in the present invention.

The structure of the pump element 35 is now described. The operation of the oil pump 100 is described later in detail.

The inner rotor 10 made of an iron-based metal material includes a shaft hole 11 in a central part serving as a rotation center R, as shown in FIGS. 1 and 2. An unshown drive shaft is connected to the shaft hole 11 so that the inner rotor 10 is rotated in one direction (along arrow Q2) in a state where the position of the rotation center R is fixed. In the oil pump 100, the crankshaft of the internal combustion (engine) is used as a drive source for the inner rotor 10. The inner rotor 10 includes a vane-housing unit 12 provided along the outer periphery of the inner rotor 10.

The vane-housing unit 12 includes six recess parts 12*a* extending in a radial direction from the outer periphery of the inner rotor 10 toward the shaft hole 11 (rotation center R). The term "radial direction" described here denotes a direction along a radius of rotation when the inner rotor 10 is rotated about the rotation center R. Each of the recess parts 12*a* has a prescribed depth in the radial direction, and the recess parts 12*a* are arranged at equal angular intervals (60-degree intervals) about the shaft hole 11. The recess parts 12*a* extend in the form of a groove along a direction X from an end surface of the inner rotor 10 on one side (X2 side) to an end surface of the inner rotor 10 on another side (X1 side). A width W (see FIG. 7) of each of the recess parts 12*a* slidably holding the vanes 30 from an inner wall surface on one side extending in the direction X to an inner wall surface on another side opposed to the inner wall surface on one side is constant. The inner rotor 10 has a prescribed rotor width L (see FIG. 1) along the direction X. The rotor width L is equal to the lengths (widths) of the outer rotor 20 and the housing 40 in the direction X.

The outer rotor 20 made of an aluminum alloy includes six outer rotor pieces 21, as shown in FIG. 2. The outer rotor pieces 21 are sequentially connected to (engage with) each other in a circumferential direction. Thus, the outer rotor 20 is configured to be rotated along arrow Q2 with respect to the housing 40 in a state where the outer rotor pieces 21 are annularly connected to each other along the inner peripheral surface 40*a* of the housing 40.

Figure 3:
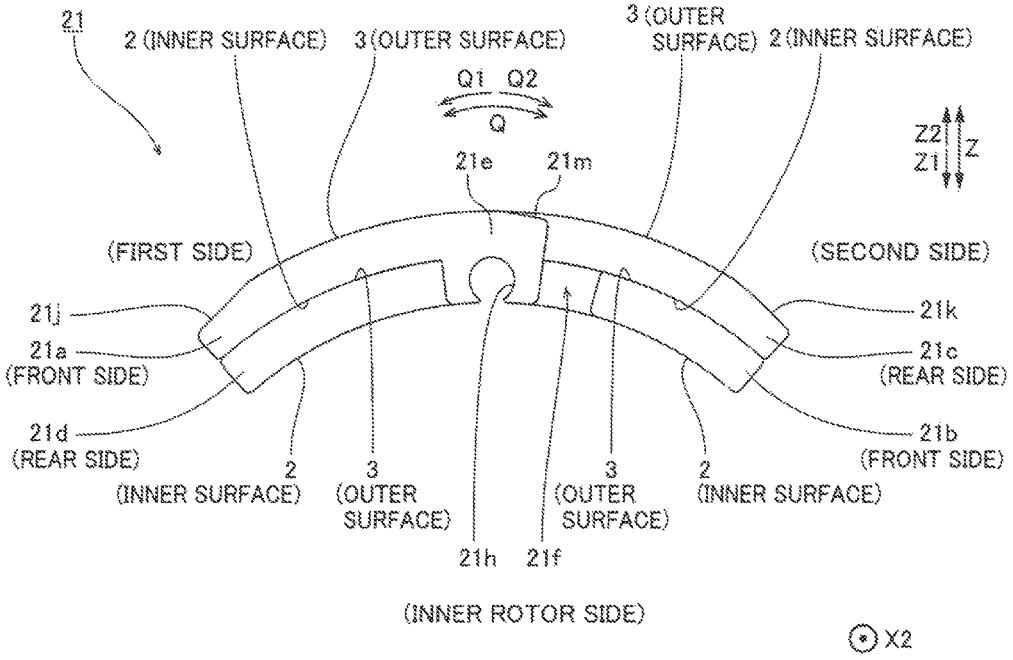
FIG. 3 A front elevational view showing the structure of an outer rotor piece (single item) constituting the oil pump according to the first embodiment of the present invention.

The outer rotor pieces 21 each include a first engaging piece 21*a*, a second engaging piece 21*b*, a third engaging piece 21*c*, and a fourth engaging piece 21*d*, each of which is formed in an arcuate shape, as shown in FIG. 3. The outer rotor pieces 21 each further include a base 21*e* extending in an axial direction (direction X), and base parts of the first engaging piece 21*a* and the fourth engaging piece 21*d* on a Q2 side, extending in the axial direction (direction X), are connected to the base 21*e* from a Q1 side. Furthermore, base parts of the second engaging piece 21*b* and the third engaging piece 21*c* on the Q1 side, extending in the axial direction (direction X), are connected to the base 21*e* from the Q2 side. In this description, the Q1 side and the Q2 side correspond to a first side and a second side of the outer rotor pieces 21 in the circumferential direction, respectively. Therefore, each of the outer rotor pieces 21 is a unitary monolithic component in which the first engaging piece 21*a* to the fourth engaging piece 21*d* have such a shape that an arcuate wing is spread in the circumferential direction (along arrow Q1 and arrow Q2) about the base 21*e*. The base 21*e* is an example of the "vane-connecting part" in the present invention.

Figure 4:
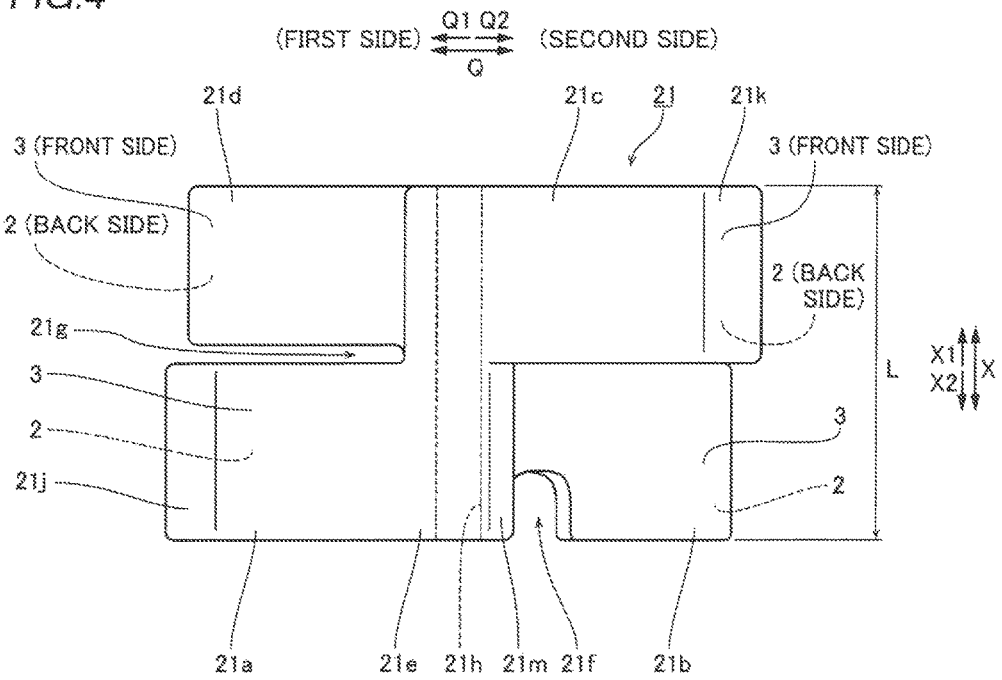
FIG. 4 A top plan view showing the structure of the outer rotor piece (single item) constituting the oil pump according to the first embodiment of the present invention.

When one outer rotor piece 21 is viewed along arrow Z1 from above (Z2 side) in FIG. 3, the first engaging piece 21*a* and the third engaging piece 21*c* arranged diagonally to each other about the base 21*e* are arranged outside (the front side of the plane of the figure) in the radial direction in the outer rotor piece 21, as shown in FIG. 4. On the other hand, the second engaging piece 21*b* and the fourth engaging piece 21*d* arranged diagonally to each other are arranged inside (the rear side of the plane of the figure) in the radial direction relative to the first engaging piece 21*a* and the third engaging piece 21*c*. Therefore, the first engaging piece 21*a* to the fourth engaging piece 21*d* are arranged alternately (staggeredly) along the radial direction as outside, inside, outside, and inside in the radial direction in this order. As shown in FIG. 2, an outer surface 3 of each of the first engaging piece 21*a* and the third engaging piece 21*c* is slid in the circumferential direction (along arrow Q) through an oil film 1*a* with respect to the inner peripheral surface 40*a* of the housing 40.

Figure 5:
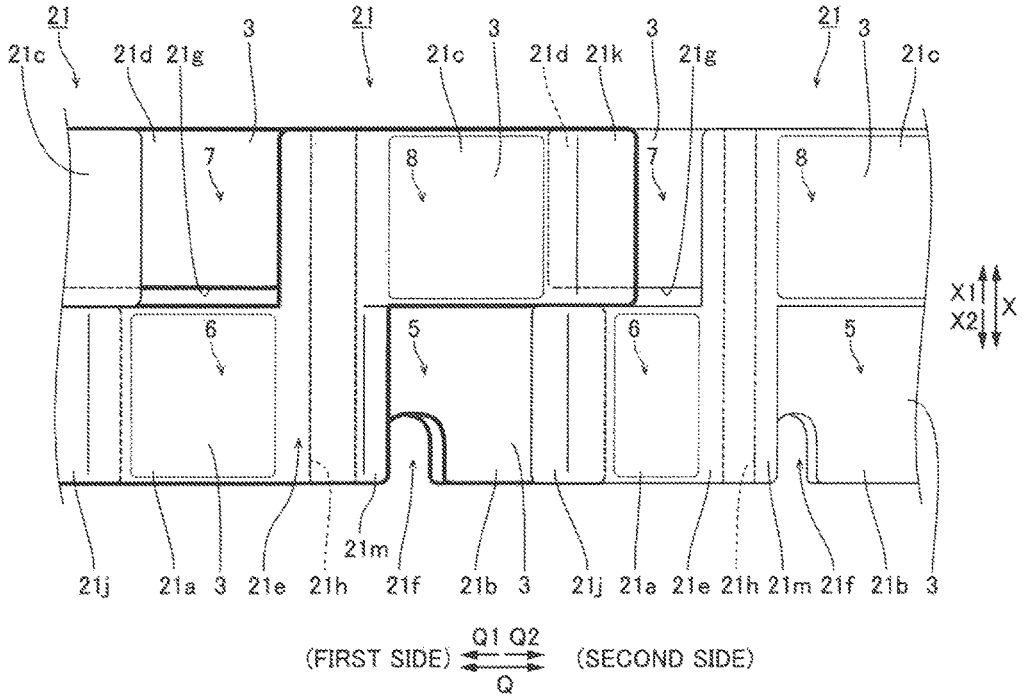
FIG. 5 A top plan view showing engagement between adjacent outer rotor pieces in an outer rotor constituting the oil pump according to the first embodiment of the present invention.

When the outer rotor pieces 21 in which the first engaging piece 21*a* to the fourth engaging piece 21*d* have a staggered structure are connected to each other, as shown in FIG. 5, the first engaging piece 21*a* of each of the outer rotor pieces 21 on the Q2 side engages with the second engaging piece 21*b* of each of the outer rotor pieces 21 on the Q1 side so as to cover the second engaging piece 21*b* from the outside (on the front side of the plane of the figure) in the radial direction. The fourth engaging piece 21*d* of each of the outer rotor pieces 21 on the Q2 side engages with the third engaging piece 21*c* of each of the outer rotor pieces 21 on the Q1 side so as to crawl into the inside (the rear side of the plane of the figure) of the third engaging piece 21*c* in the radial direction. More specifically, the inner surface 2 of the first engaging piece 21*a* relatively on the Q2 side, located on the inside in the radial direction, and the outer surface 3 of the second engaging piece 21*b* adjacent relatively in a direction Q1, located on the outside in the radial direction, come into contact (surface contact) with each other. The outer surface 3 of the fourth engaging piece 21*d* relatively on the Q2 side, located on the outside in the radial direction, and the inner surface 2 of the third engaging piece 21*c* adjacent relatively in the direction Q1, located on the inside in the radial direction, come into contact (surface contact) with each other.

Figure 6:
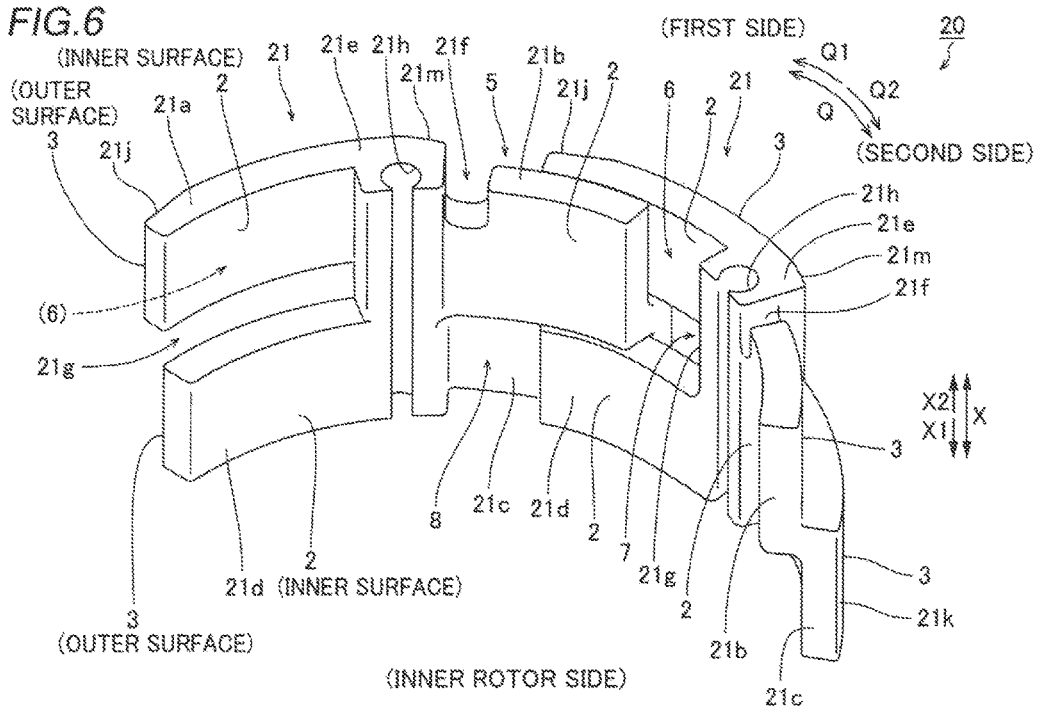
FIG. 6 A perspective view showing the engagement between the adjacent outer rotor pieces in the outer rotor constituting the oil pump according to the first embodiment of the present invention.

Therefore, the first engaging piece 21*a* and the fourth engaging piece 21*d* of the outer rotor piece 21 on the Q2 side and the second engaging piece 21*b* and the third engaging piece 21*c* of the outer rotor piece 21 adjacent on the Q1 side to this outer rotor piece 21 are alternately combined along a rotor width direction (direction X), as shown in FIGS. 5 and 6. The inner surface 2 and the outer surface 3 of each of the first engaging piece 21*a* and the fourth engaging piece 21*d* on the Q2 side and the second engaging piece 21*b* and the third engaging piece 21*c* on the Q1 side sequentially repetitively engage with each other in the outer rotor pieces 21 adjacent along a direction Q. In this manner, the six outer rotor pieces 21 are annularly (circumferentially) connected to each other, whereby the outer rotor 20 (see FIG. 2) is configured.

The first engaging piece 21*a* to the fourth engaging piece 21*d* each are formed in the arcuate shape, and hence an overlapping margin (engagement area) of the adjacent outer rotor pieces 21 in the circumferential direction (along arrow Q) can be increased or decreased along arrow Q1 or arrow Q2 in a prescribed range (a length range of each of the pieces in the circumferential direction). In FIG. 6, the outer rotor pieces 21 adjacent to each other are viewed from a side on which the inner rotor 20 (see FIG. 2) is arranged. Therefore, in the outer rotor 20 incorporated in the housing 40 (see FIG. 2), engagement between the adjacent outer rotor pieces 21 is maintained while a distance (engagement area) between the adjacent outer rotor pieces 21 in the circumferential direction (along arrow Q) is increased or decreased in the prescribed range.

According to the first embodiment, engagement spaces 5 to 8 described below are formed between the outer rotor pieces 21 adjacent to each other along arrow Q.

Figure 7:
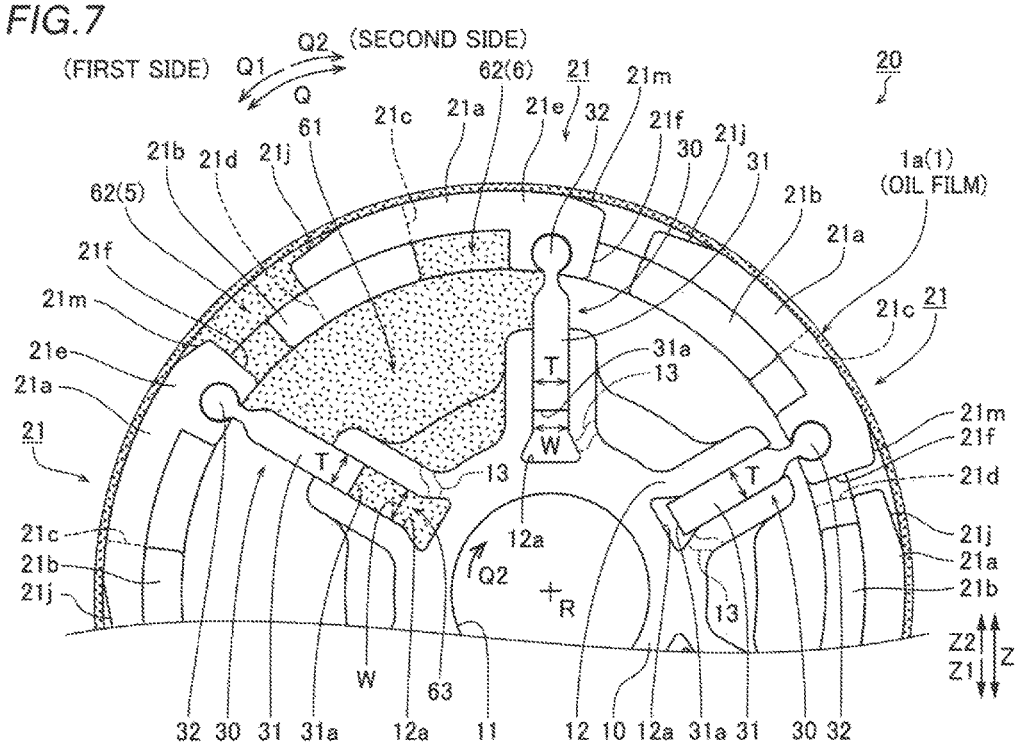
FIG. 7 A diagram showing the internal structure of the oil pump according to the first embodiment of the present invention.

Specifically, one engagement space 5 that enables increase and decrease (expansion and contraction) in volume is formed on the side of the outer surface 3 of the second engaging piece 21*b* by engagement between the first engaging piece 21*a* of one outer rotor piece 21 on the Q2 side and the second engaging piece 21*b* of the outer rotor piece 21 adjacent on the Q1 side, as shown in FIGS. 5 and 6. The engagement space 5 is a space formed between the outer surface 3 of the second engaging piece 21*b* and the inner peripheral surface 40*a* (see FIG. 2) of the housing 40 that faces this. The engagement space 5 is located on the Q1 side (first side) between two adjacent vanes 30, as shown in FIG. 7. Simultaneously, one engagement space 6 that enables increase and decrease (expansion and contraction) in volume is formed on the side of the inner surface 2 of the first engaging piece 21*a*. The engagement space 6 is a space directly exposed to the side of the inner rotor 10 (see FIG. 2). The engagement space 6 is located on the Q2 side (second side) between the two adjacent vanes 30. The engagement spaces 5 and 6 are examples of the "first engagement space" and the "second engagement space" in the present invention, respectively.

In a connection part between the base 21*e* and the second engaging piece 21*b*, one notch part 21*f* is formed. The notch part 21*f* is formed by partially notching the second engaging piece 21*b* in a groove shape along a thickness direction to have a prescribed length (depth) in the axial direction (direction X) from an end of the base 21*e* on one side (X2 side). Thus, the side of the inner surface 2 of the second engaging piece 21*b* communicates with the side of the outer surface 3 of the second engaging piece 21*b*. Thus, according to the first embodiment, the engagement space 5 located on the side of the outer surface 3 of the outer rotor 20 and a volume chamber 61 surrounded by the inner rotor 10, the outer rotor 20, and the two adjacent vanes 30 communicate with each other through the notch part 21*f*, as shown in FIG. 7. The volume of the notch part 21*f* is preferably as small as possible relative to the engagement space 5 in a range where the oil 1 easily flows. The notch part 21*f* is an example of the "groove part" in the present invention.

In the outer rotor 20, another similar structure exists. As shown in FIGS. 5 and 6, one engagement space 7 that enables increase and decrease (expansion and contraction) in volume is formed on the side of the outer surface 3 of the fourth engaging piece 21*d* by engagement between the fourth engaging piece 21*d* of one outer rotor piece 21 on the Q2 side and the third engaging piece 21*c* of the outer rotor piece 21 adjacent on the Q1 side. The engagement space 7 is a space formed between the outer surface 3 of the fourth engaging piece 21*d* and the inner peripheral surface 40*a* (see FIG. 2) of the housing 40 that faces this. The engagement space 7 is located on the Q2 side (second side) between two adjacent vanes 30, as shown in FIG. 7. Simultaneously, one engagement space 8 that enables increase and decrease (expansion and contraction) in volume is formed on the side of the inner surface 2 of the third engaging piece 21*c*. The engagement space 8 is a space directly exposed to the side of the inner rotor 10. The engagement space 8 is located on the Q1 side (first side) between the two adjacent vanes 30. The engagement spaces 7 and 8 are examples of the "second engagement space" and the "first engagement space" in the present invention, respectively.

In an end in which the first engaging piece 21*a* and the fourth engaging piece 21*d* face each other in the axial direction (direction X), one notch part 21*g* extending from an end on the Q1 side to the base 21*e* along the circumferential direction (along arrow Q) is formed. The notch part 21*g* is formed by partially notching the fourth engaging piece 21*d* in a groove shape along the thickness direction in a state where the notch part 21*g* has a prescribed width in the direction X. Thus, the side of the inner surface 2 of the first engaging piece 21*a* communicates with the side of the outer surface 3 of the fourth engaging piece 21*d*. Thus, according to the first embodiment, the engagement space 7 located on the side of the outer surface 3 of the outer rotor 20 and a volume chamber 61 (see FIG. 7) surrounded by the inner rotor 10, the outer rotor 20, and the two adjacent vanes 30 communicate with each other through the notch part 21*g*, as shown in FIG. 6. The volume of the notch part 21*g* is preferably as small as possible relative to the engagement space 7 in a range where the oil 1 easily flows. The notch part 21*g* is an example of the "groove part" in the present invention.

As can be seen in FIG. 6, the engagement spaces 6 and 8 are arranged on the side of the inner surface 2 in the radial direction of the rotation of the outer rotor 20, and hence the engagement spaces 6 and 8 are substantially connected to (communicate with) the volume chamber 61 (see FIG. 7).

One volume chamber 62 having a volume V2 is formed between the outer rotor pieces 21 engaging with each other by the aforementioned engagement spaces 5, 6, 7, and 8. More specifically, the total volume of the engagement spaces 5 to 8 corresponds to the volume V2. The engagement spaces 6 and 8 substantially communicate with the volume chamber 61, but are described distinctively from the volume chamber 61 as engagement spaces, the sizes of which can be increased or decreased, formed on the side of the outer rotor 20. The volume chamber 62 is configured such that the operations of increasing or decreasing the volumes of the engagement spaces 5 to 8 are synchronized following an increase or decrease in the overlapping margin (engagement area) of the adjacent outer rotor pieces 21 in the circumferential direction (along arrow Q) in the prescribed range. More specifically, when the adjacent outer rotor pieces 21 are displaced in a direction away from each other, the "overlapping margin" is decreased, and the volume V2 of the engagement spaces 5 to 8 is monotonically increased. When the adjacent outer rotor pieces 21 are displaced in a direction toward each other, the "overlapping margin" is increased, and the volume V2 of the engagement spaces 5 to 8 is monotonically decreased. The operations of increasing or decreasing the volumes of the engagement spaces 5 to 8 serve the pumping function of the outer rotor 20 described later. The volume chamber 62 is an example of the "second volume-changing part" in the present invention. The volume V2 is an example of the "second volume" in the present invention.

As shown in FIG. 3, the base 21*e* of each of the outer rotor pieces 21 is formed with an engaging part 21*h* having a prescribed inner diameter, formed by partially notching the inside in the radial direction in an arcuate shape (C shape). As shown in FIG. 4, the engaging part 21*h* linearly extends from the end of the base 21*e* on one side (X2 side) to an end of the base 21*e* on another side (X1 side) along the axial direction, and the engaging part 21*h* passes through the base 21*e* in the axial direction (direction X). More specifically, the length of the engaging part 21*h* in the direction X is equal to the width (the rotor width L of the inner rotor 10) of each of the vanes 30. The engaging portion 21*h* is an example of the "vane-connecting part" in the present invention.

As shown in FIGS. 3 and 4, on the outer surface 3 of each of the outer rotor pieces 21 located on the outside in the radial direction, a side end 21*j* of the first engaging piece 21*a* opposite (Q1 side) to the base 21*e*, a side end 21*k* of the third engaging piece 21*c* opposite (Q2 side) to the base 21*e*, and a side end 21*m* of the base 21*e* on the Q2 side each have a slightly tapered shape by reducing a thickness in the radial direction. Thus, when the outer rotor 20 in which the six outer rotor pieces 21 are combined rotates along the inner peripheral surface 40*a* of the housing 40, the oil 1 (see FIG. 2) is easily drawn into a small gap between the outer surface 20*a* of the outer rotor 20 and the inner peripheral surface 40*a* of the housing 40. Therefore, according to the first embodiment, the outer rotor 20 is configured to rotate in the housing 40 in a state where the thin oil film 1*a* is formed on the outer surface 20*a* of the outer rotor 20, as shown in FIGS. 2 and 7.

The vanes 30 made of an aluminum alloy each have a base 31 and a tip end 32, as shown in FIG. 7. The base 31 has a slightly narrow part formed by reducing a thickness T on the side of the tip end 32, and the tip end 32 is integrally connected to a tip of this narrow part. The base 31 has a base part 31*a*. The vanes 30 are configured to be inserted into the recess parts 12*a* (vane-housing unit 12) of the inner rotor 10 from the side of the base part 31*a*. The base 31 is an example of the "part housed in the vane-housing unit" in the present invention.

According to the first embodiment, the thickness T of the base 31 is constant along the radial direction (the movement direction of the vanes 30). The width W of one recess part 12*a* is slightly larger than the thickness T of the base 31, and the outer surface of the base 31 extending in the direction X is smoothly slid (slidingly moved) with respect to the inner surface of the recess part 12*a* extending in the direction X along the radial direction of rotation. More specifically, the multiple vanes 30 are arranged in the recess parts 12*a* of the vane-housing unit 12 of the inner rotor 10 so as not to swing in the circumferential direction (along arrow Q), which is the rotation direction of the inner rotor 10 but so as to be capable of sliding along with the protrusion of tip ends 32 from the recess parts 12*a* to the outside in the radial direction and the retraction of base parts 31*a* opposite thereto toward the recess parts 12*a* on the inside in the radial direction.

According to the first embodiment, one volume chamber 63 having a volume V3 is formed in the vane-housing unit 12 of the inner rotor 10 by the recess part 12*a* and the base part 31*a* of the vane 30. The vane 30 is slid to freely appear from and disappear into the recess part 12*a*, whereby the volume V3 of the volume chamber 63 is increased or decreased. In other words, the volume V3 is increased when the vane 30 (tip end 32) jumps out of the recess part 12*a*, and the volume V3 is decreased when the vane 30 (base part 31*a*) is drawn into the recess part 12*a*. The volume chamber 63 is an example of the "third volume-changing part" in the present invention. The volume V3 is an example of the "third volume" in the present invention.

The tip end 32 of the vane 30 is rounded, and the tip end 32 is configured to be fitted into the engaging part 21*h* formed in the base 21*e* of the outer rotor piece 21. The cross-sectional area of the engaging part 21*h* is slightly larger than the cross-sectional area of the tip end 32, and the outer peripheral surface of the tip end 32 is connected to (engages with) the inner peripheral surface of the engaging part 21*h* with a slight airspace. Thus, the vane 30 is configured to be capable of sliding with respect to the recess part 12*a* of the inner rotor 10 in the radial direction regardless of a connection angle between the vane 30 and the outer rotor piece 21. Furthermore, the outer rotor 20 is configured to be rotatable in the housing 40 while maintaining an annular shape as a whole regardless of the connection angle between the vane 30 and the outer rotor piece 21 also on the side of the outer rotor pieces 21 annularly connected to each other.

Inside the inner rotor 10, a communication passage 13 (shown by a broken line in FIG. 2) configured to allow the volume chamber 63 formed by the recess part 12*a* and the base part 31*a* of the vane 30 and the volume chamber 61 surrounded by the inner rotor 10, the outer rotor 20, and the two adjacent vanes 30 to communicate with each other is formed. Thus, according to the first embodiment, one volume chamber 61 located between the adjacent vanes 30, the volume chamber 62 formed between the outer rotor pieces 21 engaging with each other in the circumferential direction (along arrow Q) in this part, and the volume chamber 63 in the vicinity of the volume chamber 61 are configured to communicate with each other. More specifically, six volume chambers, each of which has a set of these volume chambers 61 to 63, are formed in a state where the volume chambers are zoned around the inner rotor 10.

The inner rotor 10, the outer rotor 20, and the vanes 30 constituting the pump element 35 (see FIG. 1) are configured as described above, whereby each component is incorporated in the oil pump 100, as described below. More specifically, in a state where both the inner rotor 10 and the outer rotor 20 in which the six outer rotor pieces 21 are annularly connected to each other are arranged in the housing 40, the base 31 of each of the vanes 30 is slidingly inserted into the recess part 12*a* (vane-housing unit 12) of the inner rotor 10 along the direction X while the tip end 32 of each of the vanes 30 is fitted into the engaging part 21*h* of each of the outer rotor pieces 21 along the direction X, as shown in FIG. 2. Furthermore, the six vanes 30 are fitted similarly so that the inner rotor 10 and the outer rotor 20 are connected to each other through the vanes 30. Then, the unshown cover covers the pump body 50 to close the same. When the inner rotor 10 is rotated along arrow Q2 by the drive source (crankshaft), the outer rotor 20 is also rotated along the same arrow Q2 as the inner rotor 10 through the six vanes 30.

FIG. 2 shows a state where the rotation center R of the inner rotor 10 and the rotation center U of the outer rotor 20 completely coincide with each other. In this case, the tip end 32 of each of the vanes 30 protrudes from the recess part 12*a* (vane-housing unit 12) toward the outer rotor piece 21 by the same amount. Therefore, even when the inner rotor 10 is rotated, each of the vanes 30 is rotationally moved without changing the amount of protrusion and only allows the outer rotor 20 to be rotated in an accompanying manner, and hence the oil pump 100 does not perform the pumping function described later.

The housing 40 holding the outer rotor 20 is moved by a prescribed amount in the direction Y (along arrow Y1 or Y2). Thus, the rotation center U of the outer rotor 20 is eccentric in a transverse direction (along arrow Y1 or Y2) relative to the rotation center R of the inner rotor 10. In this case, the tip end 32 of each of the vanes 30 protrudes from the recess part 12*a* (vane-housing unit 12) toward the outer rotor piece 21 by an amount in response to eccentricity in each rotational position along arrow Q2, as shown in FIG. 7. Therefore, each of the vanes 30 is rotationally moved while appearing from and disappearing into the recess part 12*a* along with the rotation of the inner rotor 10 and allows the outer rotor 20 to be rotated in an accompanying manner. Thus, the oil pump 100 is configured to operate with the pumping function.

The operation of the oil pump 100 according to the first embodiment is now described with reference to FIGS. 2 and 6 to 9.

Figure 8:
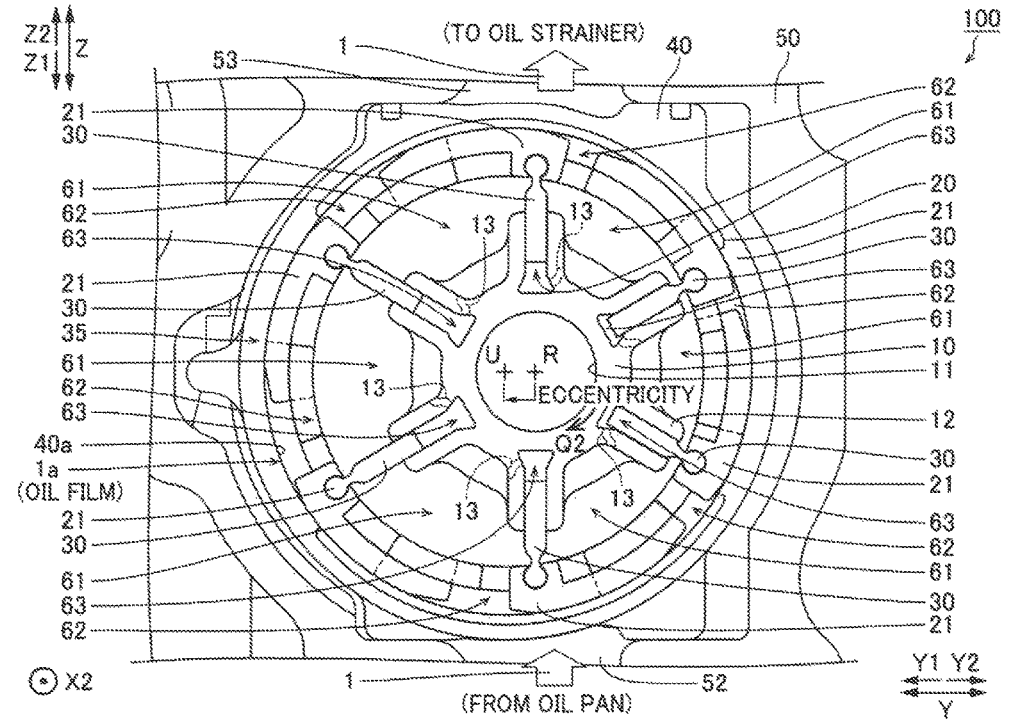
FIG. 8 A diagram for illustrating the operation of the oil pump according to the first embodiment of the present invention.

When the inner rotor 10 is first rotated along arrow Q2, the outer rotor 20 is also rotated through the six vanes 30 along the same arrow Q2 as the inner rotor 10, as shown in FIG. 2. Then, the housing 40 holding the outer rotor 20 is moved along arrow Y1 on the basis of prescribed control operation, as shown in FIG. 8, whereby the rotation center U of the outer rotor 20 is eccentric in the transverse direction (direction Y1) with respect to the rotation center R of the inner rotor 10.

According to the first embodiment, when the outer rotor 20 is rotated along arrow Q2 with prescribed eccentricity with respect to the inner rotor 10, the oil pump 100 operates such that the volume chambers 61, 62, and 63 serve the pumping function while changing their shapes (volumes) in response to this eccentricity. More specifically, the oil pump 100 performs the pumping function by changing (increasing or decreasing) the volume V1 of the volume chamber 61, the volume V2 of the volume chamber 62, and the volume V3 of the volume chamber 63 in response to the eccentricity of the outer rotor 20 with respect to the inner rotor 10.

Figure 9:
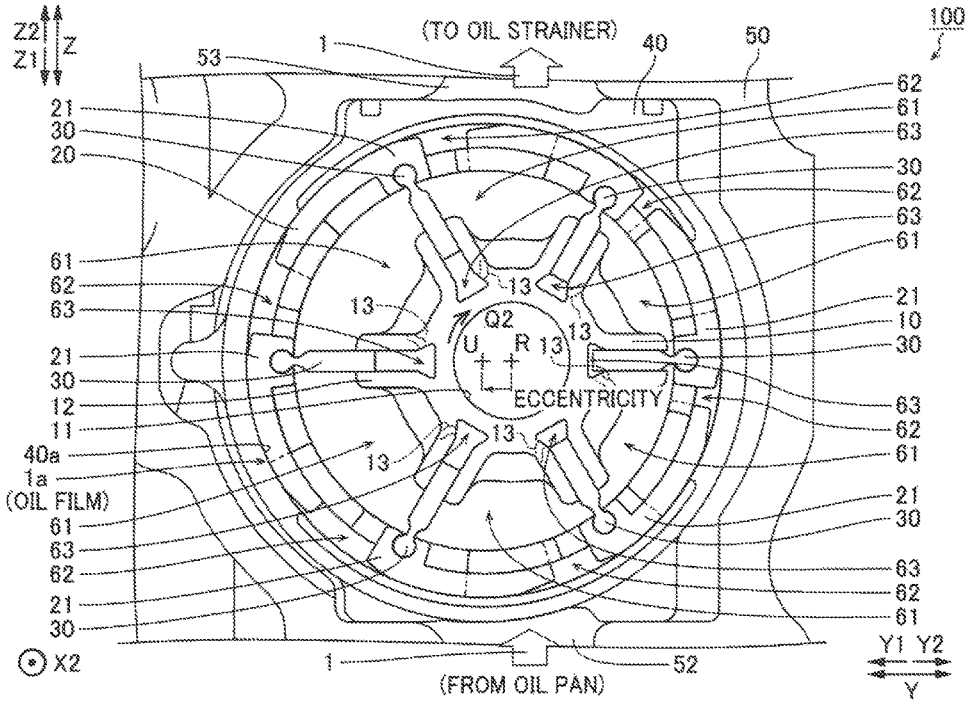
FIG. 9 A diagram for illustrating the operation of the oil pump according to the first embodiment of the present invention.

The volume V1 of the volume chamber 61, the volume V2 of the volume chamber 62, and the volume V3 of the volume chamber 63 are now individually described. The radial slide position of the tip end 32 (see FIG. 7) of the vane 30 located on the outside in the radial direction is changed in response to the eccentricity of the outer rotor 20 with respect to the inner rotor 10, following the rotational movement of the outer rotor 20, whereby the volume chamber 61 repetitively operates to increase or decrease its volume V1. Specifically, when each volume chamber 61 sequentially passes through the vicinity of the suction port 52 (see FIG. 8) along arrow Q2 in the pump body 50, the vane 30 gradually increases the amount of protrusion of the tip end 32 (see FIG. 7) from the recess part 12*a* (see FIG. 7) along the radial direction, as shown in FIGS. 8 and 9. Due to the protrusion of the tip end 32, a distance in the circumferential direction (along arrow Q) between the adjacent outer rotor pieces 21 surrounding one volume chamber 61 is gradually increased. Thus, the volume V1 of the volume chamber 61 is gradually increased. When each volume chamber 61 sequentially passes through the vicinity of the discharge port 53 (see FIG. 8) along arrow Q2 in the pump body 50, on the other hand, the vane 30 gradually increases the amount of insertion of the base part 31*a* (see FIG. 7) into the recess part 12*a* (see FIG. 7) along the radial direction. Due to the insertion of the base part 31*a*, the distance in the circumferential direction (along arrow Q) between the adjacent outer rotor pieces 21 surrounding one volume chamber 61 is gradually decreased. Thus, the volume V1 of the volume chamber 61 is gradually decreased.

The radial slide position of the tip end 32 of the vane 30 located on the outside in the radial direction is changed in response to the eccentricity of the outer rotor 20 with respect to the inner rotor 10, following the rotational movement of the outer rotor 20, whereby the volume chamber 62 repetitively operates to increase or decrease its volume V2. Specifically, when each volume chamber 62 sequentially passes through the vicinity of the suction port 52 (see FIG. 8) along arrow Q2, the amount of protrusion of the vane 30 is increased, and the adjacent outer rotor pieces 21 are displaced in the direction away from each other so that the distance between the outer rotor pieces 21 in the circumferential direction (along arrow Q) is gradually increased. Thus, the volume V2 of the volume chamber 62 including the engagement spaces 5 to 8 is gradually increased. When each volume chamber 62 sequentially passes through the vicinity of the discharge port 53 along arrow Q2, on the other hand, the amount of insertion of the vane 30 is increased, and the adjacent outer rotor pieces 21 are displaced in the direction toward each other so that the distance in the circumferential direction (along arrow Q) between the outer rotor pieces 21 is gradually decreased. Thus, the volume V2 of the volume chamber 62 including the engagement spaces 5 to 8 is gradually decreased.

The multiple vanes 30 are slid in the radial direction in response to the eccentricity of the outer rotor 20 with respect to the inner rotor 10, whereby the volume chamber 63 repetitively operates to increase or decrease its volume V3 in the vane-housing unit 12 of the inner rotor 10. Specifically, when each volume chamber 63 sequentially passes through the vicinity of the suction port 52 (see FIG. 8) along arrow Q2, the amount of protrusion of the vane 30 is increased, and the volume V3 of the volume chamber 63 is gradually increased. When each volume chamber 63 sequentially passes through the vicinity of the discharge port 53 along arrow Q2, on the other hand, the amount of insertion of the vane 30 is increased, and the volume V3 of the volume chamber 63 is gradually decreased. FIG. 9 shows a state where the inner rotor 10 and the outer rotor 20 are rotated by about 30 degrees along arrow Q2 relative to FIG. 8.

In the oil pump 100, one volume chamber 61 located between the adjacent vanes 30, the volume chamber 62 (engagement spaces 5 to 8) formed between the outer rotor pieces 21 engaging with each other in the circumferential direction in this part, and the volume chamber 63 in the vicinity of the volume chamber 61 communicate with each other through the aforementioned notch part 21*f* (see FIG. 6), notch part 21*g* (see FIG. 6), and communication passage 13 (see FIG. 7), and enlargement and shrinkage thereof are synchronized. Thus, when passing through the vicinity of the suction port 52, a set of the volume chambers 61 to 63 in terms of a flow passage suctions the oil 1 while increasing their volume V1, volume V2, and volume V3. Then, when passing through the vicinity of the discharge port 53, a set of the volume chambers 61 to 63 in terms of a flow passage discharges the oil 1 while decreasing their volume V1, volume V2, and volume V3. Pumping resulting from the enlargement and shrinkage of the volume chambers 61 to 63 volumetrically integrated is implemented once per rotation of the inner rotor 10.

The eccentricity of the outer rotor 20 with respect to the inner rotor 10 is adjusted to arbitrary magnitude according to the movement position of the housing 40 (see FIG. 2). More specifically, when the eccentricity is relatively small, a pumping volume resulting from the enlargement and shrinkage of the volume chambers 61 to 63 volumetrically integrated is relatively small, and the rate of discharge of the oil 1 is relatively small. When the eccentricity is relatively large, the pumping volume resulting from the enlargement and shrinkage of the volume chambers 61 to 63 volumetrically integrated is relatively large, and the rate of discharge of the oil 1 is relatively large.

In the oil pump 100, a series of changes from the volume decreased state of a set of volume chambers 61 to 63 to the volume increased state of a set of volume chambers 61 to 63 and from the volume increased state of a set of volume chambers 61 to 63 to the volume decreased state of a set of volume chambers 61 to 63 in one rotation are sequentially made along with 60 degree phase shifting for each set of volume chambers. Thus, continuous pumping including suction of the oil 1 from the suction port 52 into a pump main body and discharge of the oil 1 from the discharge port 53 is implemented. The drive force of the unshown drive source rotates the inner rotor 10, and rotates the outer rotor 20 annularly connected outside the inner rotor 10 through the vanes 30, following the rotation of the inner rotor 10. At this time, the six outer rotor pieces 21 periodically change their engagement states so that pumping is generated in the outer rotor 20 (volume chamber 62). Furthermore, the drive force of the drive source slidingly (back and forth) moves the vanes 30 on the basis of the eccentricity of the outer rotor 20 with respect to the inner rotor 10 when rotating the inner rotor 10 and the outer rotor 20. At this time, in addition to moving the vanes 30 back and forth, pumping resulting from enlargement and shrinkage of volume chambers 63 is generated also in the recess parts 12*a* of the vane-housing unit 12.

Thus, in the oil pump 100, all the deformation movement of movable parts (space parts: volume chambers 61 to 63) existing in the housing 40, deformed along with the rotation of the inner rotor 10 is converted to pumping. At this time, the vanes 30 each having the unnarrowed base 31 and a contact thickness T are used, and hence no minus factor (wasted work) to increase the volume V1 inversely to the volume chamber 63 is generated in the volume chamber 61 during a decrease in the volume V3 of the volume chamber 63, and synchronous changes in the volumes of the volume chambers 61 to 63 effectively work on the pumping of the entire oil pump 100. As described above, the drive force of the drive source input into the inner roto 10 is utilized for the deformation movement of the movable parts (volume chambers 61 to 63). Therefore, in the oil pump 100, a mechanism in which the volume chambers 61 to 63 operate together contributes to the maximum possible conversion of the drive force of the drive source to pumping and the discharge of the oil 1. Particularly, the deformation movement of not only the volume chambers 61 but also the volume chambers 62 and 63 is incorporated in pumping, and hence the volume V2 of the volume chamber 62 and the volume V3 of the volume chamber 63 are effectively added to the volume V1 of the volume chamber 61. This means that a net rate of discharge of the oil 1 per unit rotation is increased. The oil pump 100 is configured in the aforementioned manner.

According to the first embodiment, the following effects can be obtained.

More specifically, according to the first embodiment, as hereinabove described, the oil pump 100 includes the inner rotor 10 that includes the vane-housing unit 12 (six recess parts 12*a*) housing the six vanes 30 so as to be capable of sliding in the radial direction, the outer rotor 20 that includes six bases 21*e* connecting respective tip ends 32 of the six vanes 30 on the outside in the radial direction, the volume chambers 61, the volume V1 of which is changed in response to the eccentricity of the inner rotor 10 with respect to the outer rotor 20, thereby providing the pumping function, and the volume chambers 62, which are provided in the outer rotor 20, and the volume V2 of which is changed by the change in the distance between the adjacent bases 21*e* in the circumferential direction in response to the eccentricity of the inner rotor 10 with respect to the outer rotor 20, thereby providing the pumping function. Thus, in addition to the highly-efficient pumping of the volume chambers 61 partitioned by the vanes 30, the pumping of the volume chambers 62 newly provided in the outer rotor 20 can be effectively utilized. Therefore, the net rate of discharge of the oil 1 per unit rotation in the oil pump 100 can be sufficiently increased. Consequently, the pumping efficiency of the oil pump 100 can be improved.

According to the first embodiment, the pumping of the volume chambers 62 on the side of the outer rotor 20 is added to the volume chambers 61 efficiently ensuring the rate of discharge of the oil 1, and hence the rate of discharge of the oil 1 can be efficiently increased. When compared at the same rate of discharge, therefore, the oil pump 100 can be reduced in size by reducing the rotor width L (see FIG. 1), and hence the mountability of the oil pump 100 to the internal combustion (engine) or the like can be improved. Furthermore, the oil pump 100 is reduced in size so that a mechanical loss during driving of the oil pump 100 can be reduced, and hence the load of the drive source driving the oil pump 100 is reduced so that the energy can be saved.

According to the first embodiment, the oil pump 100 further includes the volume chambers 63, the volume V3 of which in the vane-housing unit 12 of the inner rotor 10 is changed by the slide of the multiple vanes 30 in the radial direction in response to the eccentricity of the inner rotor 10 with respect to the outer rotor 20, thereby providing the pumping function. Thus, the oil pump 100 can be configured to incorporate the change in the volume of the volume chambers 63 in the vane-housing unit 12 by the linear slide of the vanes 30 in the radial direction with respect to the vane-housing unit 12 into the pumping including the suction and discharge of the oil 1 without ignoring the change in the volume of the volume chambers 63 in addition to the pumping of the volume chambers 61 and the volume chambers 62, and hence the pumping of the volume chambers 63 is effectively added so that the rate of discharge of the oil 1 per unit rotation that the oil pump 100 has can be further increased. Consequently, the oil pump 100 can be further reduced in size. Furthermore, the vanes 30 linearly sliding in the radial direction are used, and hence it is not necessary to narrow an intermediate part of each of the vanes 30 that appears from and disappears into the vane-housing unit 12 (recess part 12*a*). Therefore, no minus factor (wasted work) to newly increase the volume (newly form volume chambers) in parts on the side of the volume chambers 61 in the vicinity of the volume chambers 63 is generated during a decrease change in the volume V3 of the volume chambers 63, and hence the changes in the volumes of the volume chambers 61 to 63 can effectively work on the pumping of the entire oil pump 100.

According to the first embodiment, the oil pump 100 further includes the suction port 52 that suctions the oil 1 and the discharge port 53 that discharges the oil 1. Furthermore, the oil pump 100 is configured to gradually increase, in the suction port 52, the volume V3 in the vane-housing unit 12 of the inner rotor 10 by the gradual slide of the vanes 30, housed in the vane-housing unit 12, to the outside in the radial direction and to gradually decrease, in the discharge port 53, the volume V3 in the vane-housing unit 12 of the inner rotor 10 by the gradual slide of the vanes 30, housed in the vane-housing unit 12, to the inside in the radial direction. Thus, the change in the volume V3 generated by repeating appearance (increase) from and disappearance (decrease) into the vane-housing unit 12 (recess parts 12*a*) along with back-and-forth linear movement of the vanes 30 to the outside and the inside in the radial direction can be easily utilized as pumping. At this time, the drive force of the oil pump 100 (the drive force of the inner rotor 10) can be converted to not only the change in the volume (volume V1) of the volume chambers 61 and the change in the volume (volume V2) of the volume chambers 62 following the slide of the vanes 30 but also the change in the volume (volume V3) of the volume chambers 63 following the slide of the vanes 30, and hence the mechanical efficiency of the oil pump 100 can be improved without wasting the drive force.

According to the first embodiment, the thickness T of each of the bases 31 of the vanes 30 housed in the vane-housing unit 12 is constant. Thus, the vanes 30 each including the base 31 housed in the vane-housing unit 12, the thickness T of which is constant, are used, whereby the vanes 30 can stably slide in the radial direction without backlash in the vane-housing unit 12. Furthermore, no backlash of the vanes 30 is generated during back-and-forth movement, and hence the airtightness can be improved when the volume chambers 63 repeat their enlargement (increase) and shrinkage (decrease). Thus, the pumping efficiency of the volume chambers 63 can be maintained at a high level.

According to the first embodiment, the volume chambers 62 are configured to be capable of changing the volume V2 of the volume chambers 62 by the changes in the distances between the multiple bases 21*e* of the outer rotor 20 in the circumferential direction by the change in the radial slide positions of the tip ends 32 of the vanes 30 on the outside in the radial direction in response to the eccentricity of the inner rotor 10 with respect to the outer rotor 20. Thus, properly utilizing the displacement of the radial slide positions of the tip ends 32 of the vanes 30 on the outside in the radial direction, the distances between the multiple bases 21*e* of the outer rotor 20 in the circumferential direction can be easily changed (increased and decreased). Thus, properly utilizing the drive force of the vanes 30 in the radial direction, the volume chambers 62 can perform the pumping function.

According to the first embodiment, the outer rotor 20 includes the multiple outer rotor pieces 21, each of which is provided for each of the multiple vanes 30, each including the base 21*e*. Furthermore, the outer rotor 20 is configured such that the multiple outer rotor pieces 21 are circumferentially arranged in a state where the adjacent outer rotor pieces 21 engage with each other so as to be capable of changing the distance therebetween in the circumferential direction (along arrow Q). Thus, properly utilizing the movement (expansion and contraction) of the adjacent outer rotor pieces 21 away from and toward each other in the circumferential direction (along arrow Q), the volume chambers 62 can perform the pumping function of repeating their enlargement and shrinkage.

According to the first embodiment, the adjacent outer rotor pieces 21 engage with each other in the circumferential direction (along arrow Q) while having the engagement spaces 5 to 8 constituting the volume chamber 62, and the oil pump 100 is configured to change the volume V2 of the engagement spaces 5 to 8 by the change in the distance between the adjacent outer rotor pieces 21 in the circumferential direction (along arrow Q). Thus, properly utilizing, as the volume V2, the engagement spaces 5 to 8 generated when the outer rotor pieces 21 engage with each other, the volume chambers 62 can perform the pumping function of repeating an increase and decrease in the volume V2.

According to the first embodiment, the outer rotor pieces 21 each have the first engaging piece 21*a* to the fourth engaging piece 21*d* engageable with each other in the circumferential direction in a state where the adjacent outer rotor pieces 21 overlap each other in the radial direction. Furthermore, the outer rotor 20 is configured to change the volume V2 obtained by summing the engagement spaces 5 to 8 by the change in the distance between the engagement spaces 5 and 6 partially constituting the volume chamber 62 in the circumferential direction in response to the amount of overlap of the first engaging piece 21*a* and the second engaging piece 21*b* and the change in the distance between the engagement spaces 7 and 8 partially constituting the volume chamber 62 in the circumferential direction in response to the amount of overlap of the third engaging piece 21*c* and the fourth engaging piece 21*d*. Thus, the volume V2 of the engagement spaces 5 to 8 can be easily increased or decreased in response to the amounts of overlap of the first engaging piece 21*a* to the fourth engaging piece 21*d* overlapping each other, and hence the outer rotor 20 (volume chambers 62) can easily perform the pumping function.

According to the first embodiment, each of the outer rotor pieces 21 is provided with the notch part 21*f* that allows the engagement space 5 constituting the volume chamber 62 and the volume chamber 61 to communicate with each other and the notch part 21*g* that allows the engagement space 7 constituting the volume chamber 62 and the volume chamber 61 to communicate with each other. Thus, the volume chamber 61 having the volume V1 and the volume chamber 62 having the volume V2 are allowed to communicate with each other through the notch part 21*f* and the notch part 21*g*, and hence the oil 1 can be suctioned into both the volume chamber 61 and the volume chamber 62 when the volume chambers are enlarged. When the volume chambers are shrunk, the oil 1 can be discharged from both the volume chamber 61 and the volume chamber 62.

According to the first embodiment, the outer rotor 20 is configured such that a set of the engagement spaces 5 to 8 includes the engagement spaces 5 and 8 located on the first side (the Q1 side in FIG. 5) between the two adjacent vanes 30 and the engagement spaces 6 and 7 located on the second side (the Q2 side in FIG. 5) between the two adjacent vanes 30. Thus, in the case where the generally annular (circumferential) outer rotor 20 is configured by sequentially connecting the adjacent outer rotor pieces 21 to each other, each of the outer rotor pieces 21 can easily engage with an outer rotor piece 21 adjacent on the first side (Q1 side) relative to itself through the engagement spaces 5 and 8, and each of the outer rotor pieces 21 can easily engage with an outer rotor piece 21 adjacent on the second side (Q2 side) relative to itself through the engagement spaces 6 and 7.

According to the first embodiment, the outer rotor 20 is configured to gradually increase the volume V2 by a gradual increase in the distance between the adjacent outer rotor pieces 21 in the circumferential direction (along arrow Q) in the suction port 52 and to gradually decrease the volume V2 by a gradual decrease in the distance between the adjacent outer rotor pieces 21 in the circumferential direction (along arrow Q) in the discharge port 53. Thus, the volume V2 of each of the volume chambers 62 can be increased or decreased in synchronization with the timing of sequentially passing through the suction port 52 or the discharge port 53 when the annular outer rotor 20 is rotated, and hence the volume chambers 62 can effectively perform their pumping function.

According to the first embodiment, the oil film 1*a* is formed on the outer surface 20*a* of the outer rotor 20. Thus, even when the outer rotor 20 includes the multiple bases 21*e* and is configured to involve the change in its shape causing the change in the volume V2 of the volume chambers 62 resulting from the change in the distance between the adjacent bases 21*e* in the circumferential direction, the oil film 1*a* is formed on the outer surface 20*a* of the outer rotor 20 so that the annular outer rotor 20 involving this change in its shape can be smoothly rotated in the housing 40 of the oil pump 100. Furthermore, due to this oil film 1*a*, the volume V2 of the volume chambers 62 can be smoothly changed.

According to the first embodiment, the multiple vanes 30 are mounted on the recess parts 12*a* of the vane-housing unit 12 of the inner rotor 10 so as to be capable of sliding in the radial direction without swinging in the circumferential direction (along arrow Q). Thus, the vanes 30 can appear from and disappear into the vane-housing unit 12 (recess parts 12*a*) while linearly (one-dimensionally) sliding along the radial direction when the oil pump 100 operates, and hence it is not necessary to form, in the vanes 30, such a unique shape that the bases 31 of the vanes 30 appearing from and disappearing into the vane-housing unit 12 are partially narrowed. Thus, unlike the structure of vanes having intermediate parts narrower than both ends (tip ends and base parts) and swinging, a factor to reduce the pumping efficiency can be removed by using the vanes 30 each having the unnarrowed base 31 and the contact thickness T. More specifically, the highly-efficient pumping function can be provided to the volume chambers 61.

Second Embodiment

Figure 10:
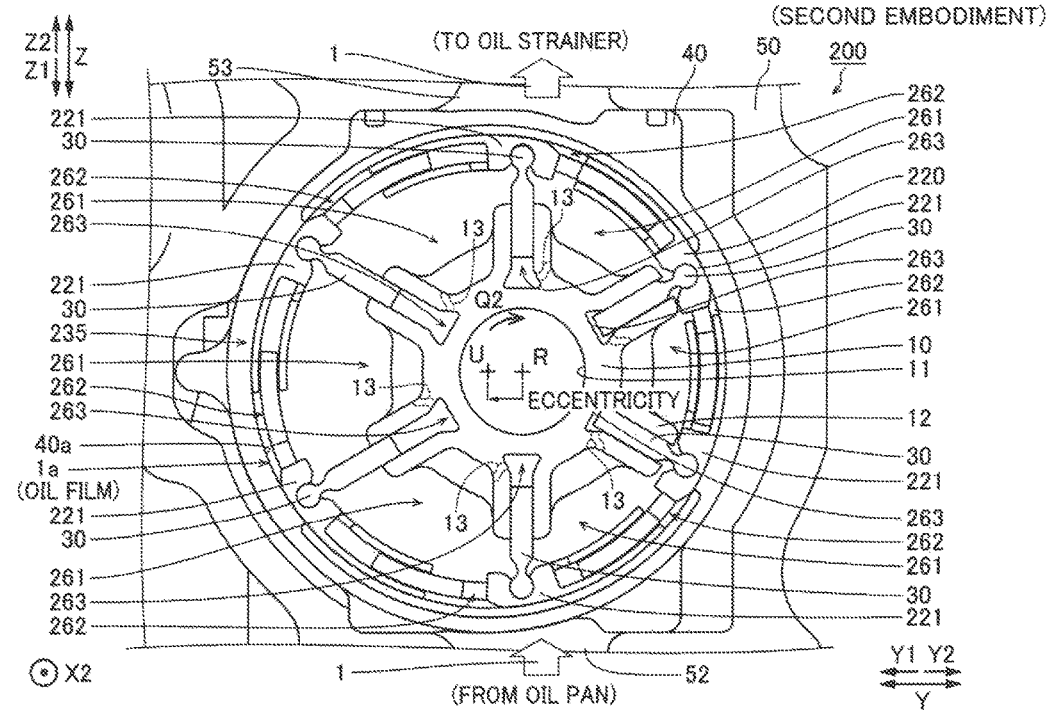
FIG. 10 A diagram showing the internal structure of an oil pump according to a second embodiment of the present invention.

A second embodiment is now described with reference to FIGS. 2 and 10 to 14. In this second embodiment, an example of configuring an annular outer rotor 220 by combining outer rotor pieces 221 having shapes different from those of the outer rotor pieces 21 of the outer rotor 20 (see FIG. 2) used in the aforementioned first embodiment is described. In FIG. 10, main components constituting an oil pump 200 are denoted by reference numerals, and in FIGS. 11 to 14, the detailed configuration (structure) of the oil pump 200 is denoted by reference numerals. In the figures, the same reference numerals as those in the aforementioned first embodiment are assigned to and show structures similar to those of the first embodiment.

The oil pump 200 according to the second embodiment of the present invention includes an inner rotor 10, the outer rotor 220, and six vanes 30 constituting a pump element 235, as shown in FIG. 10. In a pump body 50, six volume chambers 261 surrounded by the inner rotor 10, the outer rotor 220, and the six vanes 30 are formed. The volume V1 of each of the volume chambers 261 is increased or decreased in response to enlargement or shrinkage of the volume chambers 261 resulting from expansion and contraction (slide) of the vanes 30 during the operation of the oil pump 200. The volume chambers 261 are examples of the "first volume-changing part" in the present invention.

According to the second embodiment, the outer rotor 220 includes six outer rotor pieces 221 configured to be capable of being sequentially connected to (engage with) each other in a circumferential direction. Thus, the outer rotor 220 is configured to be rotated along arrow Q2 with respect to a housing 40 in a state where the outer rotor pieces 221 are annularly connected to each other in the housing 40.

Figure 11:
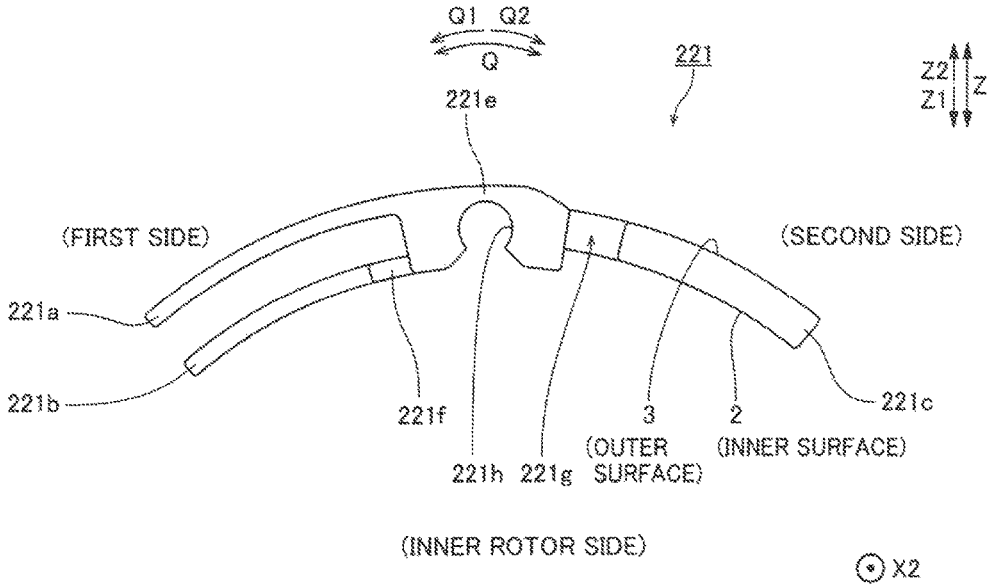
FIG. 11 A front elevational view showing the structure of an outer rotor piece (single item) constituting the oil pump according to the second embodiment of the present invention.
Figure 12:
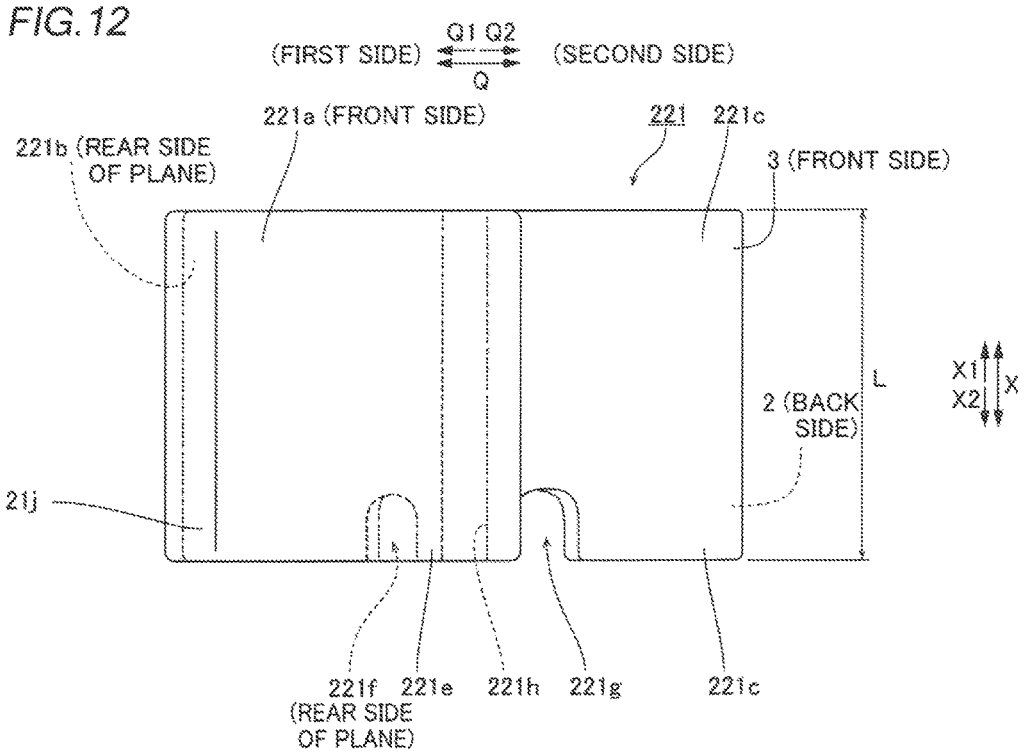
FIG. 12 A top plan view showing the structure of the outer rotor piece (single item) constituting the oil pump according to the second embodiment of the present invention.

As shown in FIG. 11, the outer rotor pieces 221 each include a first engaging piece 221*a*, a second engaging piece 221*b*, and a third engaging piece 221*c*, each of which is formed in an arcuate shape. The outer rotor pieces 221 each further include a base 221*e* extending in an axial direction (direction X), and base parts of the first engaging piece 221*a* and the second engaging piece 221*b* on a Q2 side, extending in the axial direction (direction X), are connected to the base 221*e* from a Q1 side. Furthermore, a base part of the third engaging piece 221*c* on the Q1 side, extending in the axial direction (direction X), is connected to the base 221*e* from the Q2 side. Therefore, each of the outer rotor pieces 221 is a unitary monolithic component in which the first engaging piece 221*a* and the second engaging piece 221*b* on the Q1 side relative to the base 221*e* and the third engaging piece 221*c* on the Q2 side relative to the base 221*e* have such a shape that an arcuate wing is spread. Furthermore, the outer rotor pieces 221 each have a uniform cross-sectional shape from an end on an X2 side to an end on an X1 side, except for a notch part 221*f* and a notch part 221*g* described later, as shown in FIG. 12. The base 221*e* is an example of the "vane-connecting part" in the present invention.

Figure 13:
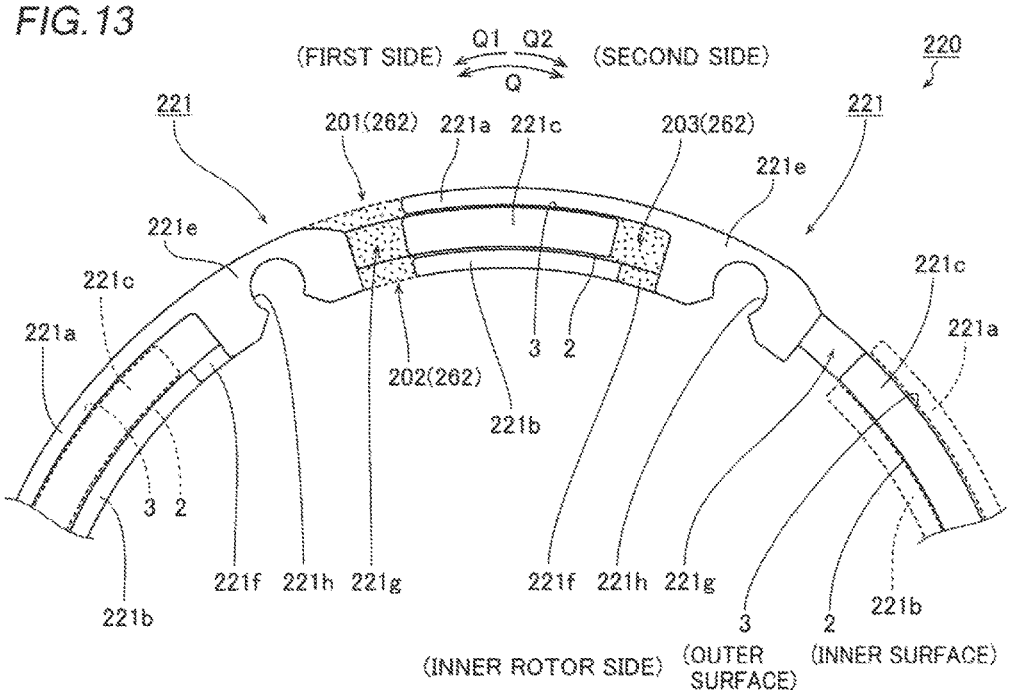
FIG. 13 A diagram showing engagement between adjacent outer rotor pieces in an outer rotor constituting the oil pump according to the second embodiment of the present invention.

When the outer rotor pieces 221 are connected to each other, as shown in FIG. 13, the first engaging piece 221*a* and the second engaging piece 221*b* of an outer rotor piece 221 on the Q2 side engage with the third engaging piece 221*c* of an outer rotor piece 221 adjacent on the Q1 side so as to hold the third engaging piece 221*c* from the outside and inside in a radial direction. An engaging state where the third engaging piece 221*c* of the outer rotor piece 221 on the Q2 side (second side) is held between the first engaging piece 221*a* and the second engaging piece 221*b* of the outer rotor piece 221 on the Q1 side (first side) is sequentially repeated in the outer rotor pieces 221 adjacent along a direction Q. In this manner, the six outer rotor pieces 221 are annularly (circumferentially) connected to each other, whereby the outer rotor 220 (see FIG. 10) is configured.

As shown in FIG. 13, an overlapping margin (engagement area) of the adjacent outer rotor pieces 221 in the circumferential direction (along arrow Q) can be increased or decreased along arrow Q in a prescribed range (a length range of each of the pieces in the circumferential direction). Therefore, in the outer rotor 220 incorporated in the housing 40 (see FIG. 10), engagement between the adjacent outer rotor pieces 221 is maintained while a distance (engagement area) between the adjacent outer rotor pieces 221 in the circumferential direction (along arrow Q) is increased or decreased in the prescribed range.

According to the second embodiment, engagement spaces 201 to 203 described below are formed between the outer rotor pieces 21 adjacent to each other along arrow Q.

Figure 14:
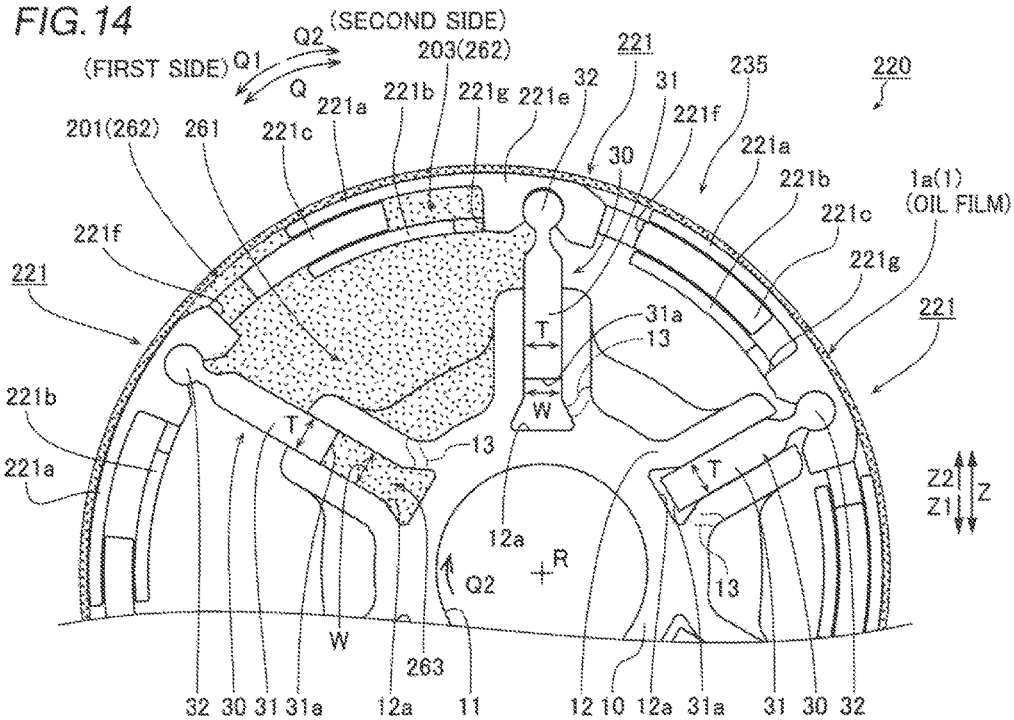
FIG. 14 A diagram showing the internal structure of the oil pump according to the second embodiment of the present invention.

Specifically, one engagement space 201 that enables increase and decrease (expansion and contraction) in volume is formed on the side of the outer surface 3 of the third engaging piece 221*c* by engagement between the first engaging piece 221*a* and the second engaging piece 221*b* of one outer rotor piece 221 on the Q2 side and the third engaging piece 221*c* of the outer rotor piece 221 adjacent on the Q1 side, as shown in FIG. 13. This engagement space 201 is a space formed between the outer surface 3 of the third engaging piece 221*c* and the inner peripheral surface 40*a* (see FIG. 10) of the housing 40 that faces this. Simultaneously, one engagement space 202 that enables increase and decrease (expansion and contraction) in volume is formed on the side of the inner surface 2 of the third engaging piece 221*c*. This engagement space 202 is a space directly exposed to the side of the inner rotor 10 (see FIG. 10). Furthermore, one engagement space 203 that enables increase and decrease (expansion and contraction) in volume is formed in a part into which the third engaging piece 221*c* is inserted and where the first engaging piece 221*a* and the second engaging piece 221*b* face each other. The engagement spaces 201 and 202 are located on the Q1 side (first side) between the two adjacent vanes 30, as shown in FIG. 14. The engagement space 203 is located on the Q2 side (second side) between the two adjacent vanes 30. The engagement spaces 201 and 202 are examples of the "first engagement space" in the present invention. The engagement space 203 is an example of the "second engagement space" in the present invention.

As shown in FIGS. 11 and 12, in a connection part between the base 221*e* and the second engaging piece 221*b*, one notch part 221*f* is formed. The notch part 221*f* is formed by partially notching the second engaging piece 221*b* in a groove shape along a thickness direction to have a prescribed length (depth) in the axial direction (direction X) from an end of the base 221*e* on one side (X2 side). Thus, the side of the inner surface 2 of the second engaging piece 221*b* communicates with the side of the outer surface 3 of the second engaging piece 221*b*. Thus, according to the second embodiment, the engagement space 203 located between the first engaging piece 221*a* and the second engaging piece 221*b* and a volume chamber 261 surrounded by the inner rotor 10, the outer rotor 220, and the two adjacent vanes 30 communicate with each other through the notch part 221*f*. The volume of the notch part 221*f* is preferably as small as possible relative to the engagement space 203 in a range where oil 1 easily flows. The notch part 221*f* is an example of the "groove part" in the present invention.

Furthermore, in a connection part between the base 221*e* and the third engaging piece 221*c*, one notch part 221*g* is formed. The notch part 221*g* is formed by partially notching the third engaging piece 221*c* in a groove shape along the thickness direction to have a prescribed length (depth) in the axial direction (direction X) from the end of the base 221*e* on one side (X2 side). Thus, the side of the inner surface 2 of the third engaging piece 221*c* communicates with the side of the outer surface 3 of the third engaging piece 221*c*. Thus, according to the second embodiment, the engagement space 201 located on the side of the outer surface 3 of the third engaging piece 221*c* and the engagement space 202 (volume chamber 261) located on the side of the inner surface 2 of the third engaging piece 221*c* communicate with each other through the notch part 221*g*. The volume of the notch part 221*g* is preferably as small as possible relative to the engagement space 201 in a range where the oil 1 easily flows. The notch part 221*g* is an example of the "groove part" in the present invention.

As shown in FIG. 13, one volume chamber 262 having a volume V2 is formed between the outer rotor pieces 221 engaging with each other by the aforementioned engagement spaces 201, 202, and 203. More specifically, the total volume of the engagement spaces 201 to 203 corresponds to the volume V2. The engagement space 202 substantially communicates with the volume chamber 261, but is described distinctively from the volume chamber 261 as an engagement space, the size of which can be increased or decreased, formed on the side of the outer rotor 220. The volume chamber 262 is configured such that the operations of increasing or decreasing the volumes of the engagement spaces 201 to 203 are synchronized following an increase or decrease in the overlapping margin (engagement area) of the adjacent outer rotor pieces 221 in the circumferential direction (along arrow Q) in the prescribed range. Thus, when the adjacent outer rotor pieces 221 are displaced in a direction away from each other, the "overlapping margin" is decreased, and the volume V2 of the engagement spaces 201 to 203 is monotonically increased. When the adjacent outer rotor pieces 221 are displaced in a direction toward each other, the "overlapping margin" is increased, and the volume V2 of the engagement spaces 201 to 203 is monotonically decreased. The operations of increasing or decreasing the volumes of the engagement spaces 201 to 203 serve a pumping function of the outer rotor 220. The volume chamber 262 is an example of the "second volume-changing part" in the present invention.

As shown in FIG. 11, the base 221*e* of each of the outer rotor pieces 221 is formed with an engaging part 221*h* having a prescribed inner diameter, formed by partially notching the inside in the radial direction in an arcuate shape (C shape). The engaging part 221*h* linearly extends from the end of the base 221*e* on one side to an end of the base 221*e* on another side along the axial direction and passes through the base 221*e* in the axial direction (direction X). The engaging portion 221*h* is an example of the "vane-connecting part" in the present invention.

According to the second embodiment, one volume chamber 263 having a volume V3 is formed in a vane-housing unit 12 of the inner rotor 10 by a recess part 12*a* and a base part 31*a* of each of the vanes 30, as shown in FIG. 14. The volume chamber 263 is an example of the "third volume-changing part" in the present invention. Each of the vanes 30 is slid to freely appear from and disappear into the recess part 12*a*, whereby the volume V3 of the volume chamber 263 is increased or decreased.

Thus, according to the second embodiment, one volume chamber 261 located between the adjacent vanes 30, the volume chamber 262 formed between the outer rotor pieces 221 engaging with each other in the circumferential direction (along arrow Q) in this part, and the volume chamber 263 in the vicinity of the volume chamber 261 are configured to communicate with each other. More specifically, six volume chambers, each of which has a set of these volume chambers 261 to 263, are formed in a state where the volume chambers are zoned around the inner rotor 10.

According to the second embodiment, when the outer rotor 220 is rotated along arrow Q2 with prescribed eccentricity with respect to the inner rotor 10, as shown in FIG. 10, the volume chambers 261, 262, and 263 serve the pumping function while changing their shapes (volumes) in response to this eccentricity. More specifically, the volume V1 of the volume chamber 261, the volume V2 of the volume chamber 262, and the volume V3 of the volume chamber 263 are changed in response to the eccentricity of the outer rotor 220 with respect to the inner rotor 10 so that the volume chambers 261, 262, and 263 perform the pumping function.

The operation of the pumping function of the volume chamber 262 is now described. As shown in FIG. 10, in the vicinity of a suction port 52, a distance between the adjacent outer rotor pieces 221 in the circumferential direction is gradually increased, whereby the volume V2 of the volume chamber 262 including the engagement spaces 201 to 203 is gradually increased. In the vicinity of a discharge port 53, the distance between the adjacent outer rotor pieces 221 in the circumferential direction is gradually decreased, whereby the volume V2 of the volume chamber 262 including the engagement spaces 201 to 203 is gradually decreased. In this case, the adjacent outer rotor pieces 221 engage with each other in the circumferential direction (along arrow Q) while having the engagement spaces 201 to 203 constituting the volume chamber 262, and the total volume V2 of the engagement spaces 201 to 203 is changed by a change in the distance between the adjacent outer rotor pieces 221 in the circumferential direction (along arrow Q). The pumping of the volume chambers 261 and 263 is similar to the pumping of the volume chambers 61 and 63 described in the aforementioned first embodiment.

Also in the oil pump 200, one volume chamber 261 located between the adjacent vanes 30, the volume chamber 262 formed between the outer rotor pieces 221 engaging with each other in the circumferential direction in this part, and the volume chamber 263 in the vicinity of the volume chamber 261 communicate with each other through the aforementioned notch part 221*f* (see FIG. 13), the notch part 21*g* (see FIG. 13), and a communication passage 13 (see FIG. 14), and enlargement and shrinkage thereof are synchronized. Thus, when passing through the vicinity of the suction port 52, a set of the volume chambers 261 to 263 in terms of a flow passage suctions the oil 1 while increasing their volume V1, volume V2, and volume V3. Then, when passing through the vicinity of the discharge port 53, a set of the volume chambers 261 to 263 in terms of a flow passage discharges the oil 1 while decreasing their volume V1, volume V2, and volume V3.

Thus, in the oil pump 200, all the deformation movement of movable parts (space parts: volume chambers 261 to 263) existing in the housing 40, deformed along with the rotation of a pump main body is converted to pumping. As described above, the drive force of a drive source input into the inner roto 10 is utilized for the deformation movement of the movable parts (volume chambers 261 to 263). Therefore, also in the oil pump 200, a mechanism in which the volume chambers 261 to 263 operate together contributes to the maximum possible conversion of the drive force of the drive source to pumping and the discharge of the oil 1. This means that a net rate of discharge of the oil 1 per unit rotation is increased. The remaining structure of the oil pump 200 according to the second embodiment is similar to that of the oil pump 100 according to the aforementioned first embodiment.

According to the second embodiment, the following effects can be obtained.

According to the second embodiment, as hereinabove described, the oil pump 200 includes the inner rotor 10 that includes the vane-housing unit 12 (six recess parts 12*a*) housing the six vanes 30 so as to be capable of sliding in the radial direction, the outer rotor 220 that includes six bases 21*e* connecting respective tip ends 32 of the six vanes 30 on the outside in the radial direction, the volume chambers 261, the volume V1 of which is changed in response to the eccentricity of the inner rotor 10 with respect to the outer rotor 220, thereby providing the pumping function, and volume chambers 262, which are provided in the outer rotor 220, and the volume V2 of which is changed by the change in the distance between the adjacent bases 221*e* in the circumferential direction in response to the eccentricity of the inner rotor 10 with respect to the outer rotor 220, thereby providing the pumping function. Thus, in addition to the highly-efficient pumping of the volume chambers 261 partitioned by the vanes 30, the pumping of the volume chambers 262 newly provided in the outer rotor 220 can be effectively utilized. Therefore, the net rate of discharge of the oil 1 per unit rotation in the oil pump 200 can be sufficiently increased. Consequently, the pumping efficiency of the oil pump 200 can be improved.

According to the second embodiment, the oil pump 200 further includes volume chambers 263, the volume V3 of which is changed in the vane-housing unit 12 of the inner rotor 10 by the slide of the multiple vanes 30 in the radial direction in response to the eccentricity of the inner rotor 10 with respect to the outer rotor 220, thereby providing the pumping function. Thus, the oil pump 200 can be configured to incorporate the change in the volume of the volume chambers 263 in the vane-housing unit 12 by the linear slide of the vanes 30 in the radial direction with respect to the vane-housing unit 12 into the pumping including the suction and discharge of the oil 1 without ignoring the change in the volume of the volume chambers 263 in addition to the pumping of the volume chambers 261 and the volume chambers 262, and hence the pumping of the volume chambers 263 is effectively added so that the rate of discharge of the oil 1 per unit rotation that the oil pump 200 has can be further increased. Consequently, the oil pump 200 can be further reduced in size. Furthermore, the vanes 30 linearly sliding in the radial direction are used, and hence it is not necessary to narrow an intermediate part of each of the vanes 30 that appears from and disappears into the vane-housing unit 12 (recess part 12*a*). Therefore, no minus factor (wasted work) to newly increase the volume (newly form volume chambers) in parts on the side of the volume chambers 261 is generated in the vicinity of the volume chambers 263 during a decrease change in the volume V3 of the volume chambers 263, and hence the changes in the volumes of the volume chambers 261 to 263 can effectively work on the pumping of the entire oil pump 200.

According to the second embodiment, the outer rotor 220 includes the multiple outer rotor pieces 221, each of which is provided for each of the multiple vanes 30, each including the base 221*e*. Furthermore, the outer rotor 220 is configured such that the multiple outer rotor pieces 221 are circumferentially arranged in a state where the adjacent outer rotor pieces 221 engage with each other so as to be capable of changing the distance therebetween in the circumferential direction (along arrow Q). Thus, properly utilizing the movement (expansion and contraction) of the adjacent outer rotor pieces 221 away from and toward each other in the circumferential direction (along arrow Q), the volume chambers 262 can perform the pumping function of repeating their enlargement and shrinkage.

According to the second embodiment, the adjacent outer rotor pieces 221 engage with each other in the circumferential direction (along arrow Q) while having the engagement spaces 201 to 203 constituting the volume chamber 262, and the oil pump 200 is configured to change the volume V2 of the engagement spaces 201 to 203 by the change in the distance between the adjacent outer rotor pieces 221 in the circumferential direction (along arrow Q). Thus, properly utilizing, as the volume V2, the engagement spaces 201 to 203 generated when the outer rotor pieces 221 engage with each other, the volume chambers 262 can perform the pumping function of repeating an increase and decrease in the volume V2.

According to the second embodiment, the outer rotor pieces 221 each have the first engaging piece 221*a* to the third engaging piece 221*c* engageable with each other in the circumferential direction in a state where the adjacent outer rotor pieces 221 overlap each other in the radial direction. Furthermore, the outer rotor 220 is configured to change the volume V2 obtained by summing the engagement spaces 201 to 203 by the change in the distance between the engagement spaces 201 and 203 partially constituting the volume chamber 262 in the circumferential direction in response to the amount of overlap of the first engaging piece 221*a* to the third engaging piece 221*c*. Thus, the volume V2 of the engagement spaces 201 to 203 can be easily increased or decreased in response to the amount of overlap of the first engaging piece 221*a* to the third engaging piece 221*c* overlapping each other, and hence the outer rotor 220 (volume chambers 262) can easily perform the pumping function.

According to the second embodiment, each of the outer rotor pieces 221 is provided with the notch part 221*f* that allows the engagement space 203 constituting the volume chamber 262 and the volume chamber 261 to communicate with each other and the notch part 221*g* that allows the engagement spaces 201 and 202 constituting the volume chamber 262 and the volume chamber 261 to communicate with each other. Thus, the volume chamber 261 having the volume V1 and the volume chamber 262 having the volume V2 are allowed to communicate with each other through the notch part 221*f* and the notch part 221*g*, and hence the oil 1 can be suctioned into both the volume chamber 261 and the volume chamber 262 when the volume chambers are enlarged. When the volume chambers are shrunk, the oil 1 can be discharged from both the volume chamber 261 and the volume chamber 262.

According to the second embodiment, the outer rotor 220 is configured such that a set of the engagement spaces 201 to 203 includes the engagement spaces 201 and 202 located on the first side (the Q1 side in FIG. 5) between the two adjacent vanes 30 and the engagement space 203 located on the second side (the Q2 side in FIG. 5) between the two adjacent vanes 30. Thus, in the case where the generally annular outer rotor 220 is configured by sequentially connecting the adjacent outer rotor pieces 221 to each other, each of the outer rotor pieces 221 can easily engage with an outer rotor piece 221 adjacent on the first side (Q1 side) relative to itself through the engagement spaces 201 and 202, and each of the outer rotor pieces 221 can easily engage with an outer rotor piece 221 adjacent on the second side (Q2 side) relative to itself through the engagement space 203. The remaining effects of the second embodiment are similar to those of the aforementioned first embodiment.

Third Embodiment

The structure of an oil pump 300 according to a third embodiment of the present invention is now described with reference to FIGS. 1 and 15 to 23. In the following description, the movement direction of a housing 45 housing a pump element 35 is set to a Y-axis direction, the movement direction of a spool member 360 orthogonal to this is set to a Z-axis direction, and the rotation axis direction of an inner rotor 10 is set to an X-axis direction. In the figures, the same reference numerals as those in the aforementioned first embodiment are assigned to and show structures similar to those of the first embodiment. The housing 45 is an example of the "rotor-housing unit" in the present invention, and the spool member 360 is an example of the "cam member" in the present invention.

Figure 15:
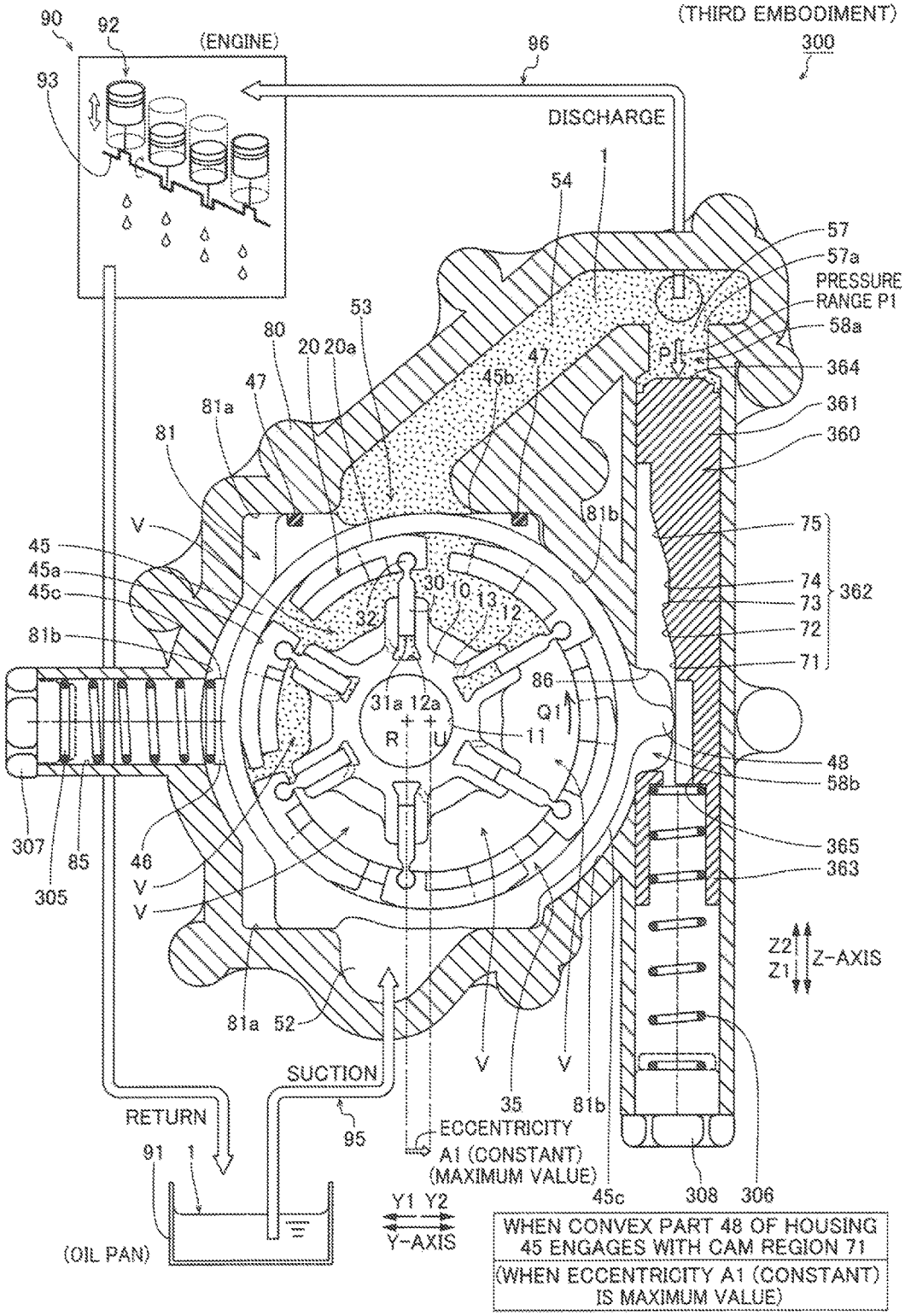
FIG. 15 A sectional view showing the overall structure of an oil pump according to a third embodiment of the present invention.

The oil pump 300 according to the third embodiment of the present invention is mounted on a motor vehicle (not shown) including an engine 90, as shown in FIG. 15 and has a function of pumping oil (lubricating oil) 1 in an oil pan 91 and supplying the oil 1 around pistons 92 and to a movable part (slide part) such as a crankshaft 93.

The oil pump 300 includes the pump element 35 having a pumping function, the housing 45 housing the pump element 35 (see FIG. 1), and a pump body 80 housing the housing 45. The housing 45 is an example of the "rotor-housing unit" in the present invention.

The outer surface 20*a* of an annular outer rotor 20 is held to be slidable with respect to the inner peripheral surface 45*a* of the housing 45. The pump body 80 is sealed from the front side of the plane of the figure by an unshown cover member in a state where the pump element 35 and the housing 45 are rotatably incorporated in a recessed pump-housing unit 81 of the pump body 80, whereby six volume chambers V are formed in the pump element 35. Each of the volume chambers V includes volume chambers 61, 62, and 63 (see FIG. 2). When the inner rotor 10 is rotated along arrow Q1 by the drive force of the crankshaft 93 in this state, the outer rotor 20 is also rotated along the same arrow Q1 as the inner rotor 10 through six vanes 30. The volume chambers V periodically change their shapes along with the rotation of the pump element 35 along arrow Q1, thereby providing the pumping function.

The pump-housing unit 81 is formed with a suction port 52 that suctions the oil 1 and a discharge port 53 that discharges the oil 1. The suction port 52 is connected to an intake oil passage 95 extending from the oil pan 91. The pump body 80 includes a discharge oil passage 54 connected to the discharge port 53 of the pump-housing unit 81, and the discharge oil passage 54 is connected to an external supply oil passage 96 supplying the oil 1 to each part of the engine 90.

The pump-housing unit 81 has such a shape that the housing 45 is housed so as to be movable back and forth along the Y-axis direction. Specifically, the pump-housing unit 81 has an inner surface 81*a* extending in the Y-axis direction on each of a Z1 side and a Z2 side, and the housing 45 has an outer surface 45*b* extending in the Y-axis direction on each of the Z1 side and the Z2 side. The housing 45 has such an outer shape that the housing 45 is fitted into the pump-housing unit 81 while the outer surface 45*b* faces the inner surface 81*a* of the pump-housing unit 81. The outer surface 45*b* of the housing 45 is slid with respect to the inner surface 81*a* of the pump-housing unit 81 so that the housing 45 is linearly moved along arrow Y1 or arrow Y2 with respect to the pump-housing unit 81. The Y-axis direction is an example of the "first direction" in the present invention.

Sealing members 47 are fitted into the outer surface 45*b* of the housing 45 on the Z2 side. The respective sealing members 47 made of a rubber (resin) material are provided in the outer surface 45*b* on a Y1 side and the outer surface 45*b* on a Y2 side. These sealing members 47 prevent the oil 1 having a relatively high pressure on the side of the discharge port 53 in the pump-housing unit 81 from being leaked to the suction port 52 (intake oil passage 95), which is a region having a relatively low pressure.

Figure 16:
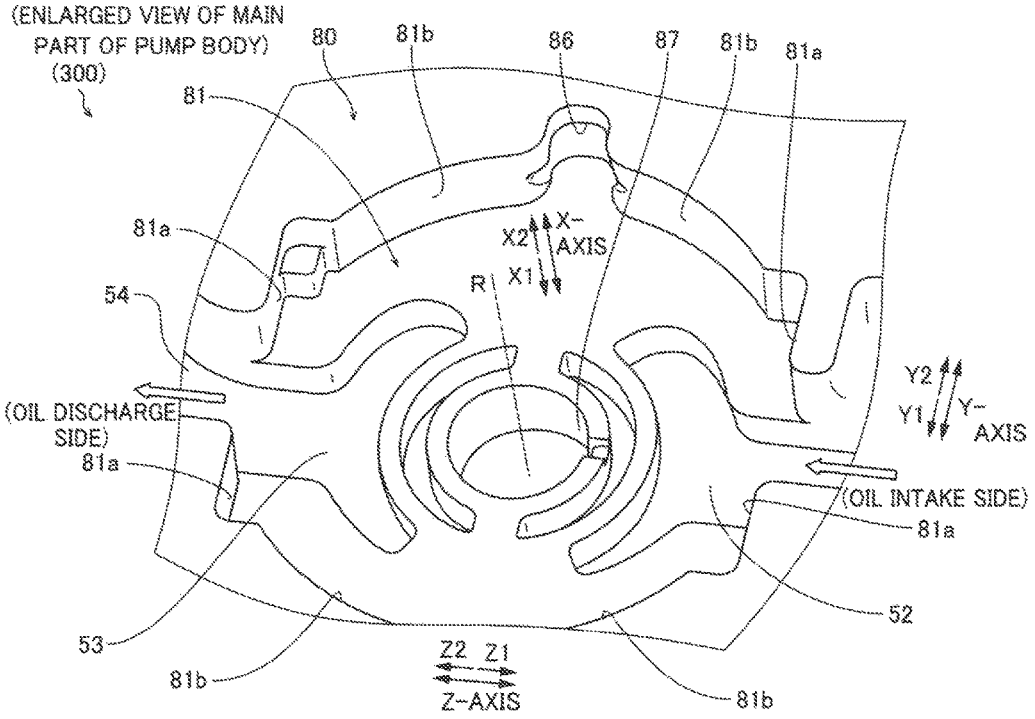
FIG. 16 A perspective view partially showing the internal structure of a pump-housing unit of a pump body constituting the oil pump according to the third embodiment of the present invention.

The pump-housing unit 81 further has an inner surface 81*b* extending in an arcuate shape on each of the Y1 side and the Y2 side, as shown in FIGS. 15 and 16. The inner surface 81*b* on the Y1 side is provided with a spring-storing unit 85 (see FIG. 15), and the inner surface 81*b* on the Y2 side is provided with an opening 86. As shown in FIG. 16, a through-hole 87 passing through the pump body 80 in the X-axis direction is formed in a central part held between the suction port 52 and the discharge port 53 of the pump-housing unit 81. A drive shaft (not shown) for rotating the inner rotor 10 (see FIG. 15) is configured to be inserted into the through-hole 87. This drive shaft is fixed to a shaft hole 11 of the inner rotor 10 in a state where the inner rotor 10 is arranged in the pump-housing unit 81. The housing 45 further has an outer surface 45*c* extending in an arcuate shape on each of the Y1 side and the Y2 side, as shown in FIG. 15. The outer surface 45*c* on the Y1 side is provided with a seat part 46 having a flat surface, and the outer surface 45*c* on the Y2 side is provided with a convex part 48. The convex part 48 is an example of the "cam engaging part" in the present invention.

The housing 45 is arranged in the pump-housing unit 81 such that the convex part 48 is directed to a side (Y2 side) on which the opening 86 of the pump-housing unit 81 is provided. The side (Y1 side) of the spring-storing unit 85 opposite to the housing 45 is sealed by a plug screw 307 in a state where a coiled spring 305 is fitted into the spring-storing unit 85 and the seat part 46 is pressed along arrow Y2. Thus, the housing 45 is constantly urged to the Y2 side on which the opening 86 is provided by the urging force of the spring 305. When the housing 45 is located farthest on Y2 side, a tip end of the convex part 48 protrudes into an oil passage part 57 described later through the opening 86. The spring 305 is an example of the "first urging member" in the present invention.

The inner rotor 10 has a rotation center R fixedly arranged. The housing 45 holding the outer rotor 20 is moved by a prescribed amount in the Y-axis direction (along arrow Y1 or arrow Y2), whereby the rotation center U of the outer rotor 20 is eccentric in a transverse direction (along arrow Y1 or arrow Y2) relative to the rotation center R of the inner rotor 10. In this case, a tip end 32 of each of the vanes 30 protrudes from a recess part 12*a* of a vane-housing unit 12 toward an outer rotor piece 21 by an amount in response to eccentricity in each rotational position (rotational angle) along arrow Q1. Therefore, each of the vanes 30 is rotationally moved along arrow Q1 while appearing from and disappearing into the recess part 12*a* along with the rotation of the inner rotor 10 and allows the outer rotor 20 to be rotated along arrow Q1 in an accompanying manner.

At this time, in each of the volume chambers V, its volume is periodically changed between a minimum value and a maximum value, following the shape deformation of the volume chambers V. The oil 1 is suctioned according to a decrease in the pressure of the volume chambers V following the change of the volume of each of the volume chambers V from the minimum value to the maximum value, and the suctioned oil 1 is discharged according to an increase in the pressure of the volume chambers V following the change of the volume of each of the volume chambers V from the maximum value to the minimum value. Thus, the oil pump 300 is configured to operate with the pumping function.

According to the third embodiment, the oil pump 300 includes the spool member 360, as shown in FIG. 15. The spool member 360 is incorporated in the pump body 80 and is linearly moved in the Z-axis direction orthogonal to the Y-axis direction in response to the discharge pressure P (the oil 1 on a discharge side is dotted in FIG. 15) of the oil 1 from the discharge port 53. The housing 45 is moved in the Y-axis direction following the linear movement of the spool member 360 in the Z-axis direction. The spool member 360 has a function of increasing and decreasing the amount of movement of the housing 45 in the Y-axis direction (=the eccentricity of the rotation center U of the outer rotor 20 with respect to the rotation center R of the inner rotor 10). The Z-axis direction is an example of the "second direction" in the present invention. This point is now described in detail.

As shown in FIG. 15, the pump body 80 is formed with the oil passage part 57 for drawing the oil 1 is formed in the middle of the discharge oil passage 54. The oil passage part 57 has a circular cross-section except for a part corresponding to the opening 86, and the spool member 360 extending in the Z-axis direction is inserted into the oil passage part 57. The oil passage part 57 has such a shape that the spool member 360 is housed so as to be movable back and forth along arrow Z1 or arrow Z2 in the Z-axis direction. Arrow Z1 is an example of the "one direction of the second direction" in the present invention. Arrow Z2 is an example of the "another direction of the second direction" in the present invention.

Figure 17:
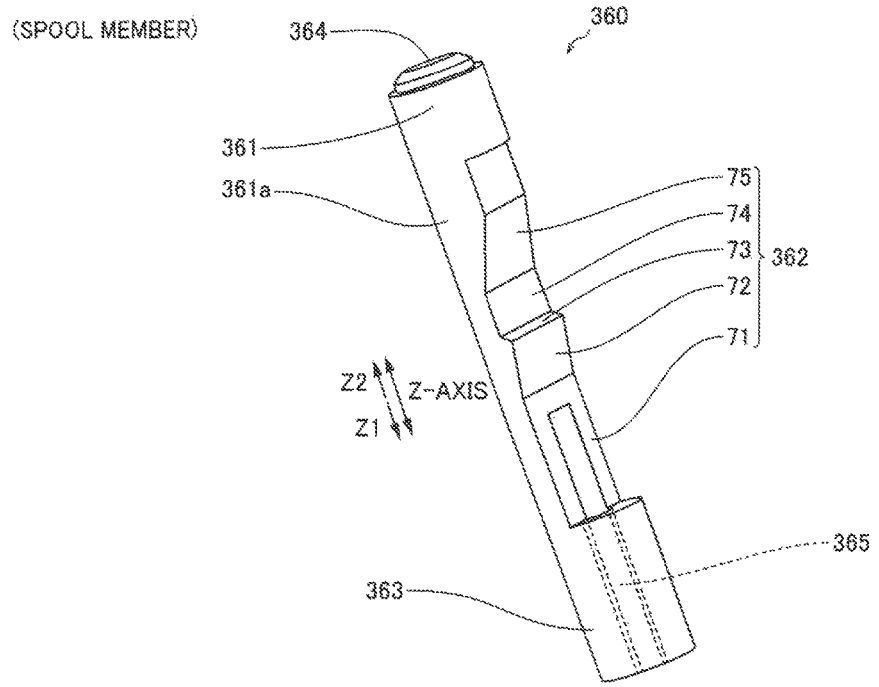
FIG. 17 A perspective view showing the structure of a spool member constituting the oil pump according to the third embodiment of the present invention.

The spool member 360 includes a main body part 361 extending in the form of a bar in the Z-axis direction, a cam-shaped part 362 formed in a region of the main body part 361 closer to a central part along the Z-axis direction, a recessed seat part 363 formed in a first end (Z1 side), and a pressure-receiving surface 364 formed in a second end (Z2 side), as shown in FIG. 17. The spool member 360 is inserted into the oil passage part 57 such that the pressure-receiving surface 364 is directed to the discharge oil passage 54, and the side (Z1 side) of the spool member 360 opposite to the oil passage part 57 is sealed by a plug spring 308 in a state where a coiled spring 306 is fitted into the seat part 363. The cam-shaped part 362 is an example of the "cam region" in the present invention. The spring 306 is an example of the "second urging member" in the present invention.

The cam-shaped part 362 is formed to have a prescribed concave-convex shape by cutting one side surface of the main body part 361, and in a part other than the cam-shaped part 362, a cylindrical outer surface 361*a* remains. The outer surface 361*a* of the spool member 360 is slid with respect to the inner surface 57*a* (see FIG. 15) of the oil passage part 57 in a state where the main body part 361 is slidingly inserted into the oil passage part 57 such that the outer surface 361*a* faces the inner surface 57*a*, whereby the spool member 360 is linearly moved along arrow Z1 or arrow Z2 with respect to the oil passage part 57. The inner diameter of the oil passage part 57 is slightly larger than the outer diameter of the spool member 360, and the cylindrical outer surface 361*a* of the spool member 360 is smoothly slid with respect to the inner surface 57*a* of the oil passage part 57.

As shown in FIG. 15, the spool member 360 is arranged in the oil passage part 57, whereby the oil passage part 57 is divided into a pressure-receiving region 58*a* where the pressure of the oil 1 discharged from the discharge port 53 directly acts along arrow Z1 and an adjustment region 58*b* including a region provided with the cam-shaped part 362 and the seat part 363, where the spool member 360 is allowed to be moved without directly receiving the discharge pressure of the oil 1. In a state where the spool member 360 is arranged in the oil passage part 57, the cam-shaped part 362 is arranged to face the convex part 48 of the housing 45 protruding into the adjustment region 58*b* of the oil passage part 57 through the opening 86. In this case, the tip end of the convex part 48 of the housing 45 comes into contact with a prescribed part of the cam-shaped part 362 from the Y1 side by the urging force of the spring 305.

Thus, according to the third embodiment, when the oil 1 discharged from the discharge port 53 is drawn into the pressure-receiving region 58*a* of the oil passage part 57 through the discharge oil passage 54 with the discharge pressure P during operation of the pump element 35, the oil 1 acts on the pressure-receiving surface 364 of the spool member 360 so that the spool member 360 is linearly moved along arrow Z1. Along with the linear movement of the cam-shaped part 362 along arrow Z1 in response to the discharge pressure P, the housing 45 is moved along arrow Y1 or arrow Y2 with respect to the pump body 80 through the convex part 48 coming into contact with the cam-shaped part 362. Consequently, in the pump element 35, the eccentricity of the outer rotor 20 with respect to the inner rotor 10 is increased or decreased along with an increase or decrease in the amount of movement of the housing 45 in the Y-axis direction.

Figure 21:
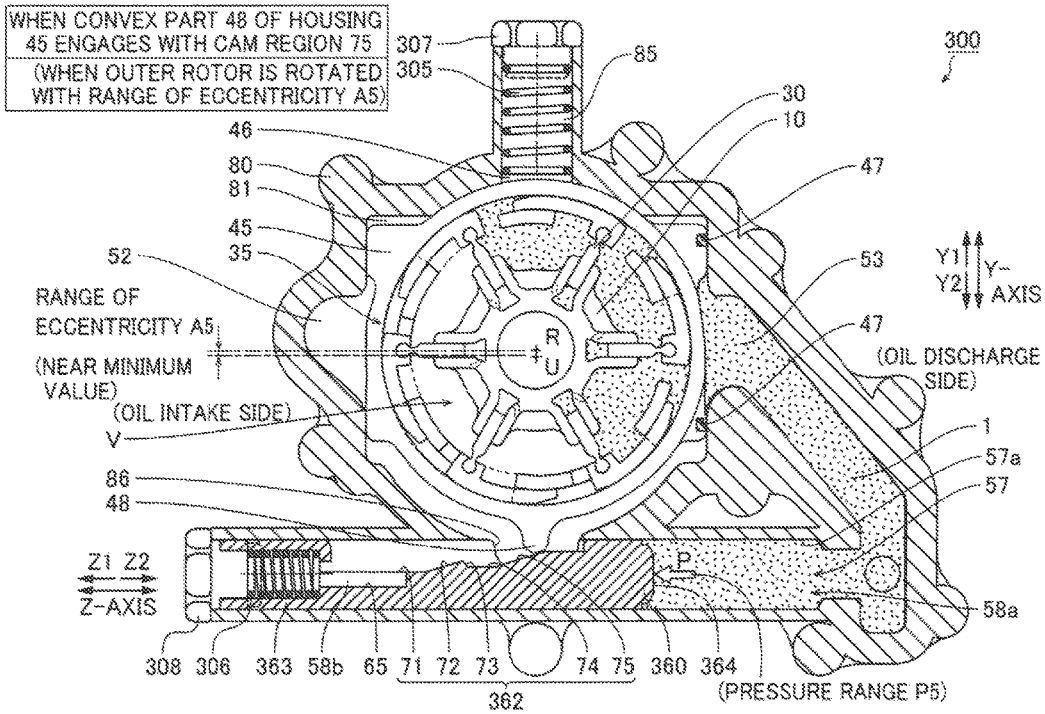
FIG. 21 A diagram for illustrating the operation of the oil pump according to the third embodiment of the present invention.
Figure 22:
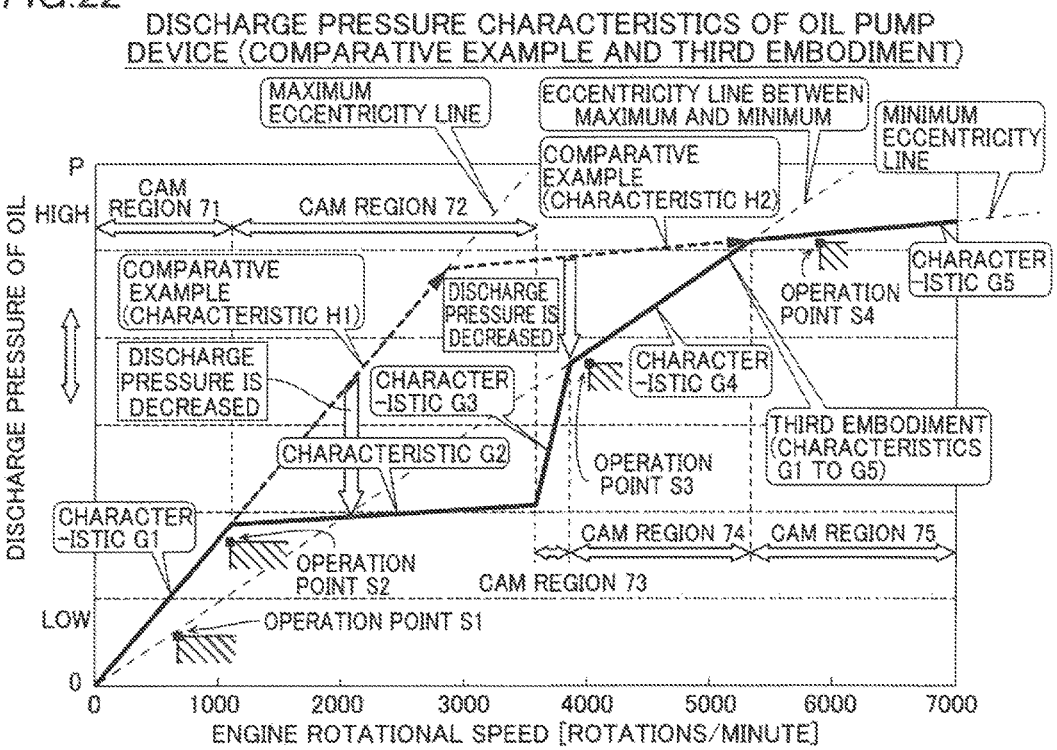
FIG. 22 A diagram showing the characteristics (engine rotational speed-discharge pressure characteristics) of the oil pump according to the third embodiment of the present invention and the characteristics (engine rotational speed-discharge pressure characteristics) of an oil pump as a comparative example to the third embodiment.

When the eccentricity of the outer rotor 20 with respect to the inner rotor 10 is relatively small (a state in FIG. 21, for example), the pumping amount resulting from the enlargement and shrinkage of the six volume chambers V volumetrically integrated is relatively small, and the rate of discharge of the oil 1 at the same rotational speed is relatively small. In this case, an increase (the inclination of a straight line (discharge pressure characteristics) shown in FIG. 22) in the discharge pressure P following an increase in the rotational speed is modest. When the eccentricity is relatively large (a state in FIG. 15, for example), the pumping amount resulting from the enlargement and shrinkage of the six volume chambers V volumetrically integrated is relatively large, and the rate of discharge of the oil 1 at the same rotational speed is relatively large. In this case, an increase in the discharge pressure P following an increase in the rotational speed is large (the inclination of the straight line shown in FIG. 22 is increased).

According to the third embodiment, the cam-shaped part 362 of the spool member 360 has such a surface shape (concave-convex shape) that the amount D of protrusion of the cam-shaped part 362 in the Y-axis direction with respect to the convex part 48 of the housing 48 is changed (increased or decreased) along the Z-axis direction. Thus, the housing 45 is moved along arrow Y1 or arrow Y2 in response to the change (the undulating state of the cam-shaped part 362) in the amount D of protrusion of the cam-shaped part 362 following the movement of the spool member 360 along arrow Z1, so that the eccentricity of the rotation center U of the outer rotor 20 with respect to the rotation center R of the inner rotor 10 is increased or decreased.

More detailedly, the cam-shaped part 362 is formed by connecting a cam region 71, a cam region 72, a cam region 73, a cam region 74, and a cam region 75 in this order along the Z-axis direction from the first end (Z1 side) toward the second end (Z2 side). The cam regions 71, 72, and 73 are examples of the "first cam region", the "second cam region", and the "third cam region" in the present invention, respectively.

Based on the height (the amount D of protrusion along arrow Y1) of the cam region 71, the cam region 71 is flattened along the Z-axis direction and has a constant height along the Z-axis direction. The cam region 72 is continuously connected to the cam region 71, and the height (the amount D of protrusion along arrow Y1) of the cam region 72 is gradually increased from the cam region 71 toward a Y2 direction. The cam region 73 is connected to an end point part of the cam region 72 on the Z2 side so as to be bent along arrow Y2, and the height (the amount D of protrusion along arrow Y1) of the cam region 73 is gradually decreased from the cam region 72 toward the Y2 direction. The cam region 74 is flattened along the Z-axis direction while maintaining the height (the amount D of protrusion along arrow Y1) of an end point part of the cam region 73 on the Z2 side, and the height of the cam region 74 in that position is maintained constant. The height of the cam region 74 is larger than the height of the cam region 71. The cam region 75 is continuously connected to an end point part of the cam region 74 on the Z2 side, and the height (the amount D of protrusion along arrow Y1) of the cam region 75 is gradually increased from the cam region 74 toward the Y2 direction.

According to the third embodiment, when the discharge pressure P of the oil 1 from the discharge port 53 is within a pressure range P1 (see FIG. 15), the cam region 71 is a region arranged to face the convex part 48 of the housing 45. When the discharge pressure P of the oil 1 from the discharge port 53 is within a pressure range P2 (see FIG. 18) larger than the pressure range P1, the cam region 72 is a region engaging with the convex part 48 of the housing 45. When the discharge pressure P of the oil 1 from the discharge port 53 is within a pressure range P3 (see FIG. 19) larger than the pressure range P2, the cam region 73 is a region engaging with the convex part 48 of the housing 45. The pressure range P1, the pressure range P2, and the pressure range P3 are examples of the "first pressure range", the "second pressure range", and the "third pressure range" in the present invention, respectively.

In addition to the above, when the discharge pressure P of the oil 1 from the discharge port 53 is within a pressure range P4 (see FIG. 20) larger than the pressure range P3, the cam region 74 is a region engaging with the convex part 48 of the housing 45. When the discharge pressure P of the oil 1 from the discharge port 53 is within a pressure range P5 (see FIG. 21) larger than the pressure range P4, the cam region 75 is a region engaging with the convex part 48 of the housing 45. There is a relationship of the pressure range P1<the pressure range P2<the pressure range P3<the pressure range P4<the pressure range P5.

When the convex part 48 of the housing 45 is arranged to face the cam region 71 (see FIG. 15), the eccentricity of the rotation center U of the outer rotor 20 with respect to the rotation center R of the inner rotor 10 is eccentricity A1, which is a maximum value. When the convex part 48 of the housing 45 is arranged to face the cam region 75 (see FIG. 21), the eccentricity of the rotation center U of the outer rotor 20 with respect to the rotation center R of the inner rotor 10 is eccentricity A5, which is a minimum value.

Figure 18:
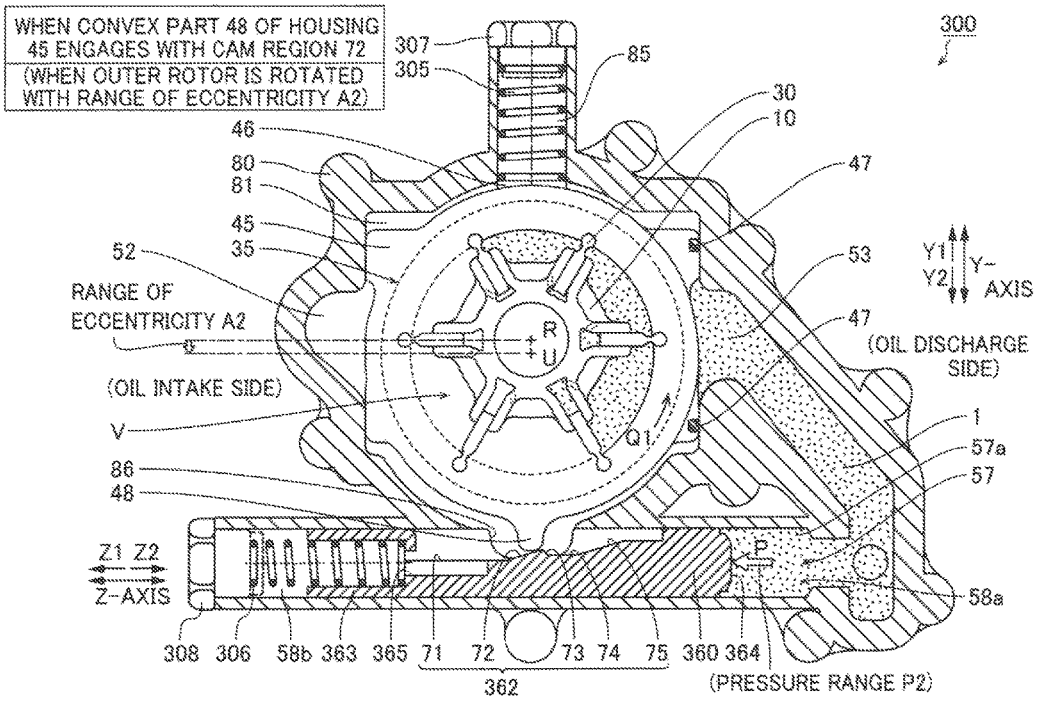
FIG. 18 A diagram for illustrating the operation of the oil pump according to the third embodiment of the present invention.

In the oil pump 300, when the spool member 360 is moved along arrow Z1 so as to sequentially switch the cam-shaped part 362 of the spool member 360 to the cam region 71, the cam region 72, the cam region 73, the cam region 74, and the cam region 75 in response to an increase in the discharge pressure P of the oil 1 from the discharge port 53, the amount of movement of the housing 45 in the Y-axis direction with respect to the rotation center R of the inner rotor 10 (the eccentricity of the outer rotor 20 with respect to the inner rotor 10) is maintained (unchanged) in the case of the cam region 71 (see FIG. 15) whereas the amount of movement of the housing 45 in the Y-axis direction with respect to the rotation center R of the inner rotor 10 (the eccentricity of the outer rotor 20 with respect to the inner rotor 10) is decreased in the case of the cam region 72 (see FIG. 18).

The oil pump 300 is configured such that in the case of the cam region 73 (see FIG. 19), the amount of movement of the housing 45 in the Y-axis direction with respect to the rotation center R of the inner rotor 10 (the eccentricity of the outer rotor 20 with respect to the inner rotor 10) is increased (the eccentricity is reversed in an increasing direction) from the state where the amount of movement of the housing 45 in the Y-axis direction with respect to the rotation center R of the inner rotor 10 is decreased in the case of the cam region 72. Furthermore, the amount of movement of the housing 45 in the Y-axis direction with respect to the rotation center R of the inner rotor 10 (the eccentricity of the outer rotor 20 with respect to the inner rotor 10) is maintained (the increased state in the case of the cam region 73 is unchanged) in the case of the cam region 74 (see FIG. 20) whereas the amount of movement of the housing 45 in the Y-axis direction with respect to the rotation center R of the inner rotor 10 (the eccentricity of the outer rotor 20 with respect to the inner rotor 10) is decreased again in the case of the cam region 75 (see FIG. 21) (the housing 45 is moved such that the eccentricity is decreased).

More specifically, the cam region 71 is formed such that the eccentricity of the outer rotor 20 with respect to the inner rotor 10 associated with the movement of the housing 45 in the Y-axis direction is maintained at (fixed to) the eccentricity A1. The cam region 72 is formed such that the eccentricity of the outer rotor 20 with respect to the inner rotor 10 associated with the movement of the housing 45 in the Y-axis direction is (decreased to) eccentricity A2 smaller than the eccentricity A1. The cam region 73 is formed such that the eccentricity of the outer rotor 20 with respect to the inner rotor 10 associated with the movement of the housing 45 in the Y-axis direction is increased to eccentricity A3 larger than the minimum value of the eccentricity A2. The maximum value of the eccentricity A3 is smaller than the maximum value (=eccentricity A1) of the eccentricity A2. The eccentricity A1, the eccentricity A2, and the eccentricity A3 are examples of the "first eccentricity", the "second eccentricity", and the "third eccentricity" in the present invention, respectively.

In addition to the above, the cam region 74 is formed such that the eccentricity of the outer rotor 20 with respect to the inner rotor 10 associated with the movement of the housing 45 in the Y-axis direction is maintained at eccentricity A4, which is the maximum value of the eccentricity A3 (but a value smaller than the maximum value of the eccentricity A2), and the cam region 75 is formed such that the eccentricity of the outer rotor 20 with respect to the inner rotor 10 associated with the movement of the housing 45 in the Y-axis direction is decreased to the eccentricity A5 smaller than the eccentricity A4.

Therefore, the cam region 72 is provided such that the eccentricity of the outer rotor 20 with respect to the inner rotor 10 is decreased from the eccentricity A1 (=the maximum value of the eccentricity A2) to the eccentricity A2 (=the minimum value of the eccentricity A2) toward the cam region 73. The cam region 73 is provided such that the eccentricity of the outer rotor 20 with respect to the inner rotor 10 is increased from the eccentricity A2 (=the minimum value of the eccentricity A2) to the eccentricity A3 (restricted to the maximum value of the eccentricity A2) toward the cam region 74. The cam region 75 is provided such that the eccentricity of the outer rotor 20 with respect to the inner rotor 10 is increased from the eccentricity A4

(=the maximum value of the eccentricity A3) to the eccentricity A5 (=the minimum value of the eccentricity A5) toward a side opposite to the cam region 74.

The cam region 71, the cam region 72, the cam region 73, the cam region 74, and the cam region 75 are continuously provided, and the convex part 48 of the housing 45 is moved in the Y-axis direction (along arrow Y1 or arrow Y2) by sequentially sliding along the cam region 71, the cam region 72, the cam region 73, the cam region 74, and the cam region 75 following the movement of the spool member 360 along arrow Z1.

As discussed in relation to the discharge pressure P, according to the third embodiment, when the discharge pressure P of the oil 1 is within the pressure range P1 (see FIG. 15), the cam region 71 of the spool member 360 is linearly moved to a position corresponding to the convex part 48 of the housing 45 so that the housing 45 is linearly moved to a first eccentricity position in the Y-axis direction and the eccentricity of the outer rotor 20 with respect to the inner rotor 10 is maintained at the eccentricity A1, which is the maximum eccentricity. In the pressure range P2 (see FIG. 18), the cam region 72 of the spool member 360 is linearly moved to a position engaging with the convex part 48 of the housing 45 so that the housing 45 is linearly moved to a second eccentricity position in the Y-axis direction and the eccentricity of the outer rotor 20 with respect to the inner rotor 10 is changed to the eccentricity A2 smaller than the eccentricity A1. In the pressure range P3 (see FIG. 19), the cam region 73 of the spool member 360 is linearly moved to a position engaging with the convex part 48 of the housing 45 so that the housing 45 is linearly moved to a third eccentricity position in the Y-axis direction and the eccentricity of the outer rotor 20 with respect to the inner rotor 10 is changed to the eccentricity A3 larger than the minimum value of the eccentricity A2.

In the pressure range P4 (see FIG. 20), the cam region 74 of the spool member 360 is linearly moved to a position engaging with the convex part 48 of the housing 45 so that the housing 45 is linearly moved to a fourth eccentricity position in the Y-axis direction and the eccentricity of the outer rotor 20 with respect to the inner rotor 10 is maintained at the eccentricity A4, which is the maximum of the eccentricity A3. In the pressure range P5 (see FIG. 21), the cam region 75 of the spool member 360 is linearly moved to a position engaging with the convex part 48 of the housing 45 so that the housing 45 is linearly moved to a fifth eccentricity position in the Y-axis direction and the eccentricity of the outer rotor 20 with respect to the inner rotor 10 is changed to the eccentricity A5 smaller than the eccentricity A4.

According to the third embodiment, the suction port 52 (intake oil passage 95) in the pump-housing unit 81 communicates with the adjustment region **58*b* provided with the cam-shaped part 362 of the spool member 360 through the opening 86 in a region on the Y2 side, as shown in FIG. 15. Therefore, during operation of the pump element 35, at least part of the oil 1 suctioned into the suction port 52 through the opening 86 is drawn into the cam-shaped part 362 (cam regions 71 to 75) of the spool member 360. Thus, when the housing 45 is moved in the Y-axis direction through the cam-shaped part 362 provided in the spool member 360, the oil 1, the pressure of which is lower than the discharge pressure P, is easily drawn into the vicinity of the cam-shaped part 362 (adjustment region 58*b*), and the cam regions 71 to 75 are lubricated. The spool member 360 is formed with a through-hole 365 passing through the seat part 363 (bottom part) in the Z-axis direction such that a side on which the spring 306 is provided and the cam region 71 (cam-shaped part 362) communicate with each other. Therefore, at least part of the oil 1 suctioned into the suction port 52 is drawn into not only the cam-shaped part 362 but also a space part between the plug spring 308 and the seat part 363. Thus, even when the volume of the space part (adjustment region 58*b*) between the plug spring 308 and the seat part 363 is increased or decreased following the forward or reverse movement of the spool member 360 in the Z-axis direction, the oil 1 in a low pressure (intake pressure) state simply reversibly flows and does not interrupt the movement of the spool member 360** in the Z-axis direction.

When the rotation center R of the inner rotor 10 and the rotation center U of the outer rotor 20 completely coincide with each other, the tip end 32 of each of the vanes 30 protrudes from the recess part **12*a* (vane-housing unit 12) toward the outer rotor piece 21 by the same amount. Therefore, even when the inner rotor 10 is rotated, each of the vanes 30 is rotationally moved without changing the amount of protrusion and only allows the outer rotor 20 to be rotated in an accompanying manner, and hence the oil pump 300** does not perform the pumping function.

Figure 19:
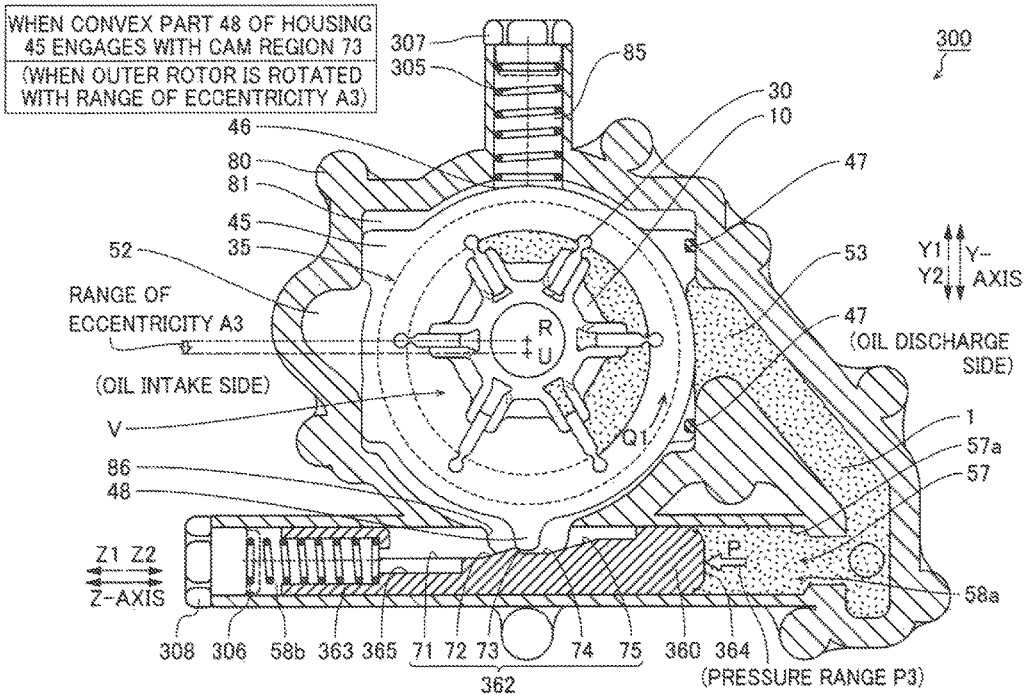
FIG. 19 A diagram for illustrating the operation of the oil pump according to the third embodiment of the present invention.
Figure 20:
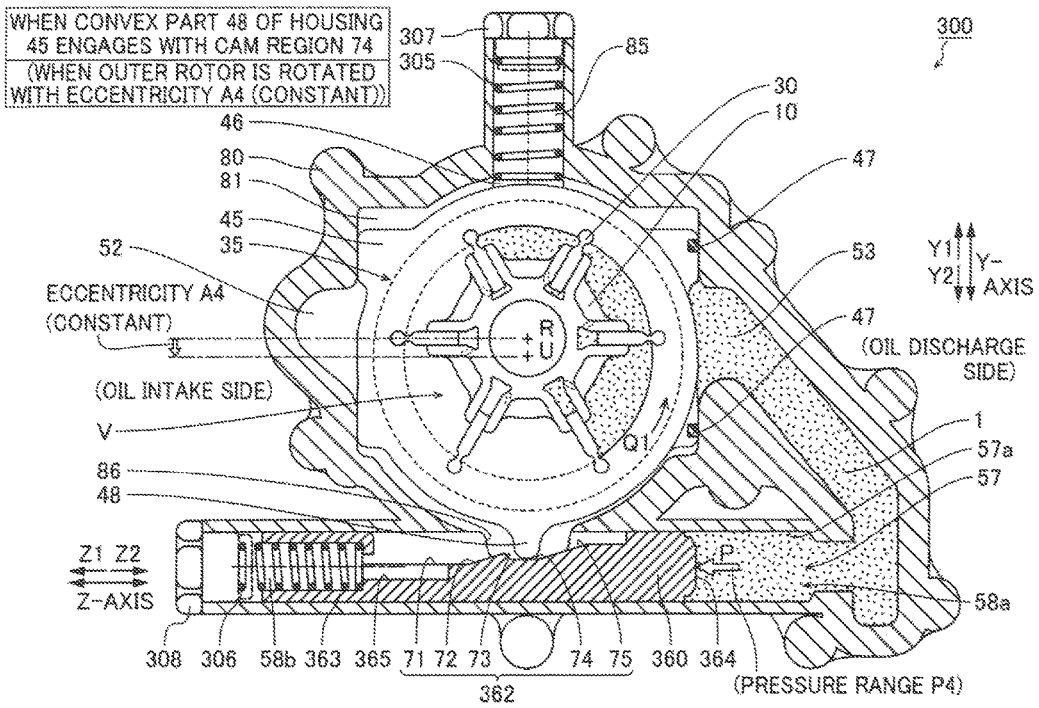
FIG. 20 A diagram for illustrating the operation of the oil pump according to the third embodiment of the present invention.

Due to the aforementioned structure, the oil pump 300 has the following characteristics (the discharge pressure characteristics of the oil 1 with respect to the rotational speed of the inner rotor 10). FIG. 22 shows the characteristics of the discharge pressure (vertical axis) of the oil 1 discharged from the pump body 80 (discharge oil passage 54) with respect to the rotational speed (horizontal axis) of the engine 90 (crankshaft 93) as the operating characteristics of the oil pump 300. FIG. 22 shows not only the operating characteristics of the oil pump 300 but also the characteristics (discharge pressure characteristics) of a conventional oil pump as a comparative example. In the oil pump as the comparative example (conventional example), when the housing (rotor-housing unit) is moved in one direction along with an increase in the discharge pressure of the oil, the eccentricity of the housing with respect to the inner rotor (rotor) is monotonically decreased, and the pump capacity is decreased. The following description is with reference to FIGS. 15 and 18 to 21 according to the movement position of the spool member 360. FIGS. 18 to 20 illustrate the schematic structure of the pump element 35, and the outer shape of the annular outer rotor 20 (outer rotor piece 21) is shown by broken lines.

In a section in which the rotational speed of the engine 90 (see FIG. 15) is up to about 1100 rotations per minute in FIG. 22, the cam region 71 of the spool member 360 is arranged to face the convex part 48 of the housing 45, as shown in FIG. 15. In this case, the cam region 71 flattened along the Z-axis direction is only moved along arrow Z1 even when the rotational speed of the engine 90 (crankshaft 93) is increased so that the spool member 360 is moved along arrow Z1 along with an increase in the discharge pressure P of the oil 1 from the discharge port 53. Thus, the amount of movement of the convex part 48 in the Y-axis direction is unchanged. In this case, the eccentricity of the rotation center U of the outer rotor 20 with respect to the rotation center R of the inner rotor 10 is maintained at the eccentricity A1, which is a maximum value. Therefore, the discharge pressure characteristics are shaped like a characteristic G1 in FIG. 22 when the housing 45 is maintained at the eccentricity A1. A straight line (a broken line on which the characteristic G1 extends) having the inclination of the characteristic G1 corresponds to a maximum eccentricity line in the oil pump 300. A range of the characteristic G1 corresponds to the pressure range P1 of the discharge pressure P.

Then, when the rotational speed of the engine 90 exceeds about 1100 rotations per minute and the discharge pressure P exceeds the maximum value of the pressure range P1, a position of the spool member 360 moved along arrow Z1, engaging with the convex part 48 is switched from the cam region 71 to the cam region 72. Thus, the oil pump 300 shifts from the state in FIG. 15 to a state in FIG. 18. When the spool member 360 is moved along arrow Z1 along with an increase in the discharge pressure P of the oil 1 from the discharge port 53, as shown in FIG. 18, the convex part 48 is gradually moved along arrow Y1 to follow the shape (inclined shape) of the cam region 72. In other words, the eccentricity of the outer rotor 20 with respect to the inner rotor 10 is decreased along with an increase in the amount D of protrusion along arrow Y1 when the convex part 48 engages with the cam region 72. Therefore, the housing 45 is changed (decreased) from the eccentricity A1 (constant value) to the eccentricity A2. In this case, the discharge pressure characteristics are shaped like a characteristic G2 in FIG. 22. A range of the characteristic G2 corresponds to the pressure range P2 of the discharge pressure P.

Then, when the rotational speed of the engine 90 exceeds about 3600 rotations per minute and the discharge pressure P exceeds the maximum value of the pressure range P2, a position of the spool member 360 moved along arrow Z1, engaging with the convex part 48 is switched from the cam region 72 to the cam region 73. Thus, the oil pump 300 shifts from the state in FIG. 18 to a state in FIG. 19. When the spool member 360 is moved along arrow Z1 along with an increase in the discharge pressure P of the oil 1 from the discharge port 53, as shown in FIG. 19, the convex part 48 is gradually moved along arrow Y2 to follow the shape (inclined shape) of the cam region 73. In other words, the eccentricity of the outer rotor 20 with respect to the inner rotor 10 is increased along with a decrease in the amount D of protrusion along arrow Y1 when the convex part 48 engages with the cam region 73. Therefore, the housing 45 is changed (increased) to the eccentricity A3 larger than the maximum value of the eccentricity A2 after the maximum value of the eccentricity A2. In this case, the discharge pressure characteristics are shaped like a characteristic G3 in FIG. 22. A range of the characteristic G3 corresponds to the pressure range P3 of the discharge pressure P.

Then, when the rotational speed of the engine 90 exceeds about 3900 rotations per minute and the discharge pressure P exceeds the maximum value of the pressure range P3, a position of the spool member 360 moved along arrow Z1, engaging with the convex part 48 is switched from the cam region 73 to the cam region 74. Thus, the oil pump 300 shifts from the state in FIG. 19 to a state in FIG. 20. When the spool member 360 is moved along arrow Z1 along with an increase in the discharge pressure P of the oil 1 from the discharge port 53, as shown in FIG. 20, the convex part 48 is not moved in the Y-axis direction to follow the shape (flat shape) of the cam region 74. In other words, the eccentricity of the outer rotor 20 with respect to the inner rotor 10 is maintained at that position (the maximum value of the eccentricity A3=the eccentricity A4 (constant value)) when the convex part 48 engages with the cam region 74. In this case, the discharge pressure characteristics are shaped like a characteristic G4 in FIG. 22. A range of the characteristic G4 corresponds to the pressure range P4 of the discharge pressure P. The inclination of the characteristic G4 is smaller than the inclination of the characteristic G1. In other words, the eccentricity of the housing 45 is decreased from the eccentricity A1 to the eccentricity A4, and the pump capacity (a net rate of discharge per rotation) is decreased. In other words, a straight line (a broken line on which the characteristic G4 extends) having the inclination of the characteristic G4 corresponds to an eccentricity line between the maximum and the minimum in the oil pump 300.

Then, when the rotational speed of the engine 90 exceeds about 5300 rotations per minute corresponding to the pressure P4 and the discharge pressure P reaches the pressure P4, a position of the spool member 360 moved along arrow Z1, engaging with the convex part 48 is switched from the cam region 74 to the cam region 75. Thus, the oil pump 300 shifts from the state in FIG. 20 to the state in FIG. 21. When the spool member 360 is moved along arrow Z1 along with an increase in the discharge pressure P of the oil 1 from the discharge port 53, as shown in FIG. 21, the convex part 48 is gradually moved along arrow Y1 to follow the shape (inclined shape) of the cam region 75. In other words, the eccentricity of the outer rotor 20 with respect to the inner rotor 10 is decreased again along with an increase in the amount D of protrusion along arrow Y1 when the convex part 48 engages with the cam region 75. Therefore, the housing 45 is changed (decreased) from the eccentricity A4 (constant value) to the eccentricity A5. In this case, the discharge pressure characteristics are shaped like a characteristic G5 in FIG. 22. A straight line (a broken line on which the characteristic G5 extends) having the inclination of the characteristic G5 corresponds to a minimum eccentricity line in the oil pump 300. A range of the characteristic G5 corresponds to the pressure range P5 of the discharge pressure P. Thus, the oil pump 300 has the discharge pressure characteristics obtained by connecting the characteristics G1 to G5, as shown by a bold solid line.

In the oil pump according to the comparative example, on the other hand, in a section in which the rotational speed of the engine 90 is up to about 2900 rotations per minute, the discharge pressure P of the oil 1 is increased following an increase in the rotational speed of the engine 90 (crankshaft 93), but the eccentricity (in this case, the eccentricity A1) of the housing (rotor-housing unit) is unchanged. Therefore, as shown in FIG. 22, the discharge pressure characteristics are shaped like a characteristic H1 obtained by extending a graph to a position in which the rotational speed of the engine 90 reaches about 2900 rotations per minute while maintaining an inclination equal to that of the characteristic G1 in the oil pump 300 (see FIG. 15). Then, when the rotational speed of the engine 90 exceeds about 2900 rotations per minute, the housing (rotor-housing unit) is moved in one direction on the basis of the discharge pressure P. Thus, the eccentricity (rotor-housing unit) of the housing is promptly decreased from the eccentricity A1, which is the maximum value, to the eccentricity A5 (A1>A5), which is a minimum value range. Therefore, at about 2900 rotations per minute, the discharge pressure characteristics follow a characteristic H2 having an inclination smaller than that of the characteristic H1. The characteristic H2 extends to a position where the rotational speed of the engine 90 is about 2900 rotations per minute with the same inclination as that of the characteristic G5 in the oil pump 300 (see FIG. 15). Thus, the oil pump according to the comparative example has the discharge pressure characteristics obtained by connecting the characteristic H1 (maximum eccentricity line) and the characteristic H2 (minimum eccentricity line) shown by bold broken lines.

As shown in FIG. 22, in the motor vehicle mounted with the oil pump 300, operation points S1 to S4 for supplying the oil 1 by prescribed oil pressures are set according to the rotational speed of the engine 90. In the oil pump 300 according to the third embodiment, the discharge pressure characteristics (characteristics G1 to G5) satisfying the supply pressure of the oil 1 required at the operation points S1 to S4 are achieved. Also in the oil pump according to the comparative example, the discharge pressure characteristics (characteristics H1 and H2) satisfy this point. However, the required discharge pressure characteristics are only required to pass through the upper vicinity of the operation points S1 to S4, and at least the discharge pressure P required in the characteristic G4 in the oil pump 300 is satisfied when attention is particularly paid to the operation point S3 (about 4000 rotations per minute), which is a medium-speed rotation region of the engine 90.

On the other hand, the oil pump according to the comparative example has only the two inclinations of the characteristics H1 and H2, and hence the pressure required at the operation point S3 (about 4000 rotations per minute) is satisfied, but the oil 1 is supplied at the discharge pressure P (characteristic H2) far exceeding this pressure. The oil pump 300 has the characteristics G2 to H4, and hence unlike the oil pump according to the comparative example, no excessive discharge pressure P is generated in the oil pump 300 while the pressure of the oil 1 required at the operation point S3 is satisfied. When the spool member 360 (see FIG. 15) is linearly moved along arrow Z1, which is one direction, the housing 45 is reversibly moved in two directions along arrow Y1 and arrow Y2 with respect to the pump body 80 while following the concave-convex shape of the cam-shaped part 362 (see FIG. 15), whereby change from the characteristic G2 to the characteristic H4 is achieved. That the oil pump 300 according to the third embodiment has sections of the characteristics G2 to G4 having peaks and valleys to be bent between the characteristic G1 and the characteristic G5, unlike change from the characteristic H1 (a characteristic obtained by extending the characteristic G1 to the medium-speed rotation region) to the characteristic H2 (a characteristic obtained by extending the characteristic G5 to the medium-speed rotation region) in the oil pump according to the comparative example means that the pump element 35 (see FIG. 15) generates no wasted (excessive) oil even at the same rotational speed. The oil 1 having a wasted oil pressure (oil amount) pushes up a relief valve (not shown) etc. and is returned to the oil pan 91 through a relief path. In the oil pump 300, no wasted (excessive) oil pressure (oil amount) is generated, and hence power for driving the pump element 35 is reduced. A reduction in pump power also contributes to a reduction in the load (loss) of the engine 90 and leads to an improved fuel consumption rate.

When the rotational speed of the engine 90 (see FIG. 15) is changed from a high state to a low state, the discharge pressure characteristics are changed in a direction opposite to the above. In other words, the discharge pressure P is changed in the order of the characteristics G5, G4, G3, G2, and G1.

According to the third embodiment, between the characteristics of the eccentricity of the outer rotor 20 with respect to the inner rotor 10 resulting from the movement of the housing 45 in the Y-axis direction (along arrow Y1 or arrow Y2) in response to the change in the amount D of protrusion of the cam-shaped part 362 generated when the spool member 360 is linearly moved along arrow Z1 and the characteristics of the eccentricity of the outer rotor 20 with respect to the inner rotor 10 resulting from the movement of the housing 45 in a direction X (along arrow Y1 or arrow Y2) in response to the change in the amount D of protrusion of the cam-shaped part 362 generated when the spool member 360 is linearly moved along arrow Z2, there is a hysteresis error.

Figure 23:
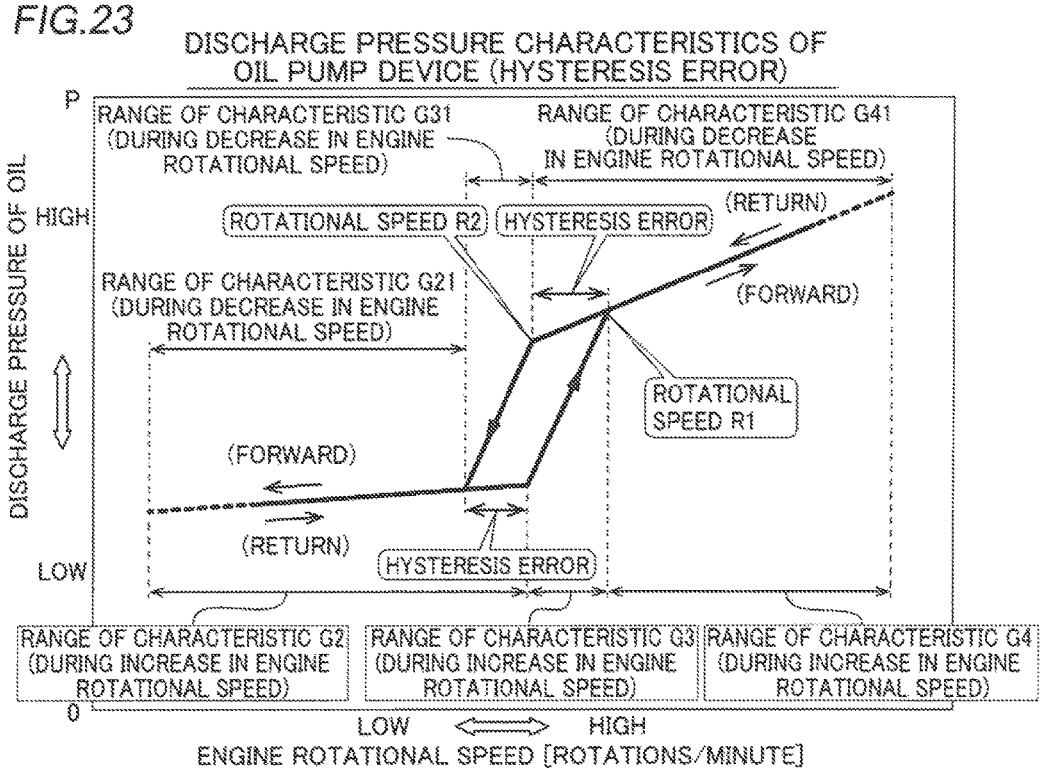
FIG. 23 A diagram for illustrating that the characteristics of the oil pump according to the third embodiment of the present invention have a hysteresis error.

Specifically, when the rotational speed of the engine 90 (see FIG. 15) is increased, as shown in FIGS. 18 to 20, the spool member 360 is linearly moved along arrow Z1 in response to the discharge pressure P of the oil 1, and the tip end of the convex part 48 of the housing 45 is slid with respect to the cam regions 72, 73, and 74 in this order. Thus, the discharge pressure characteristics follow a path of the characteristic G2, the characteristic G3, and the characteristic G4, extending from the left side of the plane of the figure to the right side thereof, as shown in FIG. 23. When the rotational speed of the engine 90 is decreased, on the other hand, the spool member 360 is linearly moved along arrow Z2 by the urging force of the spring 306, and the tip end of the convex part 48 of the housing 45 is slid with respect to the cam regions 74, 73, and 72 in this order. Thus, the discharge pressure characteristics follow a path of a characteristic G41, a characteristic G31, a characteristic G21, extending from the right side of the plane of the figure to the left side thereof, as shown in FIG. 23.

Between a range of the rotational speed of the engine corresponding to each of the characteristic G2, the characteristic G3, and the characteristic G4 during an increase in the rotational speed of the engine and a range of the rotational speed of the engine corresponding to each of the characteristic G21, the characteristic G31, and the characteristic G41 during a decrease in the rotational speed of the engine, there is a prescribed hysteresis error. In this case, during an increase in the rotational speed of the engine, the discharge pressure characteristics do not switch from the characteristic G2 to the characteristic G3 and from the characteristic G3 to the characteristic G4 unless the rotational speed of the engine reaches a relatively high rotational speed. On the other hand, during a decrease in the rotational speed of the engine, the discharge pressure characteristics do not switch from the characteristic G41 to the characteristic G31 and from the characteristic G31 to the characteristic G21 unless the rotational speed of the engine reaches a rotational speed lower than that during an increase in the rotational speed of the engine. Therefore, in the oil pump 300, it is necessary to generate a prescribed rotational speed R1 during an increase in the rotational speed of the engine 90 when a prescribed discharge pressure P (vertical axis) is applied to the discharged oil 1. On the other hand, the oil pump 300 is configured to maintain the discharge pressure P to a rotational speed R2 lower than the rotational speed R2 (R2<R1) at which the discharge pressure P is obtained during an increase and decrease the discharge pressure P after the rotational speed of the engine reaches a rotational speed lower than the rotational speed R2, during a decrease in the rotational speed of the engine 90.

The reason for this is as follows. Taking the cam region 72 of the spool member 360 as an example, when the spool member 360 is linearly moved along arrow Z1 and the tip end of the convex part 48 is slid along the inclined surface shape of the cam region 72 from the Z1 side (a side on which the amount D of protrusion is smaller) to the Z2 side (a side on which the amount D of protrusion is larger) under a condition where the convex part 48 of the housing 45 is brought into contact with (engages with) the cam region 72 having a prescribed inclination angle in a direction from the Z1 side to the Z2 side, in which the amount D of protrusion is increased, along arrow Y2 by the urging force of the spring 305, as shown in FIG. 15, a total load F1+F2 (acting along arrow Z2) of the pushing force F1 of the spring 306 acting along arrow Z2 and a spring load (pushing force) F2 split along arrow Z2 on the basis of the inclination angle of the cam region 72 when the inclined surface of the cam region 72 is pushed along arrow Y2 through the tip end of the convex part 48 by the urging force of the spring 305 is applied to the spool member 360. Therefore, the oil pump 300 requires a pushing force larger than the total load F1+F2 acting along arrow Z2 to act on the pressure-receiving surface 364 along arrow Z1 in order to linearly move the spool member 360 along arrow Z1.

When the spool member 360 is linearly moved along arrow Z2 and the tip end of the convex part 48 is slid along the inclined surface shape of the cam region 72 from the Z2 side (the side on which the amount D of protrusion is larger) to the Z1 side (the side on which the amount D of protrusion is smaller), on the other hand, a load F1-F2 (acting along arrow Z2) obtained by subtracting a spring load (pushing force) F2 split along arrow Z1 on the basis of the inclination angle of the cam region 72 when the inclined surface of the cam region 72 is pushed along arrow Y2 through the tip end of the convex part 48 by the urging force of the spring 305 from the pushing force F1 of the spring 306 acting along arrow Z2 is applied to the spool member 360. Therefore, the oil pump 300 requires a pushing force smaller than the load F1-F2 acting along arrow Z2 to act on the pressure-receiving surface 364 along arrow Z1 in order to linearly move the spool member 360 along arrow Z2. Thus, there is a difference in a pushing force (the discharge pressure P of the oil 1) to be applied to the pressure-receiving surface 364 of the spool member 360 along arrow Z1 between when the tip end of the convex part 48 ascends the inclined surface of the cam region 72 (the spool member 360 is moved along arrow Z1) and when the tip end of the convex part 48 descends the inclined surface of the cam region 72 (the spool member 360 is moved along arrow Z2). This difference in the pushing force to be applied to the pressure-receiving surface 364 along arrow Z1 corresponds to the hysteresis error shown in FIG. 23. There is the hysteresis error, whereby no chattering phenomenon where the spool member 360 is frequently moved along arrow Z1 and arrow Z2 while the wiggle back-and-forth movement of the housing 45 along the Y-axis direction is frequently repeated, following a frequent up-and-down fluctuation in the discharge pressure P is generated even when the discharge pressure P of the oil 1 acting on the pressure-receiving surface 364 repeatedly fluctuates up and down at short time intervals. The oil pump 300 according to the third embodiment is configured as described above.

According to the third embodiment, the following effects can be obtained.

More specifically, according to the third embodiment, as hereinabove described, the oil pump 300 includes the spool member 360 linearly moved in the Z-axis direction orthogonal to the Y-axis direction in response to the discharge pressure P of the oil 1 from the discharge port 53, including the cam-shaped part 362 provided to increase and decrease the eccentricity of the outer rotor 20 with respect to the inner rotor 10 by moving the housing 45 in the Y-axis direction (along arrow Y1 or arrow Y2) following the linear movement along arrow Z1. Thus, a change can be easily made by increasing or decreasing the eccentricity of the outer rotor 20 with respect to the inner rotor 10 while moving the housing 45 in the Y-axis direction through the cam-shaped part 362 provided in the spool member 360 following the linear movement of the spool member 360 along arrow Z1 in response to the discharge pressure P of the oil 1. Therefore, in the oil pump 300, only the movement in one direction (along arrow Z1) enables an increase and decrease in the eccentricity of the outer rotor 20 with respect to the inner rotor 10, and hence it is not necessary to switch a position on which the oil pressure acts in response to the discharge pressure P (the rotational speed of the engine 90) of the oil 1. Consequently, it is not necessary to provide a hydraulic direction switching valve or the like, and hence the structure of the oil pump 300 can be further simplified.

According to the third embodiment, the housing 45 includes the convex part 48 arranged to face the cam-shaped part 362 of the spool member 360, and the amount D of protrusion of the cam-shaped part 362 of the spool member 360 with respect to the convex part 48 of the housing 45 changes along the Z-axis direction. Furthermore, the housing 45 is moved in the Y-axis direction (along arrow Y1 or arrow Y2) in response to the change in the amount D of protrusion of the cam-shaped part 362 associated with the movement of the spool member 360 along arrow Z1 so that the eccentricity of the outer rotor 20 with respect to the inner rotor 10 is increased or decreased. Thus, effectively utilizing a cam mechanism including the cam-shaped part 362 of the spool member 360 and the convex part 48 of the housing 45, the eccentricity of the outer rotor 20 with respect to the inner rotor 10 can be increased or decreased directly following the change in the amount D of protrusion of the cam-shaped part 362 associated with the movement of the spool member 360 along arrow Z1.

According to the third embodiment, the cam-shaped part 362 of the spool member 360 includes at least the cam region 71 arranged to face the convex part 48 of the housing 45 when the discharge pressure P of the oil 1 from the discharge port 53 is within the pressure range P1, the cam region 72 engaging with the convex part 48 of the housing 45 when the discharge pressure P is within the pressure range P2 larger than the pressure range P1, and the cam region 73 engaging with the convex part 48 of the housing 45 when the discharge pressure P is within the pressure range P3 larger than the pressure range P2. Furthermore, when the spool member 360 is moved along arrow Z1 so as to sequentially switch the cam-shaped part 362 of the spool member 360 to the cam region 71, the cam region 72, and the cam region 73 in response to an increase in the discharge pressure P of the oil 1 from the discharge port 53, the amount of movement of the housing 45 in the Y-axis direction with respect to the rotation center R of the inner rotor 10 and the eccentricity of the outer rotor 20 with respect to the inner rotor 10 are decreased in the case of the cam region 72, and the amount of movement of the housing 45 in the Y-axis direction and the eccentricity of the outer rotor 20 with respect to the inner rotor 10 are increased in the case of the cam region 73 from the state where the amount of movement of the housing 45 in the Y-axis direction with respect to the rotation center R of the inner rotor 10 and the eccentricity of the outer rotor 20 with respect to the inner rotor 10 are decreased in the case of the cam region 72. Thus, based on the cam region 71 corresponding to the case where the discharge pressure P of the oil 1 from the discharge port 53 is within the pressure range P1, the cam-shaped part 362 of the spool member 360 is sequentially switched from the cam region 71 to the cam region 72 and from the cam region 72 to the cam region 73 along arrow Z1 when the discharge pressure P of the oil 1 is increased from the pressure range P1 to the pressure range P2 and from the pressure range P2 to the pressure range P3, and the eccentricity of the outer rotor 20 with respect to the inner rotor 10 can be both increased and decreased by the switching from the cam region 71 to the cam region 72 and the switching from the cam region 72 to the cam region 73 following the movement of the spool member 360 along arrow Z1. Therefore, desired discharge pressure characteristics can be easily generated in the oil pump 300.

According to the third embodiment, the cam region 71 is formed such that the eccentricity of the outer rotor 20 with respect to the inner rotor 10 associated with the movement of the housing 45 in the Y-axis direction is the eccentricity A1, the cam region 72 is formed such that the eccentricity of the outer rotor 20 with respect to the inner rotor 10 associated with the movement of the housing 45 in the Y-axis direction is the eccentricity A2 smaller than the eccentricity A1, and the cam region 73 is formed such that the eccentricity of the outer rotor 20 with respect to the inner rotor 10 associated with the movement of the housing 45 in the Y-axis direction is the eccentricity A3 larger than the minimum value of the eccentricity A2. Thus, based on the pump capacity in the case where the discharge pressure P of the oil 1 is within the pressure range P1, the pump capacity in the case where the discharge pressure P of the oil 1 is within the pressure range P2 can be adjusted to be smaller than the pump capacity in the case where the discharge pressure P of the oil 1 is within the pressure range P1, and the pump capacity in the case where the discharge pressure P of the oil 1 is within the pressure range P3 can be adjusted to be larger than the pump capacity in the case where the discharge pressure P of the oil 1 is within the pressure range P2 and smaller than the pump capacity in the case where the discharge pressure P of the oil 1 is within the pressure range P1.

According to the third embodiment, the cam region 72 is provided such that the eccentricity of the outer rotor 20 with respect to the inner rotor 10 is decreased from the eccentricity A1 to the eccentricity A2 toward the cam region 73, and the cam region 73 is provided such that the eccentricity of the outer rotor 20 with respect to the inner rotor 10 is increased from the eccentricity A2 to the eccentricity A3 toward the cam region 74. Thus, when the spool member 360 is moved along arrow Z1, the eccentricity of the outer rotor 20 with respect to the inner rotor 10 associated with the movement of the housing 45 in the Y-axis direction can be easily decreased in the case of the cam region 72. Furthermore, when the spool member 360 is moved along arrow Z1, the eccentricity of the outer rotor 20 with respect to the inner rotor 10 associated with the movement of the housing 45 in the Y-axis direction can be easily increased in the case of the cam region 73.

According to the third embodiment, the cam region 71, the cam region 72, and the cam region 73 are continuously provided, and the convex part 48 of the housing 45 is configured to be moved in the Y-axis direction (along arrow Y1 or arrow Y2) by sliding along at least the cam region 72 and the cam region 73 following the movement of the spool member 360. Thus, the housing 45 can be moved in the Y-axis direction while engaging with the cam-shaped part 362 (the cam region 72 and the cam region 73) so as to follow the cam shape (inclined shape) of the cam-shaped part 362 when the spool member 360 is moved along arrow Z1, and hence based on the cam region 71 corresponding to the case where the discharge pressure P of the oil 1 from the discharge port 53 is within the pressure range P1, the eccentricity of the outer rotor 20 with respect to the inner rotor 10 can be smoothly decreased in the case of the cam region 72, and the eccentricity of the outer rotor 20 with respect to the inner rotor 10 can be smoothly increased from the decreased state in the case of the cam region 73.

According to the third embodiment, the cam region 71 of the spool member 360 is linearly moved to the position corresponding to the convex part 48 of the housing 45 in the pressure range P1 so that the housing 45 is linearly moved to the first eccentricity position in the Y-axis direction and the eccentricity of the outer rotor 20 with respect to the inner rotor 10 is changed to the eccentricity A1, which is the maximum eccentricity. Furthermore, the cam region 72 of the spool member 360 is linearly moved to the position engaging with the convex part 48 of the housing 45 in the pressure range P2 so that the housing 45 is linearly moved to the second eccentricity position in the Y-axis direction and the eccentricity of the outer rotor 20 with respect to the inner rotor 10 is changed to the eccentricity A2 smaller than the eccentricity A1. Moreover, the cam region 73 of the spool member 360 is linearly moved to the position engaging with the convex part 48 of the housing 45 in the pressure range P3 so that the housing 45 is linearly moved to the third eccentricity position in the Y-axis direction and the eccentricity of the outer rotor 20 with respect to the inner rotor 10 is changed to the eccentricity A3 larger than the minimum value of the eccentricity A2. Thus, the housing 45 can be moved to any of the first eccentricity position, the second eccentricity position, and the third eccentricity position corresponding to the pressure range P1, the pressure range P2, and the pressure range P3, respectively, and the eccentricity of the outer rotor 20 with respect to the inner rotor 10 can be properly adjusted to the eccentricity A1, the eccentricity A2, and the eccentricity A3. Therefore, the oil pump 300 capable of accurately exhibiting the required discharge pressure characteristics can be obtained.

According to the third embodiment, the oil pump 300 includes the spring 305 configured to urge the housing 45 toward the spool member 360 along arrow Y2. Thus, when the housing 45 is moved in the Y-axis direction following the linear movement of the spool member 360 along arrow Z1, the housing 45 can be moved in the Y-axis direction while properly following the cam shape (concave-convex shape) of the cam-shaped part 362 of the spool member 360 by the urging force of the spring 305 on the housing 45 toward the spool member 360 along arrow Y2.

According to the third embodiment, the oil pump 300 includes the spring 306 configured to urge the spool member 360 toward the discharge oil passage 54 (a position on the side of the discharge port 53) along arrow Z2. Thus, when the discharge pressure P of the oil 1 from the discharge port 53 is decreased, the spool member 360 can be easily pushed back along arrow Z2 by the urging force of the spring 306, and hence the spool member 360 can perform a reversible operation in response to the discharge pressure P of the oil 1.

According to the third embodiment, there is the hysteresis error between the characteristics (a shift to the characteristics G2, G3, and G4 in FIG. 23) of the eccentricity of the outer rotor 20 with respect to the inner rotor 10 resulting from the movement of the housing 45 in the Y-axis direction (along arrow Y1 or arrow Y2) in response to the change in the amount D of protrusion of the cam-shaped part 362 generated when the spool member 360 is linearly moved along arrow Z1 and the characteristics (a shift to the characteristics G41, G31, and G21 in FIG. 23) of the eccentricity of the outer rotor 20 with respect to the inner rotor 10 resulting from the movement of the housing 45 in the direction X in response to the change in the amount D of protrusion of the cam-shaped part 362 generated when the spool member 360 is linearly moved along arrow Z2. Thus, even when the discharge pressure P of the oil 1 from the discharge port 53 repeatedly fluctuates up and down at the short time intervals, the characteristics of the eccentricity of the rotation center U of the outer rotor 20 with respect to the inner rotor 10 have the hysteresis error in response to the movement direction of the spool member 360, and hence generation of the phenomenon (chattering phenomenon) where the linear movement of the spool member 360 along arrow Z1 and arrow Z2 following the frequent up-and-down fluctuation of the discharge pressure P and the wiggle back-and-forth movement of the housing 45 in the Y-axis direction based on this are frequently repeated can be avoided in the oil pump 300. Therefore, even when the discharge pressure P of the oil 1 from the discharge port 53 repeatedly fluctuates up and down at the short time intervals, the eccentricity of the outer rotor 20 with respect to the inner rotor 10 does not vary in a fluctuating manner, and hence the oil 1 can be stably discharged.

According to the third embodiment, the opening 86 that is open to the oil passage part 57 is provided in the pump-housing unit 81 of the pump body 80. Furthermore, the oil pump 300 is configured such that at least part of the oil 1 suctioned into the suction port 52 through the opening 86 is drawn into the cam-shaped part 362 (cam regions 71 to 75) of the spool member 360. Thus, when the housing 45 is moved in the Y-axis direction through the cam-shaped part 362 provided in the spool member 360, the oil 1, the pressure of which is decreased to below the discharge pressure P, is easily drawn into the cam-shaped part 362 so that the convex part 48 (the tip end of the convex part 48 coming into contact with the cam-shaped part 362) of the housing 45 can be smoothly moved, and hence cam operation for moving the housing 45 in the Y-axis direction can be smoothly performed by the spool member 360. Thus, the smooth discharge pressure characteristics accurately following the discharge pressure P of the oil 1 from the discharge port 53 can be obtained.

Fourth Embodiment

A fourth embodiment is now described with reference to FIGS. 15, 24, and 25. In this fourth embodiment, an example of configuring an oil pump 400 including a spool member 460 including a cam-shaped part 462 different from the spool member 360 (see FIG. 15) used in the aforementioned third embodiment is described. In the figures, the same reference numerals as those in the aforementioned third embodiment are assigned to and show structures similar to those of the third embodiment.

Figure 24:
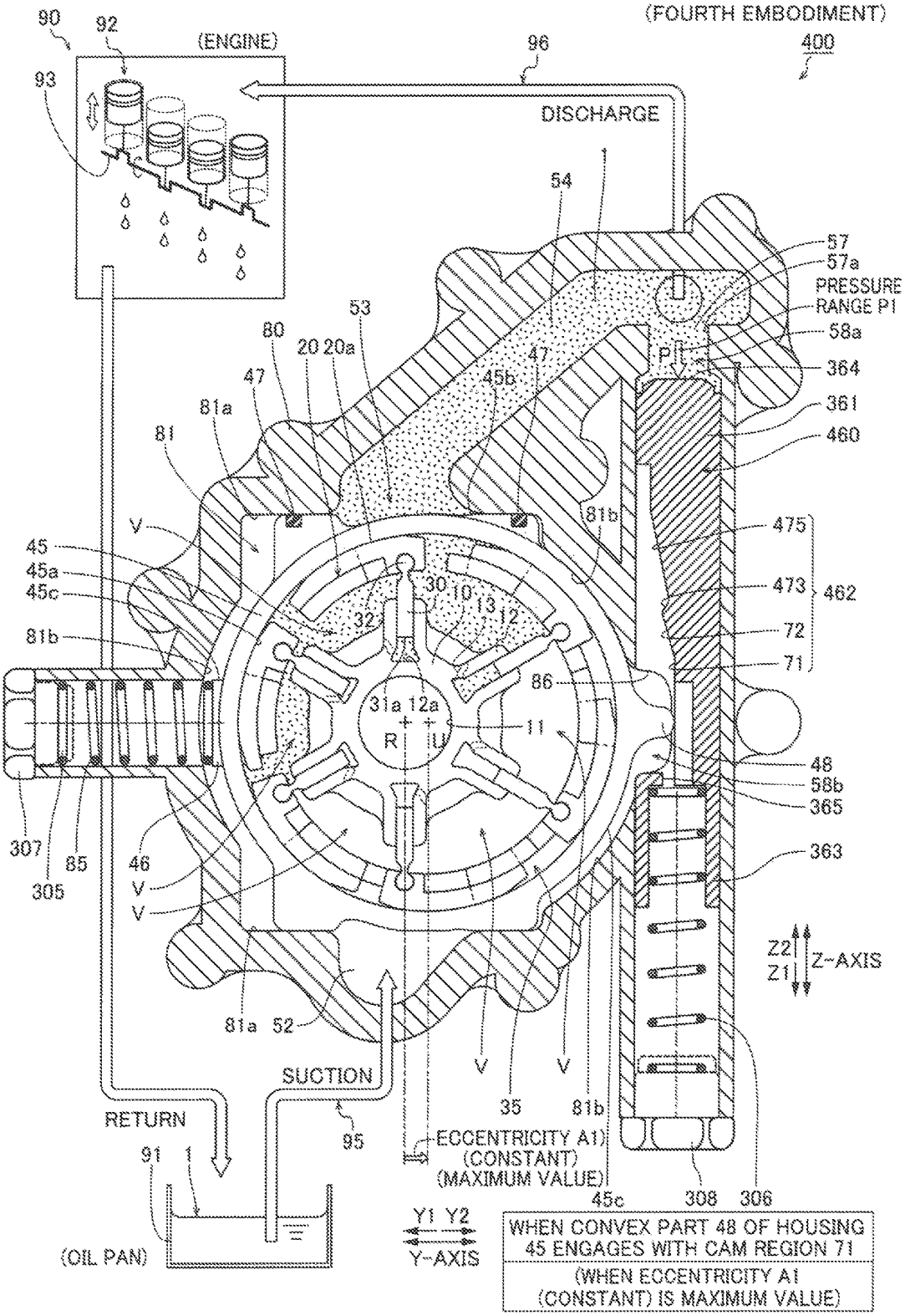
FIG. 24 A sectional view showing the overall structure of an oil pump according to a fourth embodiment of the present invention.

The oil pump 400 according to the fourth embodiment of the present invention includes the spool member 460, as shown in FIG. 24. The spool member 460 is an example of the "cam member" in the present invention.

According to the fourth embodiment, the cam-shaped part 462 of the spool member 460 is formed by connecting a cam region 71, a cam region 72, a cam region 473, and a cam region 475 in this order along a Z-axis direction from a first end (Z1 side) toward a second end (Z2 side). In other words, the cam region 473 is connected to the cam region 475 without providing a cam region 74 (see FIG. 15) parallel to the Z-axis direction, unlike the spool member 360 (see FIG. 15). Therefore, the cam region 473 is slightly longer than the cam region 73 (see FIG. 15) according to the third embodiment, and the cam region 475 extends to the cam region 473 while keeping the same inclination because of no cam region 74 (see FIG. 15). The cam-shaped part 462 is an example of the "cam region" in the present invention, and the cam region 473 is an example of the "third cam region" in the present invention.

Figure 25:
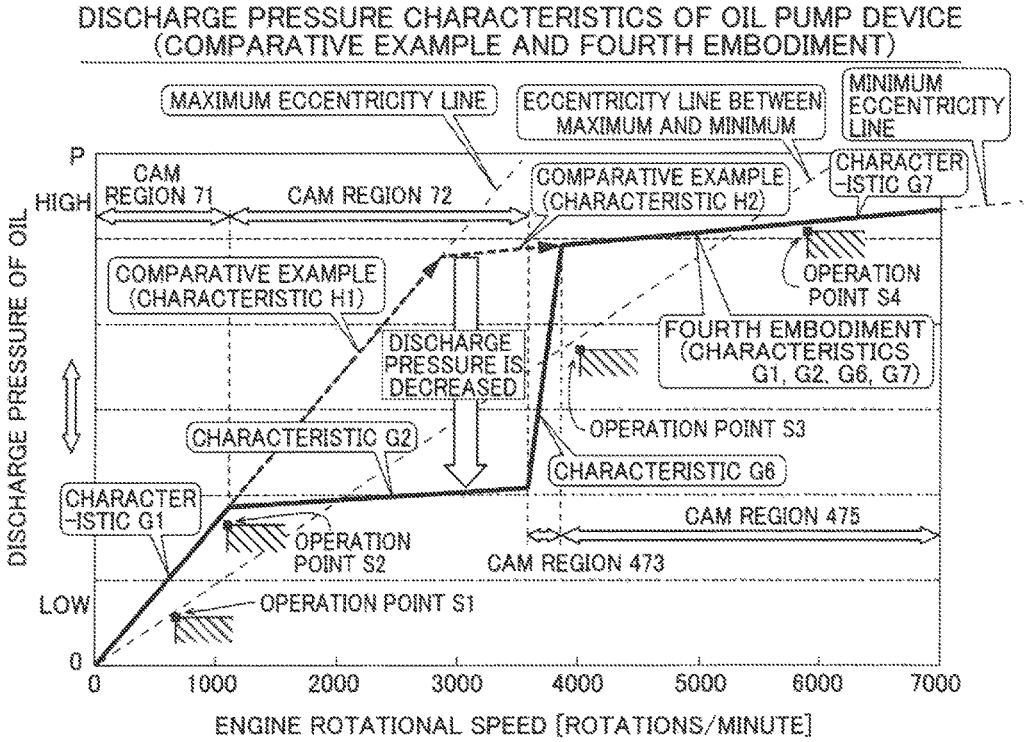
FIG. 25 A diagram showing the characteristics (engine rotational speed-discharge pressure characteristics) of the oil pump according to the fourth embodiment of the present invention and the characteristics (engine rotational speed-discharge pressure characteristics) of the oil pump as the comparative example to the third embodiment.

Therefore, the oil pump 400 has characteristics (the discharge pressure characteristics of oil 1 with respect to the rotational speed of an inner rotor 10) shown in FIG. 25.

In FIG. 25, a characteristic G1 and a characteristic G2 in the cam region 71 and the cam region 72 associated with the movement of the spool member 460 along arrow Z1 are the same as in the case of the oil pump 300. When the rotational speed of an engine 90 (see FIG. 24) exceeds about 3600 rotations per minute and the discharge pressure P exceeds the maximum value of a pressure range P2, a position of the spool member 460 moved along arrow Z1, engaging with a convex part 48 is switched from the cam region 72 to the cam region 473. In the case of the cam region 473, the eccentricity of an outer rotor 20 with respect to the inner rotor 10 is increased along with a decrease in the amount D of protrusion along arrow Y1, and the discharge pressure characteristics are shaped like a characteristic G6. When the rotational speed of the engine 90 exceeds about 3900 rotations per minute and the discharge pressure P exceeds the maximum value of a pressure range P3, a position of the spool member 460 moved along arrow Z1, engaging with the convex part 48 is switched from the cam region 473 to the cam region 475. In the case of the cam region 475, the eccentricity of the outer rotor 20 with respect to the inner rotor 10 is decreased again along with an increase in the amount D of protrusion along arrow Y1, and the discharge pressure characteristics are shaped like a characteristic G7. Thus, the oil pump 400 has the discharge pressure characteristics obtained by connecting the characteristics G1, G2, G6, and G7, as shown by a bold solid line.

That the oil pump 400 according to the fourth embodiment also has sections of the characteristic G2 and the characteristic G6 between the characteristic G1 and the characteristic G7, as compared with discharge pressure characteristics (characteristics H1 and H2) in an oil pump according to a comparative example means that a pump element 35 (see FIG. 24) generates no wasted (excessive) oil even at the same rotational speed but the oil pump 400 has characteristics satisfying the pressure of the oil 1 required at a prescribed operation point S3. Therefore, also in the oil pump 400, no wasted (excessive) oil pressure is generated, and hence pump power is reduced. A reduction in pump power also contributes to a reduction in the load (loss) of the engine 90 and leads to an improved fuel consumption rate. When the rotational speed of the engine 90 (see FIG. 24) is changed from a high state to a low state, the discharge pressure characteristics are changed in a direction opposite to the above. In other words, the discharge pressure P is changed in the order of the characteristics G7, G6, G2, and G1. The remaining structure of the oil pump 400 according to the fourth embodiment is similar to that of the oil pump 300 according to the aforementioned third embodiment.

According to the fourth embodiment, the following effects can be obtained.

According to the fourth embodiment, as hereinabove described, the oil pump 400 includes the spool member 460 linearly moved in the Z-axis direction orthogonal to a Y-axis direction in response to the discharge pressure P of the oil 1 from the discharge port 53, including the cam-shaped part 462 provided to increase and decrease the eccentricity of the outer rotor 20 with respect to the inner rotor 10 by moving the housing 45 in the Y-axis direction (along arrow Y1 or arrow Y2) following the linear movement along arrow Z1. Thus, a change can be easily made by increasing or decreasing the eccentricity of the outer rotor 20 with respect to the inner rotor 10 while moving the housing 45 in the Y-axis direction through the cam-shaped part 462 provided in the spool member 460 following the linear movement of the spool member 460 along arrow Z1 in response to the discharge pressure P of the oil 1. Therefore, unlike the case where the oil pump is provided with a multisystem hydraulic circuit, a hydraulic direction switching valve, etc. and is configured to switch the way of applying oil pressure to the housing 45 (a position of the housing 45 on which oil pressure acts) in response to the discharge pressure P of the oil 1 (the rotational speed of the engine 90), for example, in the case where the spool member 460 configured to be linearly moved in the Z-axis direction in response to the discharge pressure P of the oil 1 and to increase and decrease the eccentricity of the outer rotor 20 with respect to the inner rotor 10 by moving the housing 45 in the Y-axis direction following the linear movement along arrow Z1 is provided, the desired discharge pressure characteristics can be generated in the oil pump 400, similarly to the case where a hydraulic direction switching valve or the like is provided. Thus, the structure of the oil pump 400 can be further simplified. The remaining effects of the fourth embodiment are similar to those of the aforementioned third embodiment.

The embodiments disclosed this time must be considered as illustrative in all points and not restrictive. The range of the present invention is shown not by the above description of the embodiments but by the scope of claims for patent, and all modifications within the meaning and range equivalent to the scope of claims for patent are further included.

For example, while the example of configuring the oil pump 100 (200, 300, 400) such that the six vanes 30 are arranged between the inner rotor 10 and the outer rotor 20 (220) at the equal angular intervals (60-degree intervals) has been shown in each of the aforementioned first to fourth embodiments, the present invention is not restricted to this. For example, four (90-degree intervals), five (72-degree intervals), eight (45-degree intervals), nine (40-degree intervals) vanes 30, or the like other than the six vanes 30 may be provided. In this case, the number of outer rotor pieces constituting the outer rotor is changed in response to the number of vanes 30.

Figure 26:
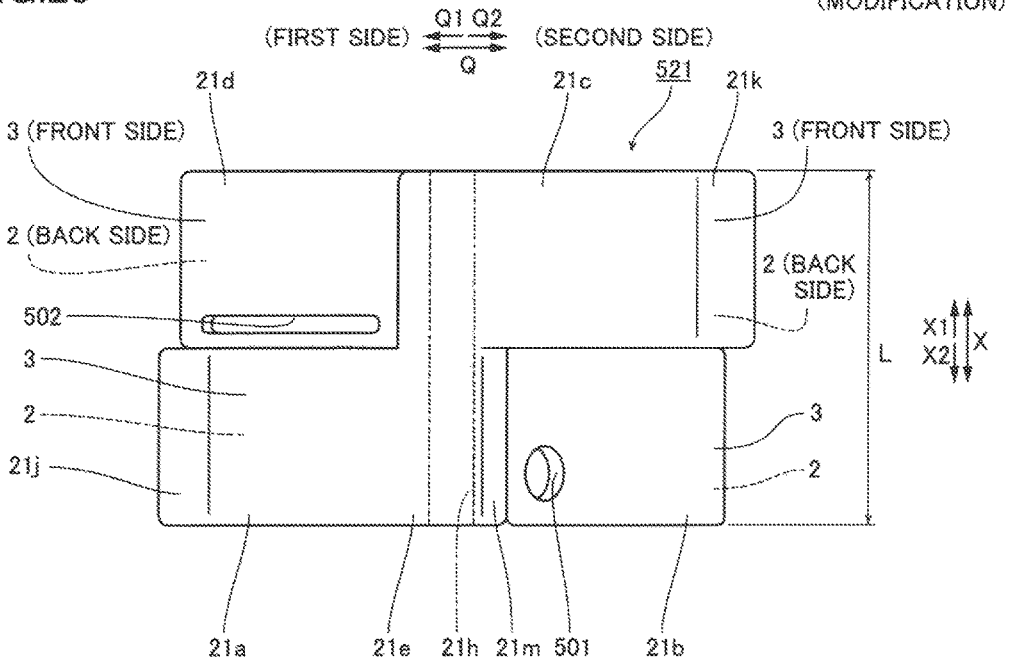
FIG. 26 A top plan view showing the structure of an outer rotor piece (single item) constituting a pump element in an oil pump according to a modification of the present invention.

While the example of providing the notch parts 21*f* and 21*g* in each of the outer rotor pieces 21 and allowing the volume parts 62 and 61 to communicate with each other has been shown in each of the aforementioned first, third, and fourth embodiments and the example of providing the notch parts 221*f* and 221*g* in each of the outer rotor pieces 221 and allowing the volume parts 262 and 261 to communicate with each other has been shown in the aforementioned second embodiment, the present invention is not restricted to this. A communicating hole may be provided in each of the outer rotor pieces, for example. As an example, outer rotor pieces 521 may be configured as in a modification shown in FIG. 26. More specifically, a communicating hole 501 passing through a second engaging piece 21*b* in a thickness direction may be provided in a connection part between a base 21*e* and the second engaging piece 21*b*, and a communicating hole 502 passing through a fourth engaging piece 21*d* in the thickness direction may be provided in an end in which a first engaging piece 21*a* and the fourth engaging piece 21*d* face each other in an axial direction (direction X). The communicating holes 501 and 502 are examples of the "hole" in the present invention.

While the example of using the crankshaft 93 of the internal combustion (engine 90) as the drive source for the inner rotor 10 has been shown in each of the aforementioned first to fourth embodiments, the present invention is not restricted to this. For example, an electric motor may be used as the drive source for the oil pump (inner rotor). In this case, the rate of discharge of the oil pump 100 (200, 300, 400) may be variable in response to the eccentricity of the outer rotor 20 with respect to the inner rotor 10 with the rotational speed of the electric motor kept constant, or in addition to the mechanical pumping of the outer rotor 20 associated with this eccentricity, the rate of discharge of the oil pump 100 (200, 300, 400) may be more finely adjusted to the required rate of discharge by further changing the rotational speed of the electric motor.

While the example of configuring the oil pump 100 (200, 300, 400) to be capable of varying the rate of discharge in response to the eccentricity by moving the housing 40 (45) parallel to the inner rotor 10, the rotation center R of which is fixed inside the pump body 50 (80), has been shown in each of the aforementioned first to fourth embodiments, the present invention is not restricted to this. The oil pump may be configured to generate the eccentricity of the outer rotor 20 with respect to the inner rotor 10 by providing a rotational fulcrum on one side of the housing 40 (45) and rotating another side of the housing 40 (45) by a prescribed angle about this rotational fulcrum, for example.

While the example of shifting the center of the housing 40 with respect to the inner rotor 10, the rotation center R of which is fixed, has been shown in each of the aforementioned first and second embodiments, the present invention is not restricted to this. More specifically, the oil pump 100 (200) may be configured such that the rotation center R of the inner rotor 10 is movable so that the inner rotor 10 is eccentric with respect to the fixed housing 40 and the rate of discharge is variable in response to the eccentricity.

While the example of shifting the center of the housing 45 in the Y-axis direction (along arrow Y1 or arrow Y2) with respect to the inner rotor 10, the rotation center R of which is fixed, has been shown in each of the aforementioned third and fourth embodiments, the present invention is not restricted to this. More specifically, the oil pump 300 (400) may be configured such that the rotation center R of the inner rotor 10 is movable in the Y-axis direction so that the rotation center R of the inner rotor 10 is eccentric with respect to the rotation center U of the fixed housing 45 and the discharge pressure is changed in response to the forward or reverse eccentricity of the inner rotor 10 associated with the movement of the spool member 360 along arrow Z1.

While the example of moving the housing 45 forward and reversely in the Y-axis direction in a state where the tip end of the convex part 48 of the housing 45 is brought into contact with the cam-shaped part 362 (462) of the spool member 360 (460) formed by continuously connecting the multiple cam regions with inclined angles different from each other has been shown in each of the aforementioned third and fourth embodiments, the present invention is not restricted to this. For example, a cam groove having the amount D of protrusion similar to that of the cam-shaped part 362 may be formed in the spool member, an engaging pin fitted into and engaging with this cam groove may be provided in a part of the housing 45 (rotor-housing unit) corresponding to the convex part 48, and the eccentricity of the outer rotor 20 with respect to the inner rotor 10 may be increased and decreased while the rotor-housing unit is moved in the Y-axis direction (along arrow Y1 or arrow Y2) utilizing engagement between the engaging pin of the rotor-housing unit and the cam groove of the spool member when the spool member 360 is linearly moved along arrow Z1.

While the example of configuring the oil pump 300 (400) such that the housing 45 (convex part 48) is pushed along arrow Y1 by the cam-shaped part 362 (462) along with the linear movement of the spool member 360 (460) along arrow Z1 in a state where the convex part 48 of the housing 45 is brought into contact with (engages with) the cam-shaped part 362 (462) of the spool member 360 (460) along arrow Y2 by the urging force of the spring 305 has been shown in each of the aforementioned third and fourth embodiments, the present invention is not restricted to this. The oil pump may be configured such that the rotor-housing unit is moved along arrow Y1 along with the linear movement of the spool member along arrow Z1 by devising how the spool member engages with the rotor-housing unit (engagement mechanism), for example.

While the example of providing the cam-shaped part 362 including the cam regions 71 to 75 in the spool member 360 has been shown in the aforementioned third embodiment and the example of providing the cam-shaped part 462 including the cam regions 71, 72, 473, and 475 in the spool member 460 has been shown in the aforementioned fourth embodiment, the present invention is not restricted to this. The cam shape (concave-convex shape) of the cam regions may be other than the above. The cam shape of the cam regions can be properly changed in response to an operation point required by a device (motor vehicle or the like) to which oil pressure is supplied.

While the example of providing the spool member 360 (460) movable back and forth in the Z-axis direction orthogonal to the Y-axis direction with respect to the housing 45 movable back and forth in the Y-axis direction in the pump body 80 has been shown in each of the aforementioned third and fourth embodiments, the present invention is not restricted to this. The linear movement direction of the spool member 360 in response to the discharge pressure P of the oil 1 is only required to intersect with the movement direction of the housing 45. For example, the pump body 80 and the internal oil passage (oil pressure path) may be configured such that the spool member 360 is linearly moved along the X-axis direction on which the rotation axis of the inner rotor 10 extends.

While the example of configuring the oil pump 100 (200) to rotate the outer rotor 20 (220) in the same direction by rotating the inner rotor 10 along arrow Q2 has been shown in each of the aforementioned first and second embodiments, the present invention is not restricted to this. Similarly to the aforementioned third and fourth embodiments, for example, the oil pump 100 (200) may be configured to rotate the inner rotor 10 along arrow Q1 opposite to arrow Q2. More specifically, the vanes 30 are configured to repetitively linearly appear from and disappear into the inner rotor 10 along the radial direction, and hence the rotation direction of the inner rotor 10 is not limited. However, it is necessary to arrange the suction port 52 and the discharge port 53 reversely to the above when the inner rotor 10 is rotated along arrow Q1.

While the example of forming each of the outer rotor pieces 221 to have the uniform cross-sectional shape from the end on the X2 side to the end on the X1 side, except for the notch parts 221*f* and 221*g* has been shown in the aforementioned second embodiment, the present invention is not restricted to this. For example, the first engaging piece 221*a* and the second engaging piece 221*b* of each of the outer rotor pieces 221 may be integrally connected to each other in the radial direction in both ends along the direction X. Each of the outer rotor pieces may be configured such that the engagement space 203 is formed in a recess part circumferentially surrounded by the first engaging piece 221*a*, the second engaging piece 221*b*, and side ends connecting the first engaging piece 221*a* and the second engaging piece 221*b* in both ends in the direction X. Therefore, the third engaging piece 221*c* engages with the first engaging piece 221*a* and the second engaging piece 221*b* so as to freely appear from and disappear into the engagement space 203 circumferentially closed. In this case, a communicating hole passing through the second engaging piece 221*b* in the thickness direction may be provided instead of the notch part 221*f* to allow the engagement space 203 and the volume chamber 261 to communicate with each other. According to the structure of this modification, the first engaging piece 221*a* and the second engaging piece 221*b* each having a small thickness (which are thin) are integrally connected to each other in both ends in the direction X, and hence the stiffness of the outer rotor pieces each having the third engaging piece 221*c* that repetitively appears from and disappears into the engagement space 203 can be improved.

While the example of configuring the oil pump 100 (200, 300, 400) to be capable of varying the rate of discharge in response to the eccentricity by moving the housing 40 parallel to the inner rotor 10, the rotation center R of which is fixed inside the pump body 50, has been shown in each of the aforementioned first to fourth embodiments, the present invention is not restricted to this. For example, the oil pump may be configured to keep the rate of discharge constant in response to the constant eccentricity without the parallel movement of the housing 40.

While the example in which the outer rotor pieces 21 (221) constitute the outer rotor 20 (220) made of the aluminum alloy has been shown in each of the aforementioned first to fourth embodiments, the present invention is not restricted to this. The outer rotor (outer rotor pieces) may be made of a resin material, for example.

While the example of applying the present invention to the oil pump 100 (200, 300, 400) supplying the oil (lubricating oil) 1 to the internal combustion (engine) has been shown in each of the aforementioned first to fourth embodiments, the present invention is not restricted to this. The prevent invention may be applied to an oil pump for supplying automatic transmission (AT) fluid (AT oil) to an AT that automatically switches a transmission gear ratio in response to the rotational speed of the internal combustion, for example. Alternatively, the present invention may be applied to an oil pump for supplying lubricating oil to a slide part in a continuously variable transmission (CVT) capable of continuously varying a transmission gear ratio unlike the aforementioned AT (multistage transmission) changing gears by switching a combination of gears. Alternatively, the present invention may be applied to an oil pump for supplying power steering oil to a power steering that drives a steering of a vehicle.

While the example of mounting the oil pump 100 (200, 300, 400) on a vehicle such as the motor vehicle including the internal combustion (engine) has been shown in each of the aforementioned first to fourth embodiments, the present invention is not restricted to this. The present invention may be applied to an oil pump mounted on an equipment instrument other than the vehicle including the internal combustion (engine), for example. Alternatively, as the internal combustion, a gasoline engine, a diesel engine, a gas engine, etc. are applicable.

DESCRIPTION OF REFERENCE NUMERALS

1 oil
5, 8 engagement space (first engagement space)
6, 7 engagement space (second engagement space)
10 inner rotor
12 vane-housing unit

12*a* recess part (vane-housing unit)
20, 220 outer rotor
21, 221 outer rotor piece
21*a*, 221*a* first engaging piece
21*b*, 221*b* second engaging piece
21*c*, 221*c* third engaging piece
21*d* fourth engaging piece
21*e*, 221*e* base (vane-connecting part)
21*f*, 221*f* notch part (groove part)
21*g*, 221*g* notch part (groove part)
21*h*, 221*h* engaging part (vane-connecting part)
30 vane
31 base (part housed in the vane-housing unit)
32 tip end
35, 235 pump element
40, 45 housing (rotor-housing unit)
46 seat part
47 convex part (cam engaging part)
50, 80 pump body
52 suction port
53 discharge port
54 discharge oil passage
57 oil passage part
58*a* pressure-receiving region
58*b* adjustment region
61, 261 volume chamber (first volume-changing part)
62, 262 volume chamber (second volume-changing part)
63, 263 volume chamber (third volume-changing part)
71 cam region (first cam region)
72 cam region (second cam region)
73, 473 cam region (third cam region)
74 cam region
75, 475 cam region
81 pump-housing unit
85 spring-storing unit
86 opening
90 engine
100, 200, 300, 400 oil pump
201, 202 engagement space (first engagement space)
203 engagement space (second engagement space)
305 spring (first urging member)
306 spring (second urging member)
360, 460 spool member (cam member)
361 main body part
362, 462 cam-shaped part (cam region)
363 seat part
364 pressure-receiving surface
365 communicating hole
501, 502 communicating hole (hole)

The invention claimed is:

1. An oil pump comprising:

a rotatable inner rotor that includes a vane-housing unit housing multiple vanes so as to be capable of sliding in a radial direction;

a rotatable annular outer rotor that includes multiple vane-connecting parts connecting tip ends of the multiple vanes on an outside in the radial direction;

first volume-changing parts, which are provided between the inner rotor and the outer rotor, and a first volume of which is changed in response to eccentricity of the inner rotor with respect to the outer rotor, thereby providing a pumping function; and second volume-changing parts, which are provided in the outer rotor, and a second volume of which is changed by a change in a distance between adjacent vane-connecting parts in a circumferential direction in response to the eccentricity of the inner rotor with respect to the outer rotor, thereby providing a pumping function the second volume-changing parts being configured to be capable of changing the second volume by the change in the distance between the multiple vane-connecting parts of the outer rotor in the circumferential direction by changes in radial slide positions of the tip ends of the vanes on the outside in the radial direction in response to the eccentricity of the inner rotor with respect to the outer rotor, the outer rotor including multiple outer rotor pieces, each of which is provided for each of the multiple vanes and includes a vane-connecting part, the multiple outer rotor pieces are circumferentially arranged in a state where adjacent outer rotor pieces engage with each other so as to be capable of changing a distance therebetween in the circumferential direction, and the adjacent outer rotor pieces engage with each other in the circumferential direction while having engagement spaces constituting the second volume changing-parts, and the second volume of the engagement spaces is changed by a change in the distance between the adjacent outer rotor pieces in the circumferential direction.

2. The oil pump according to claim 1, further comprising third volume-changing parts, a third volume of which in the vane-housing unit of the inner rotor is changed by slide of the multiple vanes in the radial direction in response to the eccentricity of the inner rotor with respect to the outer rotor, thereby providing a pumping function.

3. The oil pump according to claim 2, further comprising a suction port that suctions oil and a discharge port that discharges the oil, wherein in the suction port, the third volume in the vane-housing unit of the inner rotor is gradually increased by gradual slide of the vanes, housed in the vane-housing unit, to the outside in the radial direction, and in the discharge port, the third volume in the vane-housing unit of the inner rotor is gradually decreased by the gradual slide of the vanes, housed in the vane-housing unit, to an inside in the radial direction.

4. The oil pump according to claim 2, wherein a thickness of each of parts of the vanes housed in the vane-housing unit is constant.

5. The oil pump according to claim 1, wherein grooves or holes that allow the engagement spaces constituting the second volume-changing parts and the first volume-changing parts to communicate with each other are provided.

6. The oil pump according to claim 1, wherein the engagement spaces constituting the second volume-changing parts each include a first engagement space located on a first side between two adjacent vanes and a second engagement space located on a second side between the two adjacent vanes.

7. The oil pump according to claim 1, further comprising a suction port that suctions oil and a discharge port that discharges the oil, wherein the outer rotor includes multiple outer rotor pieces, each of which is provided for each of the multiple vanes and includes the vane-connecting part, and in the suction port, the second volume is gradually increased by a gradual increase in the distance between the adjacent outer rotor pieces in the circumferential direction, and in the discharge port, the second volume is gradually decreased by a gradual decrease in the distance between the adjacent outer rotor pieces in the circumferential direction.

8. The oil pump according to claim 1, further comprising:

a rotor-housing unit that houses the inner rotor and is movable in a first direction so as to change the eccentricity of the inner rotor;

a suction port that suctions oil and a discharge port that discharges the oil; and a cam member linearly moved in a second direction orthogonal to the first direction in response to discharge pressure of the oil from the discharge port, including a cam region provided to increase and decrease the eccentricity of the inner rotor by moving the rotor-housing unit in the first direction following linear movement in one direction of the second direction.

9. The oil pump according to claim 8, wherein the cam member includes a spool member linearly moved in the second direction in response to the discharge pressure of the oil, the rotor-housing unit includes a cam engaging part arranged to face the cam region of the spool member, and an amount of protrusion of the cam region of the spool member with respect to the cam engaging part of the rotor-housing unit changes along the second direction, and the rotor-housing unit is moved in the first direction in response to a change in the amount of protrusion of the cam region associated with movement of the spool member in the one direction of the second direction so that the eccentricity of the inner rotor is increased or decreased.

10. The oil pump according to claim 9, wherein the cam region of the spool member includes:

a first cam region arranged to face the cam engaging part of the rotor-housing unit when the discharge pressure of the oil from the discharge port is within a first pressure range, a second cam region engaging with the cam engaging part of the rotor-housing unit when the discharge pressure of the oil from the discharge port is within a second pressure range larger than the first pressure range, and a third cam region engaging with the cam engaging part of the rotor-housing unit when the discharge pressure of the oil from the discharge port is within a third pressure range larger than the second pressure range, and when the spool member is moved in the one direction of the second direction so as to sequentially switch the cam region of the cam member to the first cam region, the second cam region, and the third cam region in response to an increase in the discharge pressure of the oil from the discharge port, an amount of movement of the rotor-housing unit in the first direction with respect to a rotation center of the inner rotor and the eccentricity of the inner rotor are decreased in a case of the second cam region, and the amount of the movement of the rotor-housing unit in the first direction and the eccentricity of the inner rotor are increased in a case of the third cam region from a state where the amount of the movement of the rotor-housing unit in the first direction with respect to the rotation center of the inner rotor and the eccentricity of the inner rotor are decreased in the case of the second cam region.

11. The oil pump according to claim 10, wherein the first cam region is formed such that the eccentricity of the inner rotor associated with the movement of the rotor-housing unit in the first direction is first eccentricity, the second cam region is formed such that the eccentricity of the inner rotor associated with the movement of the rotor-housing unit in the first direction is second eccentricity smaller than the first eccentricity, and the third cam region is formed such that the eccentricity of the inner rotor associated with the movement of the rotor-housing unit in the first direction is third eccentricity larger than a minimum value of the second eccentricity.

12. The oil pump according to claim 11, wherein the second cam region is provided such that the eccentricity of the inner rotor is decreased from the first eccentricity to the second eccentricity toward the third cam region, and the third cam region is provided such that the eccentricity of the inner rotor is increased from the second eccentricity to the third eccentricity toward a side opposite to the second cam region.

13. The oil pump according to claim 10, wherein the first cam region of the spool member is linearly moved to a position corresponding to the cam engaging part of the rotor-housing unit in the first pressure range so that the rotor-housing unit is linearly moved to a first eccentricity position in the first direction and the eccentricity of the inner rotor with respect to the outer rotor is changed to first eccentricity, which is maximum eccentricity, the second cam region of the spool member is linearly moved to a position engaging with the cam engaging part of the rotor-housing unit in the second pressure range so that the rotor-housing unit is linearly moved to a second eccentricity position in the first direction and the eccentricity of the inner rotor with respect to the outer rotor is changed to second eccentricity smaller than the first eccentricity, and the third cam region of the spool member is linearly moved to the position engaging with the cam engaging part of the rotor-housing unit in the third pressure range so that the rotor-housing unit is linearly moved to a third eccentricity position in the first direction and the eccentricity of the inner rotor with respect to the outer rotor is changed to third eccentricity larger than a minimum value of the second eccentricity.

14. The oil pump according to claim 8, further comprising:

a first urging member that urges the rotor-housing unit toward the cam member; and a second urging member that urges the cam member toward a position on a side of the discharge port.

* * * * *